US011864632B2

(12) United States Patent
Schneider et al.

(10) Patent No.: US 11,864,632 B2
(45) Date of Patent: Jan. 9, 2024

(54) MODULAR SPOOL FOR AUTOMATED FOOTWEAR PLATFORM

(71) Applicant: NIKE, Inc., Beaverton, OR (US)

(72) Inventors: Summer L. Schneider, Beaverton, OR (US); Narissa Chang, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/554,936

(22) Filed: Dec. 17, 2021

(65) Prior Publication Data

US 2022/0104586 A1 Apr. 7, 2022

Related U.S. Application Data

(62) Division of application No. 16/860,520, filed on Apr. 28, 2020, now Pat. No. 11,241,065, which is a division of application No. 15/458,777, filed on Mar. 14, 2017, now Pat. No. 10,660,405.

(60) Provisional application No. 62/308,648, filed on Mar. 15, 2016.

(51) Int. Cl.
*A43C 11/16* (2006.01)
*B65H 75/14* (2006.01)
(Continued)

(52) U.S. Cl.
CPC ..... *A43C 11/165* (2013.01); *A43C 7/00* (2013.01); *A43C 11/16* (2013.01); *B65H 75/14* (2013.01);
(Continued)

(58) Field of Classification Search
CPC ..... A43C 11/165; A43C 11/16; A43C 1/00; A43C 1/06; A43C 7/00; A43C 7/08;
(Continued)

(56) References Cited

U.S. PATENT DOCUMENTS 94,997 A * 9/1869 Bessemer ..... C21C 1/00 266/221
3,197,155 A 7/1965 Yut
(Continued)

FOREIGN PATENT DOCUMENTS

CN 201015448 2/2008
CN 101977525 2/2011
(Continued)

OTHER PUBLICATIONS

"Japanese Application Serial No. 2022-031455, Voluntary Amendment filed Mar. 31, 2022", w English claims, 75 pgs.
(Continued)

*Primary Examiner* — Michael R Mansen
*Assistant Examiner* — Raveen J Dias
(74) *Attorney, Agent, or Firm* — Schwegman, Lundberg & Woessner, P.A.

(57) ABSTRACT

A footwear lacing apparatus can comprise a housing structure, a modular spool and a drive mechanism. The housing structure can comprising a first inlet, a second inlet, and a lacing channel extending between the first and second inlets. The modular spool can be disposed in the lacing channel and can comprise a lower plate including a shaft extending from the lower plate, and an upper plate including a drum portion. The upper plate can be releasably connected to the lower plate at a connection interface. The drive mechanism can couple with the modular spool and can be adapted to rotate the modular spool to wind or unwind a lace cable extending through the lacing channel and between the upper and lower plates of the modular spool.

21 Claims, 39 Drawing Sheets

(51) Int. Cl.

| | |
|---|---|
| ***A43C 7/00*** | (2006.01) |
| *B65H 59/00* | (2006.01) |
| *B65H 69/00* | (2006.01) |
| *B65H 75/44* | (2006.01) |
| *A43B 3/34* | (2022.01) |
| *A43B 3/36* | (2022.01) |
| *A43B 13/14* | (2006.01) |
| *A43C 1/00* | (2006.01) |
| *B65H 59/38* | (2006.01) |
| *B65H 75/30* | (2006.01) |

(52) U.S. Cl.

CPC ..... *B65H 75/148* (2013.01); *A43B 3/34* (2022.01); *A43B 3/36* (2022.01); *A43B 13/14* (2013.01); *A43C 1/00* (2013.01); *B65H 59/00* (2013.01); *B65H 59/38* (2013.01); *B65H 69/00* (2013.01); *B65H 75/141* (2013.01); *B65H 75/30* (2013.01); *B65H 75/4486* (2013.01)

(58) Field of Classification Search

CPC ..... B65H 75/00; B65H 75/02; B65H 75/12; B65H 75/14; B65H 75/141; B65H 75/143; B65H 75/148; B65H 75/22; B65H 75/2227; B65H 75/2236; B65H 75/2245; B65H 75/2254; B65H 75/2263; B65H 75/2272; B65H 75/2281; B65H 75/265; B65H 75/30; B65H 75/34; B65H 75/38; B65H 75/406; B65H 75/44; B65H 75/4428; B65H 75/4431; B65H 75/4434; B65H 75/4481; B65H 75/4486; B65H 59/00; B65H 59/38; B65H 59/384; B65H 69/00; B65H 49/00; B65H 49/18; B65H 49/20; B65H 49/205; A43B 3/34; A43B 3/36; A43B 3/38; A43B 3/40; A43B 13/14

See application file for complete search history.

(56) References Cited

U.S. PATENT DOCUMENTS

| | | | | |
|---|---|---|---|---|
| 4,719,670 | A | 1/1988 | Kurt | |
| 4,787,124 | A * | 11/1988 | Pozzobon | A43C 11/165 36/50.5 |
| 4,901,938 | A | 2/1990 | Cantley et al. | |
| 5,157,813 | A * | 10/1992 | Carroll | A43C 11/165 36/114 |
| 5,606,778 | A * | 3/1997 | Jungkind | A43C 11/165 24/68 SK |
| 5,929,332 | A | 7/1999 | Brown | |
| 5,934,599 | A * | 8/1999 | Hammerslag | A43C 11/00 242/396.2 |
| 6,202,953 | B1 * | 3/2001 | Hammerslag | A43C 11/00 242/396.2 |
| 6,349,893 | B1 | 2/2002 | Daoud | |
| 6,691,433 | B2 | 2/2004 | Liu | |
| 6,694,643 | B1 | 2/2004 | Hsu | |
| 7,076,843 | B2 | 7/2006 | Sakabayashi | |
| 7,162,899 | B2 | 1/2007 | Fawcett et al. | |
| 7,251,966 | B2 * | 8/2007 | Fawcett | E05B 73/0029 70/57.1 |
| 7,367,522 | B2 * | 5/2008 | Chen | A43C 7/00 242/378.1 |
| 7,516,914 | B2 * | 4/2009 | Kovacevich | A43C 11/165 242/395 |
| 7,549,602 | B2 * | 6/2009 | Inugai | B65H 75/14 242/348 |
| 7,584,528 | B2 | 9/2009 | Hu | |
| 7,591,050 | B2 | 9/2009 | Hammerslag | |
| 7,752,774 | B2 | 7/2010 | Ussher | |
| 8,146,853 | B2 | 4/2012 | Godett et al. | |
| 8,177,157 | B2 * | 5/2012 | Weissbrod | B65H 75/14 242/118.6 |
| 8,230,995 | B2 * | 7/2012 | Andrews | A01D 34/416 206/408 |
| 8,231,074 | B2 | 7/2012 | Hu et al. | |
| 8,468,657 | B2 | 6/2013 | Soderberg et al. | |
| 8,752,200 | B2 | 6/2014 | Varshavsky et al. | |
| 9,352,931 | B2 * | 5/2016 | Mori | G11B 23/113 |
| 9,481,546 | B2 * | 11/2016 | Mori | G11B 23/044 |
| 9,578,926 | B2 | 2/2017 | Alt et al. | |
| 9,629,417 | B2 * | 4/2017 | Cavanagh | A43C 11/165 |
| 9,737,115 | B2 | 8/2017 | Soderberg et al. | |
| 9,861,165 | B2 * | 1/2018 | Schneider | A43B 13/14 |
| 9,867,430 | B2 | 1/2018 | Hammerslag et al. | |
| 9,961,963 | B2 * | 5/2018 | Schneider | A43B 3/34 |
| 10,111,496 | B2 * | 10/2018 | Schneider | A43C 11/16 |
| 10,264,852 | B2 * | 4/2019 | Kim | A43C 11/165 |
| 10,390,589 | B2 * | 8/2019 | Schneider | B65H 75/14 |
| 10,433,602 | B2 * | 10/2019 | Kim | B65H 75/4471 |
| 10,463,109 | B2 * | 11/2019 | Schneider | A43C 1/00 |
| 10,470,525 | B2 | 11/2019 | Chen | |
| 10,476,410 | B2 * | 11/2019 | Schneider | H02P 6/06 |
| 10,477,923 | B2 * | 11/2019 | Walker | A43B 3/34 |
| 10,517,355 | B2 * | 12/2019 | Schneider | B65H 59/00 |
| 10,531,708 | B2 * | 1/2020 | Schneider | A43B 3/34 |
| 10,575,590 | B2 * | 3/2020 | Rankin | A43C 7/00 |
| 10,602,805 | B2 * | 3/2020 | Schneider | B65H 75/148 |
| 10,606,016 | B2 * | 3/2020 | Marcouiller | B65H 75/28 |
| 10,631,589 | B2 * | 4/2020 | Sun | A43B 23/0295 |
| 10,660,405 | B2 | 5/2020 | Schneider et al. | |
| 10,827,804 | B2 | 11/2020 | Schneider | |
| 10,856,621 | B2 * | 12/2020 | Schneider | A43C 1/00 |
| 10,874,175 | B2 * | 12/2020 | So | A44B 11/065 |
| 10,952,506 | B2 * | 3/2021 | Schneider | B65H 75/34 |
| 11,033,079 | B2 * | 6/2021 | Bock | A43C 1/003 |
| 11,071,353 | B2 * | 7/2021 | Schneider | A43C 7/06 |
| 11,076,658 | B2 * | 8/2021 | Schneider | B65H 75/148 |
| 11,219,258 | B2 * | 1/2022 | Kim | B65H 75/4471 |
| 11,241,065 | B2 | 2/2022 | Schneider et al. | |
| 11,272,762 | B2 * | 3/2022 | Schneider | A43B 13/14 |
| 11,395,527 | B2 * | 7/2022 | Rankin | A43C 3/02 |
| 11,439,202 | B2 * | 9/2022 | Schneider | A43B 3/34 |
| 2002/0095750 | A1 | 7/2002 | Hammerslag | |
| 2003/0204938 | A1 | 11/2003 | Hammerslag | |
| 2005/0098673 | A1 | 5/2005 | Huang | |
| 2005/0198867 | A1 | 9/2005 | Labbe | |
| 2005/0247813 | A1 * | 11/2005 | Kovacevich | A42B 3/08 242/395 |
| 2006/0156584 | A1 | 7/2006 | Johnson | |
| 2007/0084956 | A1 | 4/2007 | Chen | |
| 2008/0017740 | A1 * | 1/2008 | Inugai | B65H 75/14 242/348 |
| 2008/0196224 | A1 * | 8/2008 | Hu | A43C 11/16 24/68 SK |
| 2008/0301919 | A1 | 12/2008 | Ussher | |
| 2010/0090049 | A1 * | 4/2010 | Weissbrod | B65H 75/22 242/118.6 |
| 2011/0303782 | A1 * | 12/2011 | Hu | A43C 11/20 242/388 |
| 2013/0092780 | A1 | 4/2013 | Soderberg et al. | |
| 2014/0068838 | A1 | 3/2014 | Beers et al. | |
| 2014/0082963 | A1 | 3/2014 | Beers | |
| 2014/0094728 | A1 | 4/2014 | Soderberg et al. | |
| 2014/0223704 | A1 | 8/2014 | Chang | |
| 2014/0263817 | A1 * | 9/2014 | Mori | B65H 75/02 242/600 |
| 2014/0263818 | A1 * | 9/2014 | Mori | G11B 23/037 242/608.2 |
| 2014/0284418 | A1 * | 9/2014 | Mori | B65H 75/22 242/608.2 |
| 2015/0007422 | A1 * | 1/2015 | Cavanagh | A43C 11/165 29/434 |
| 2015/0197973 | A1 | 7/2015 | Day | |
| 2016/0198801 | A1 | 7/2016 | Kim et al. | |
| 2017/0227729 | A1 * | 8/2017 | Marcouiller | B65H 75/14 |
| 2017/0265577 | A1 * | 9/2017 | Schneider | A43B 11/00 |
| 2017/0265578 | A1 * | 9/2017 | Schneider | B65H 59/38 |
| 2017/0265579 | A1 * | 9/2017 | Schneider | A43B 3/36 |

(56) References Cited

U.S. PATENT DOCUMENTS

| | | | | |
|---|---|---|---|---|
| 2017/0265583 | A1 | 9/2017 | Schneider et al. | |
| 2017/0265586 | A1* | 9/2017 | Schneider | A43B 13/14 |
| 2017/0265591 | A1* | 9/2017 | Schneider | B65H 59/00 |
| 2017/0265592 | A1* | 9/2017 | Schneider | A43C 11/165 |
| 2017/0265593 | A1* | 9/2017 | Schneider | B65H 69/00 |
| 2017/0265594 | A1* | 9/2017 | Walker | A43B 3/44 |
| 2017/0267485 | A1* | 9/2017 | Schneider | A43C 7/00 |
| 2017/0272008 | A1* | 9/2017 | Schneider | A43C 11/165 |
| 2018/0110297 | A1* | 4/2018 | Rankin | A43C 11/1406 |
| 2018/0168259 | A1 | 6/2018 | Kim | |
| 2018/0199671 | A1* | 7/2018 | Schneider | A43C 7/06 |
| 2018/0263340 | A1* | 9/2018 | Schneider | A43B 13/14 |
| 2019/0000187 | A1 | 1/2019 | Chen | |
| 2019/0137718 | A1* | 5/2019 | Marcouiller | H02G 11/02 |
| 2019/0174871 | A1* | 6/2019 | Walker | G01L 1/142 |
| 2019/0246745 | A1* | 8/2019 | Bock | A43B 3/36 |
| 2019/0343233 | A1* | 11/2019 | Rankin | A43B 3/34 |
| 2019/0380410 | A1* | 12/2019 | Kim | A43C 11/00 |
| 2019/0380426 | A1* | 12/2019 | Sun | A43B 7/02 |
| 2020/0022458 | A1* | 1/2020 | Schneider | B65H 75/14 |
| 2020/0106373 | A1* | 4/2020 | Schneider | G05B 19/416 |
| 2020/0146400 | A1* | 5/2020 | Schneider | A43C 1/00 |
| 2020/0253336 | A1* | 8/2020 | Schneider | A43C 11/16 |
| 2020/0253337 | A1 | 8/2020 | Schneider et al. | |
| 2020/0281318 | A1* | 9/2020 | Beers | A43C 1/00 |
| 2020/0281319 | A1* | 9/2020 | Schneider | A43B 3/34 |
| 2020/0281320 | A1* | 9/2020 | Schneider | H02P 7/03 |
| 2020/0337418 | A1* | 10/2020 | Chen | B65H 75/4494 |
| 2021/0153606 | A1* | 5/2021 | Schneider | A43C 7/00 |
| 2021/0153607 | A1* | 5/2021 | Schneider | A43C 1/00 |
| 2021/0337931 | A1* | 11/2021 | Schneider | A43C 11/165 |
| 2022/0110414 | A1* | 4/2022 | Sekii | A43C 1/00 |
| 2022/0110417 | A1* | 4/2022 | Sekii | B65H 75/14 |
| 2022/0142304 | A1* | 5/2022 | Chen | B65H 75/4494 |
| 2022/0175090 | A1* | 6/2022 | Sekii | A43C 11/165 |
| 2022/0175091 | A1* | 6/2022 | Sekii | B65H 75/148 |

FOREIGN PATENT DOCUMENTS

| | | | |
|---|---|---|---|
| CN | 104470394 | | 3/2015 |
| CN | 109310183 | | 2/2019 |
| CN | 109310183 | | 4/2022 |
| CN | 114652052 | A | 6/2022 |
| DE | 3900777 | | 7/1990 |
| EP | 3429407 | | 8/2021 |
| EP | 3925476 | | 3/2023 |
| JP | H0554401 | | 3/1993 |
| JP | H06237802 | | 8/1994 |
| JP | H09314 | | 1/1997 |
| JP | H0986674 | | 3/1997 |
| JP | 3900777 | | 1/2007 |
| JP | 3197155 | | 4/2015 |
| JP | 2018532669 | | 11/2018 |
| JP | 2019509822 | | 4/2019 |
| JP | 7034932 | | 3/2022 |
| JP | 2022088385 | | 6/2022 |
| KR | 100986674 | | 10/2010 |
| KR | 101569461 | | 11/2015 |
| KR | 102429745 | B1 | 8/2022 |
| KR | 20220111744 | A | 8/2022 |
| WO | 2017160866 | | 9/2017 |

OTHER PUBLICATIONS

"Chinese Application Serial No. 202210265549.8, Notification to Make Rectification mailed May 10, 2022", With English machine translation, 3 pgs.

"Chinese Application Serial No. 202210265549.8, Response filed May 25, 2022 to Notification to Make Rectification mailed May 10, 2022", w English claims, 44 pgs.

"European Application Serial No. 21190426.3, Response filed Jun. 9, 2022 to Extended European Search Report dated Nov. 22, 2021", 1 pg.

"U.S. Appl. No. 16/860,520, Corrected Notice of Allowability dated Jan. 11, 2022", 3 pgs.

"Korean Application Serial No. 10-2018-7029692, Response filed Dec. 24, 2021 to Notice of Preliminary Rejection dated Jun. 29, 2021", w English claims, 12 pgs.

"International Application Serial No. PCT US2017 022345, International Search Report dated Jun. 20, 2017", 4 pgs.

"International Application Serial No. PCT US2017 022345, Written Opinion dated Jun. 20, 2017", 5 pgs.

"International Application Serial No. PCT US2017 022345, International Preliminary Report on Patentability dated Sep. 27, 2018", 7 pgs.

"Chinese Application Serial No. 201780029884.5, Notification on Correction of Deficiencies mailed Nov. 29, 2018", With English translation, 4 pgs.

"U.S. Appl. No. 15/458,777, Restriction Requirement dated Dec. 21, 2018", 10 pgs.

"U.S. Appl. No. 15/458,777, Respnse filed Feb. 18, 2019 to Restriction Requirement dated Dec. 21, 2018", 9 pgs.

"U.S. Appl. No. 15/458,777, Non Final Office Action dated May 31, 2019", 23 pgs.

"European Application Serial No. 17767356.3, Response filed Apr. 24, 2019 to Communication Pursuant to Rules 161 and 162 dated Nov. 5, 2018", 9 pgs.

"U.S. Appl. No. 15/458,777, Response filed Aug. 28, 2019 to Non-Final Office Action dated May 31, 2019", 15 pgs.

"European Application Serial No. 17767356.3, Extended European Search Report dated Oct. 24, 2019", 9 pgs.

"U.S. Appl. No. 15/458,777, Final Office Action dated Oct. 31, 2019", 19 pgs.

"U.S. Appl. No. 15/458,777, Response filed Dec. 26, 2019 to Final Office Action dated Oct. 31, 2019", 11 pgs.

"U.S. Appl. No. 15/458,777, Notice of Allowance dated Jan. 23, 2020", 12 pgs.

"European Application Serial No. 17767356.3, Response filed Apr. 8, 2020 to Extended European Search Report dated Oct. 24, 2019", 11 pgs.

"U.S. Appl. No. 16/860,520, Preliminary Amendment filed Jun. 12, 2020", 8 pgs.

"Chinese Application Serial No. 201780029884.5, Office Action dated Jul. 6, 2020", w English translation, 12 pgs.

"U.S. Appl. No. 16/860,520, Non Final Office Action dated Jan. 27, 2021", 24 pgs.

"Chinese Application Serial No. 201780029884.5, Response filed Jan. 18, 2021 to Office Action dated Jul. 6, 2020", w English Claims, 47 pgs.

"Japanese Application Serial No. 2018-549215, Notification of Reasons for Rejection dated Mar. 16, 2021", W machine English Translation, 9 pgs.

"Chinese Application Serial No. 201780029884.5, Office Action dated Apr. 8, 2021", w English translation, 8 pgs.

"U.S. Appl. No. 16/860,520, Response filed Jun. 28, 2021 to Non Final Office Action dated Jan. 27, 2021", 16 pgs.

"Korean Application Serial No. 10-2018-7029692, Notice of Preliminary Rejection dated Jun. 29, 2021", w English translation, 5 pgs.

"Japanese Application Serial No. 2018-549215, Response Filed Jul. 15, 2021 to Notification of Reasons for Rejection dated Mar. 16, 2021", w English claims, 11 pgs.

"Chinese Application Serial No. 201780029884.5, Response filed Aug. 10, 2021 to Office Action dated Apr. 8, 2021", w current English claims, 47 pgs.

"U.S. Appl. No. 16/860,520, Notice of Allowance dated Sep. 15, 2021", 13 pgs.

"Chinese Application Serial No. 201780029884.5, Office Action dated Sep. 3, 2021", w English translation, 7 pages.

"Japanese Application Serial No. 2018-549215, Notification of Reasons for Refusal dated Sep. 14, 2021", w English translation, 5 pgs.

"Chinese Application Serial No. 201780029884.5, Response filed Nov. 3, 2021 to Office Action dated Sep. 3, 2021", w English claims, 43 pgs.

(56) References Cited

OTHER PUBLICATIONS

"European Application Serial No. 21190426.3, Extended European Search Report dated Nov. 22, 2021", 5 pgs.
"Japanese Application Serial No. 2018-549215, Response filed Dec. 13, 2021 to Notification of Reasons for Refusal dated Sep. 14, 2021", w English claims, 10 pgs.
"Japanese Application Serial No. 2022-031455, Notification of Reasons for Refusal dated May 9, 2023", w English Translation, 4 pgs.
"European Application Serial No. 23158611.6, Extended European Search Report dated May 25, 2023", 12 pgs.

* cited by examiner

1100

FIXED SEGMENT CONCEPT:

- THE IDEA IS TO DICE UP THE TOTAL TRAVEL BIGFOOT HAS INTO A FIXED NUMBER OF SEGMENTS.
- A SEGMENT IS A DEFINED AMOUNT OF SPOOL TRAVEL.
- NOT ALL SEGMENTS ARE THE SAME AMOUNT AND WILL LIKELY DEPEND ON WHERE THE ENGINE IS ON THE SCALE.
- FOR EXAMPLE, THE SEGMENTS MIGHT HAVE 10DEG OF SPOOL TRAVEL WHEN THE SHOE IS AT THE LOOSE END OF THE SCALE.
- A SEGMENT MIGHT BE 2DEG OF SPOOL TRAVEL WHEN THE SHOE IS AT THE TIGHT END OF THE SCALE.
- POSITION IS THE PRIMARY INPUT FOR THE TIGHTNESS SETTING, MOTOR CURRENT IS USED SECONDARILY OR AS A SAFETY CHECK.

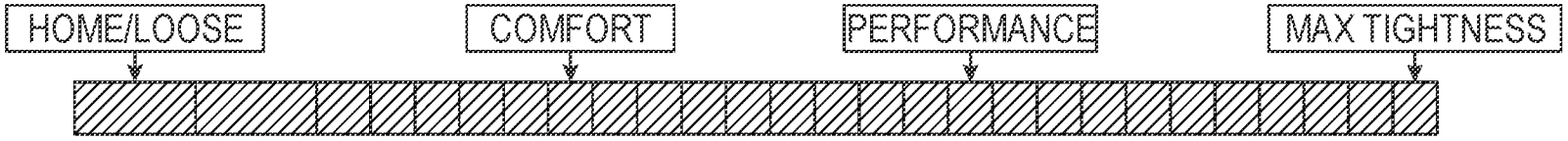

FIG. 11A

1100

MOTION PROFILE TABLES:

- WE DEFINE A TABLE OF "MOVES"."
- A MOTION PROFILE IS A COLLECTION OF THESE MOVES.
- AN AUTOLACE OR A BUTTON PRESS CREATES A SERIES OF THESE MOTION PROFILES.
- WE CONTROL TO A PROFILE AND DEMAND A CURRENT TO SUPPORT IT.
- THIS WOULD BE THE SPOOL MOTION PROFILE.
- WE WOULD HAVE A MULTIPLIER FOR THE GEAR REDUCTION (SO WE CAN CHANGE IT QUICKLY IF NEEDED).

| MOVE (SPOOL) | ACCEL (DEG/S/S) | VEL (DEG/S) | DEC (DEG/S/S) | ANGLE (DEG) |
|---|---|---|---|---|
| HOME TO COMFORT | 100 | 400 | 200 | 550 |
| SEGMENT | 400 | 100 | 400 | 30 |
| COMFORT TO PERFORMANCE | 100 | 400 | 200 | 550 |
| RELAX | 50 | 5 | 50 | -5 |
| RETURN TO HOME | 100 | 400 | 200 | 550 |
| FIND HOME | 100 | 10 | | |
| UNTANGLE 1 | | | | |

FIG. 11B

MOTION PROFILE TABLES:

- WE DEFINE A TABLE OF "MOVES"."
- A MOTION PROFILE IS A COLLECTION OF THESE MOVES.
- AN AUTOLACE OR A BUTTON PRESS CREATES A SERIES OF THESE MOTION PROFILES.
- WE CONTROL TO A PROFILE AND DEMAND A CURRENT TO SUPPORT IT.
- THIS WOULD BE THE SPOOL MOTION PROFILE.
- WE WOULD HAVE A MULTIPLIER FOR THE GEAR REDUCTION (SO WE CAN CHANGE IT QUICKLY IF NEEDED).

MODULAR SPOOL FOR AUTOMATED FOOTWEAR PLATFORM

CLAIM OF PRIORITY

This application is a divisional application of U.S. patent application Ser. No. 16/860,520, filed Apr. 28, 2020, which is a divisional application of U.S. patent application Ser. No. 15/458,777, filed Mar. 14, 2017, issued on May 26, 2020 as U.S. Pat. No. 10,660,405, which application claims the benefit of priority to U.S. Provisional Patent Application Ser. No. 62/308,648, filed on Mar. 15, 2016, the contents of both which are incorporated herein by reference in their entireties.

The following specification describes various aspects of a motorized lacing system, motorized and non-motorized lacing engines, footwear components related to the lacing engines, automated lacing footwear platforms, and related assembly processes. The following specification also describes various aspects of systems and methods for a modular spool assembly for a lacing engine.

BACKGROUND

Devices for automatically tightening an article of footwear have been previously proposed. Liu, in U.S. Pat. No. 6,691,433, titled "Automatic tightening shoe", provides a first fastener mounted on a shoe's upper portion, and a second fastener connected to a closure member and capable of removable engagement with the first fastener to retain the closure member at a tightened state. Liu teaches a drive unit mounted in the heel portion of the sole. The drive unit includes a housing, a spool rotatably mounted in the housing, a pair of pull strings and a motor unit. Each string has a first end connected to the spool and a second end corresponding to a string hole in the second fastener. The motor unit is coupled to the spool. Liu teaches that the motor unit is operable to drive rotation of the spool in the housing to wind the pull strings on the spool for pulling the second fastener towards the first fastener. Liu also teaches a guide tube unit that the pull strings can extend through.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIG. 11A-11D are diagrams illustrating a motor control scheme for a motorized lacing engine, according to some example embodiments.

Figure 1:
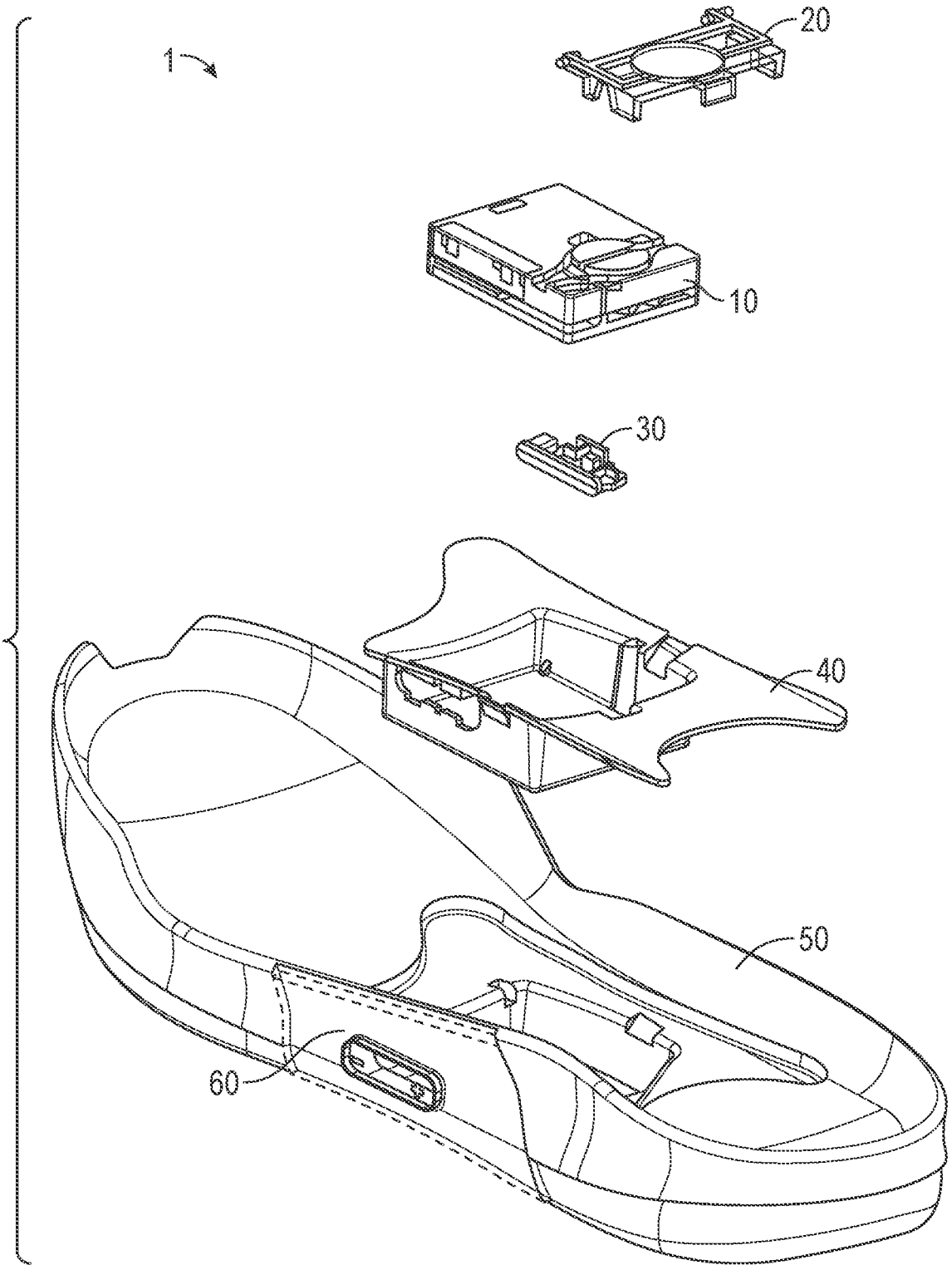
FIG. 1 is an exploded view illustration of components of a motorized lacing system, according to some example embodiments.

The headings provided herein are merely for convenience and do not necessarily affect the scope or meaning of the terms used.

DETAILED DESCRIPTION

The concept of self-tightening shoe laces was first widely popularized by the fictitious power-laced Nike® sneakers worn by Marty McFly in the movie Back to the Future II, which was released back in 1989. While Nike® has since released at least one version of power-laced sneakers similar in appearance to the movie prop version from Back to the Future II, the internal mechanical systems and surrounding footwear platform employed do not necessarily lend themselves to mass production or daily use. Additionally, previous designs for motorized lacing systems comparatively suffered from problems such as high cost of manufacture, complexity, assembly challenges, lack of serviceability, and weak or fragile mechanical mechanisms, to highlight just a few of the many issues. The present inventors have developed a modular footwear platform to accommodate motorized and non-motorized lacing engines that solves some or all of the problems discussed above, among others. The components discussed below provide various benefits including, but not limited to: serviceable components, interchangeable automated lacing engines, robust mechanical design, reliable operation, streamlined assembly processes, and retail-level customization. Various other benefits of the components described below will be evident to persons of skill in the relevant arts.

The motorized lacing engine discussed below was developed from the ground up to provide a robust, serviceable, and inter-changeable component of an automated lacing footwear platform. The lacing engine includes unique design elements that enable retail-level final assembly into a modular footwear platform. The lacing engine design allows for the majority of the footwear assembly process to leverage known assembly technologies, with unique adaptions to standard assembly processes still being able to leverage current assembly resources.

In an example, a footwear lacing apparatus can comprise a housing structure, a modular spool and a drive mechanism. The housing structure can comprising a first inlet, a second inlet, and a lacing channel extending between the first and second inlets. The modular spool can be disposed in the lacing channel and can comprise a lower plate including a shaft extending from the lower plate, and an upper plate including a drum portion. The upper plate can be releasably connected to the lower plate at a connection interface. The drive mechanism can couple with the modular spool and can be adapted to rotate the modular spool to wind or unwind a lace cable extending through the lacing channel and between the upper and lower plates of the modular spool.

The automated footwear platform discussed herein can include a lace winding spool comprising a lower component, an upper component and a connection interface. The lower component can comprise a lower plate, and a shaft extending from the lower plate. The upper component can comprise an upper plate, a drum extending from the upper plate, and a winding channel extending across the drum. The connection interface can be between the upper component and the lower component to hold the lower plate adjacent the drum.

A method of assembling a modular winding spool for a footwear lacing apparatus can comprising positioning an upper plate and a lower plate of the modular winding spool adjacent each other, inserting a fastener into the upper and lower plates to couple the upper and lower plates, and inserting the upper and lower components into a lacing channel of the footwear lacing apparatus.

This initial overview is intended to introduce the subject matter of the present patent application. It is not intended to provide an exclusive or exhaustive explanation of the various inventions disclosed in the following more detailed description.

Automated Footwear Platform

The following discusses various components of the automated footwear platform including a motorized lacing engine, a mid-sole plate, and various other components of the platform. While much of this disclosure focuses on a motorized lacing engine, many of the mechanical aspects of the discussed designs are applicable to a human-powered lacing engine or other motorized lacing engines with additional or fewer capabilities. Accordingly, the term "automated" as used in "automated footwear platform" is not intended to only cover a system that operates without user input. Rather, the term "automated footwear platform" includes various electrically powered and human-power, automatically activated and human activated mechanisms for tightening a lacing or retention system of the footwear.

FIG. 1 is an exploded view illustration of components of a motorized lacing system for footwear, according to some example embodiments. The motorized lacing system 1 illustrated in FIG. 1 includes a lacing engine 10, a lid 20, an actuator 30, a mid-sole plate 40, a mid-sole 50, and an outsole 60. FIG. 1 illustrates the basic assembly sequence of components of an automated lacing footwear platform. The motorized lacing system 1 starts with the mid-sole plate 40 being secured within the mid-sole. Next, the actuator 30 is inserted into an opening in the lateral side of the mid-sole plate opposite to interface buttons that can be embedded in the outsole 60. Next, the lacing engine 10 is dropped into the mid-sole plate 40. In an example, the lacing system 1 is inserted under a continuous loop of lacing cable and the lacing cable is aligned with a spool in the lacing engine 10 (discussed below). Finally, the lid 20 is inserted into grooves in the mid-sole plate 40, secured into a closed position, and latched into a recess in the mid-sole plate 40. The lid 20 can capture the lacing engine 10 and can assist in maintaining alignment of a lacing cable during operation.

In an example, the footwear article or the motorized lacing system 1 includes or is configured to interface with one or more sensors that can monitor or determine a foot presence characteristic. Based on information from one or more foot presence sensors, the footwear including the motorized lacing system 1 can be configured to perform various functions. For example, a foot presence sensor can be configured to provide binary information about whether a foot is present or not present in the footwear. If a binary signal from the foot presence sensor indicates that a foot is present, then the motorized lacing system 1 can be activated, such as to automatically tighten or relax (i.e., loosen) a footwear lacing cable. In an example, the footwear article includes a processor circuit that can receive or interpret signals from a foot presence sensor. The processor circuit can optionally be embedded in or with the lacing engine 10, such as in a sole of the footwear article.

In an example, a foot presence sensor can be configured to provide information about a location of a foot as it enters footwear. The motorized lacing system 1 can generally be activated, such as to tighten a lacing cable, only when a foot is appropriately positioned or seated in the footwear, such as against all or a portion of the footwear article's sole. A foot presence sensor that senses information about a foot travel or location can provide information about whether a foot is fully or partially seated, such as relative to a sole or relative to some other feature of the footwear article. Automated lacing procedures can be interrupted or delayed until information from the sensor indicates that a foot is in a proper position.

In an example, a foot presence sensor can be configured to provide information about a relative location of a foot inside of footwear. For example, the foot presence sensor can be configured to sense whether the footwear is a good "fit" for a given foot, such as by determining a relative position of one or more of a foot's arch, heel, toe, or other component, such as relative to the corresponding portions of the footwear that are configured to receive such foot components. In an example, the foot presence sensor can be configured to sense whether a position of a foot or a foot component has changed relative to some reference, such as due to loosening of a lacing cable over time, or due to natural expansion and contraction of a foot itself.

In an example, a foot presence sensor can include an electrical, magnetic, thermal, capacitive, pressure, optical, or other sensor device that can be configured to sense or receive information about a presence of a body. For example, an electrical sensor can include an impedance sensor that is configured to measure an impedance characteristic between at least two electrodes. When a body such as a foot is located proximal or adjacent to the electrodes, the electrical sensor can provide a sensor signal having a first value, and when a body is located remotely from the electrodes, the electrical sensor can provide a sensor signal having a different second value. For example, a first impedance value can be associated with an empty footwear condition, and a lesser second impedance value can be associated with an occupied footwear condition.

An electrical sensor can include an AC signal generator circuit and an antenna that is configured to emit or receive radio frequency information. Based on proximity of a body relative to the antenna, one or more electrical signal characteristics, such as impedance, frequency, or signal amplitude, can be received and analyzed to determine whether a body is present. In an example, a received signal strength indicator (RSSI) provides information about a power level in a received radio signal. Changes in the RSSI, such as relative to some baseline or reference value, can be used to identify a presence or absence of a body. In an example, WiFi frequencies can be used, for example in one or more of 2.4 GHz, 3.6 GHz, 4.9 GHz, 5 GHz, and 5.9 GHz bands. In an example, frequencies in the kilohertz range can be used, for example, around 400 kHz. In an example, power signal changes can be detected in milliwatt or microwatt ranges.

A foot presence sensor can include a magnetic sensor. A first magnetic sensor can include a magnet and a magnetometer. In an example, a magnetometer can be positioned in or near the lacing engine 10. A magnet can be located remotely from the lacing engine 10, such as in a secondary sole, or insole, that is configured to be worn above the outsole 60. In an example, the magnet is embedded in a foam or other compressible material of the secondary sole. As a user depresses the secondary sole such as when standing or walking, corresponding changes in the location of the magnet relative to the magnetometer can be sensed and reported via a sensor signal.

A second magnetic sensor can include a magnetic field sensor that is configured to sense changes or interruptions (e.g., via the Hall effect) in a magnetic field. When a body is proximal to the second magnetic sensor, the sensor can generate a signal that indicates a change to an ambient magnetic field. For example, the second magnetic sensor can include a Hall effect sensor that varies a voltage output signal in response to variations in a detected magnetic field. Voltage changes at the output signal can be due to production of a voltage difference across an electric signal conductor, such as transverse to an electric current in the conductor and a magnetic field perpendicular to the current.

In an example, the second magnetic sensor is configured to receive an electromagnetic field signal from a body. For example, Varshaysky et al., in U.S. Pat. No. 8,752,200, titled "Devices, systems and methods for security using magnetic field based identification", teaches using a body's unique electromagnetic signature for authentication. In an example, a magnetic sensor in a footwear article can be used to authenticate or verify that a present user is a shoe's owner via a detected electromagnetic signature, and that the article should lace automatically, such as according to one or more specified lacing preferences (e.g., tightness profile) of the owner.

In an example, a foot presence sensor includes a thermal sensor that is configured to sense a change in temperature in or near a portion of the footwear. When a wearer's foot enters a footwear article, the article's internal temperature changes when the wearer's own body temperature differs from an ambient temperature of the footwear article. Thus the thermal sensor can provide an indication that a foot is likely to present or not based on a temperature change.

In an example, a foot presence sensor includes a capacitive sensor that is configured to sense a change in capacitance. The capacitive sensor can include a single plate or electrode, or the capacitive sensor can include a multiple-plate or multiple-electrode configuration. Capacitive-type foot presence sensors are described at length below.

In an example, a foot presence sensor includes an optical sensor. The optical sensor can be configured to determine whether a line-of-sight is interrupted, such as between opposite sides of a footwear cavity. In an example, the optical sensor includes a light sensor that can be covered by a foot when the foot is inserted into the footwear. When the sensor indicates a change in a sensed lightness condition, an indication of a foot presence or position can be provided.

In an example, the housing structure 100 provides an air tight or hermetic seal around the components that are enclosed by the housing structure 100. In an example, the housing structure 100 encloses a separate, hermetically sealed cavity in which a pressure sensor can be disposed. See FIG. 17 and the corresponding discussion below regarding a pressure sensor disposed in a sealed cavity.

Figure 2A:
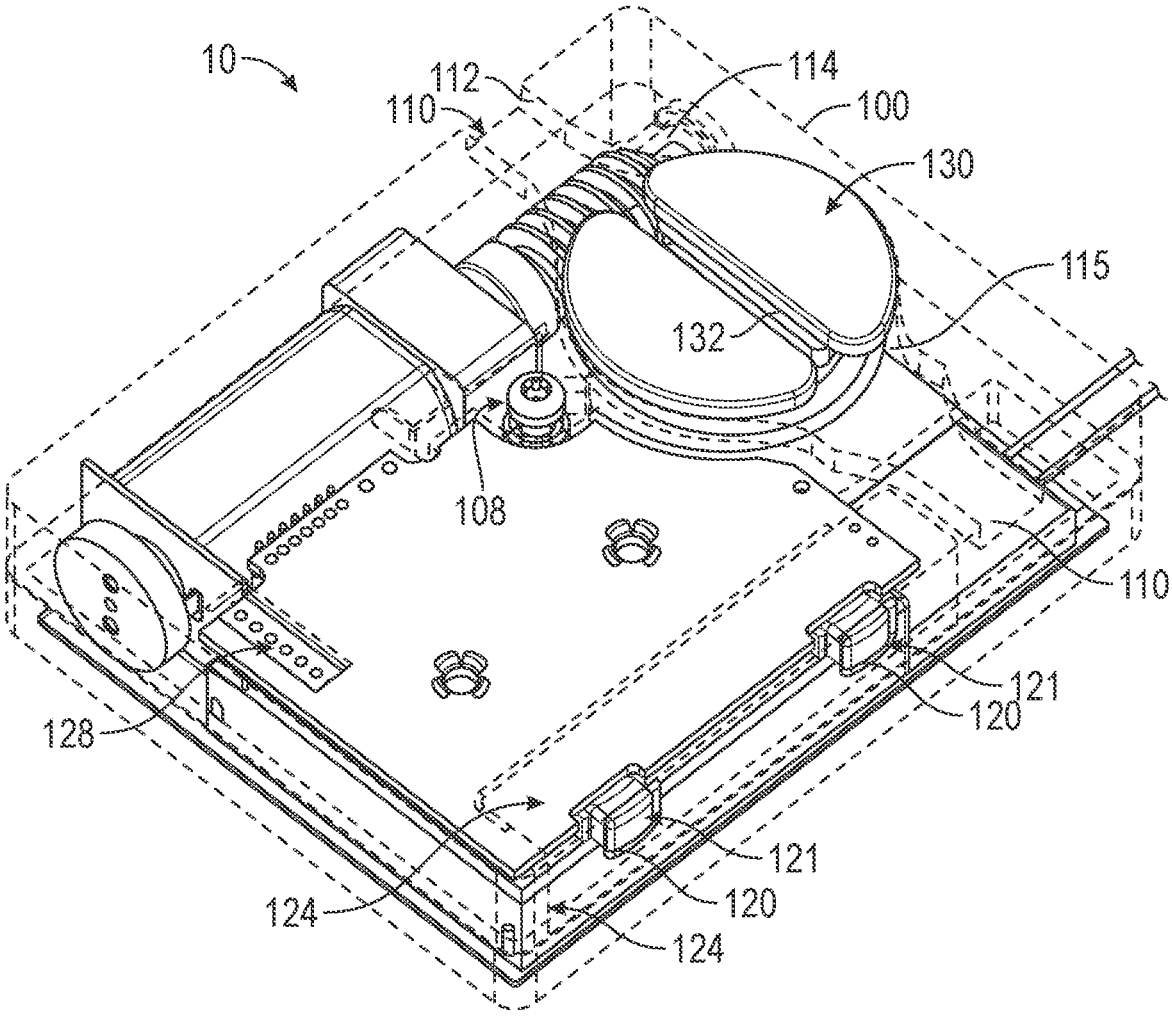
FIGS. 2A-2N are diagrams and drawings illustrating a motorized lacing engine, according to some example embodiments.
Figure 2B:
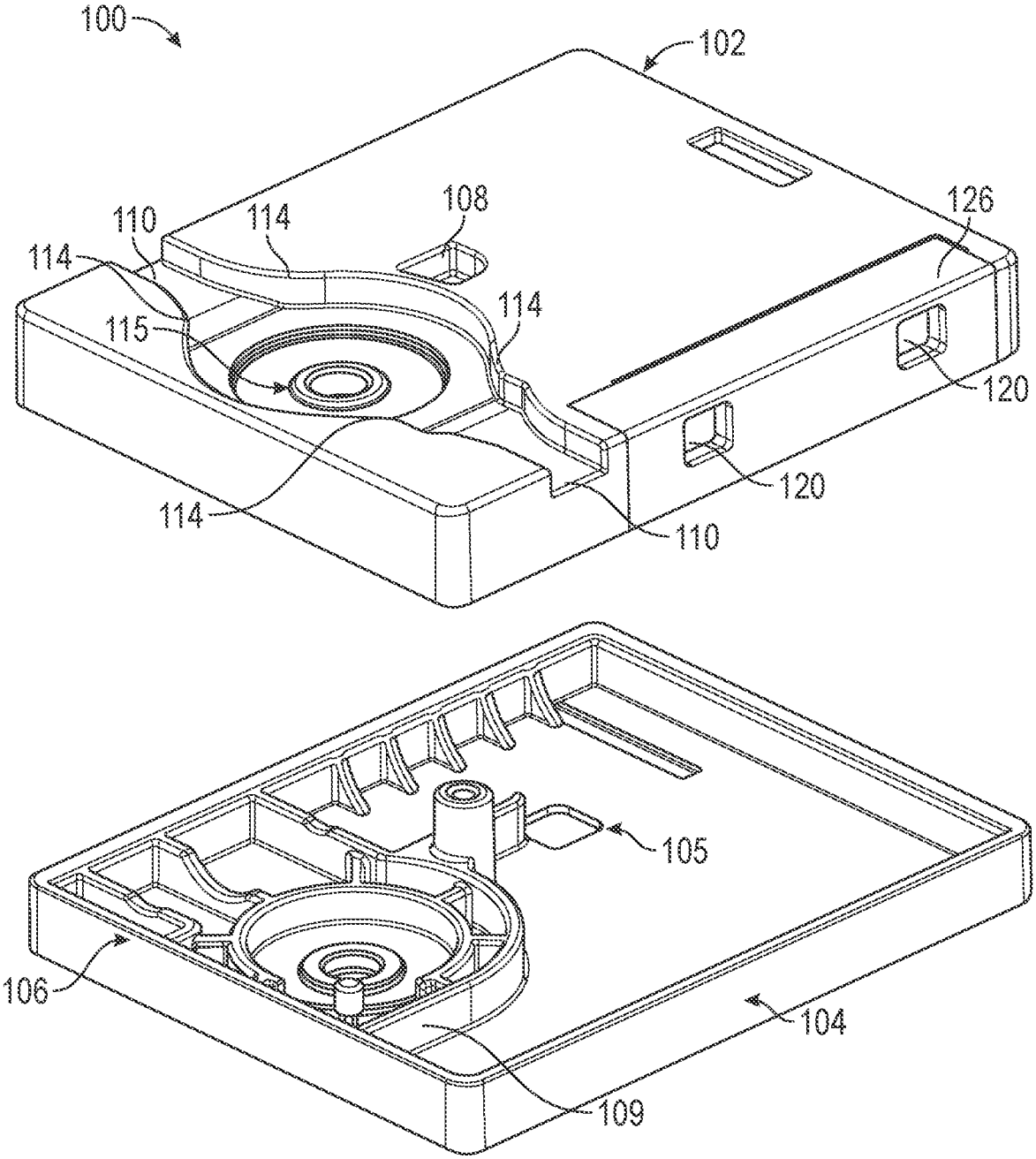
Figure 2C:
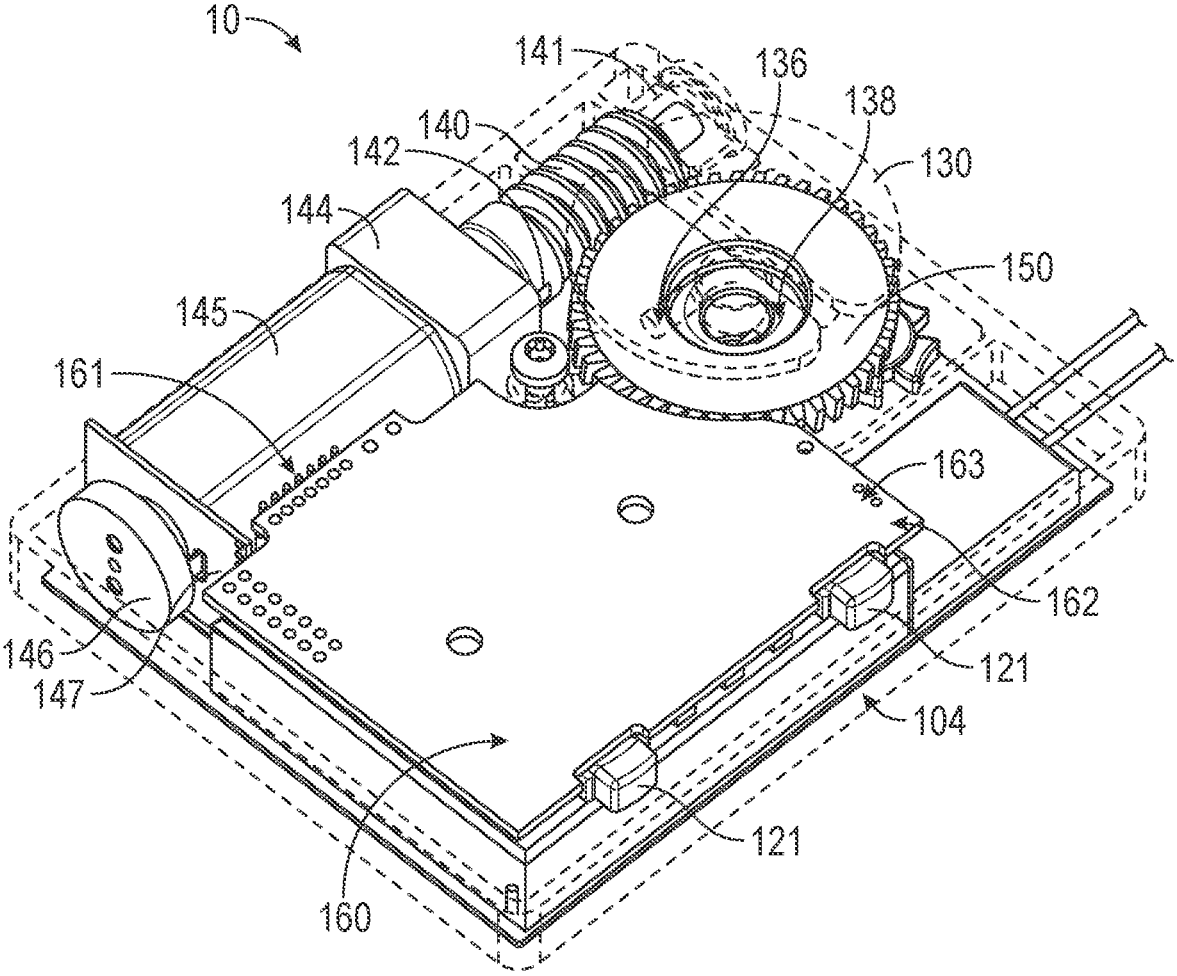
Figure 2D:
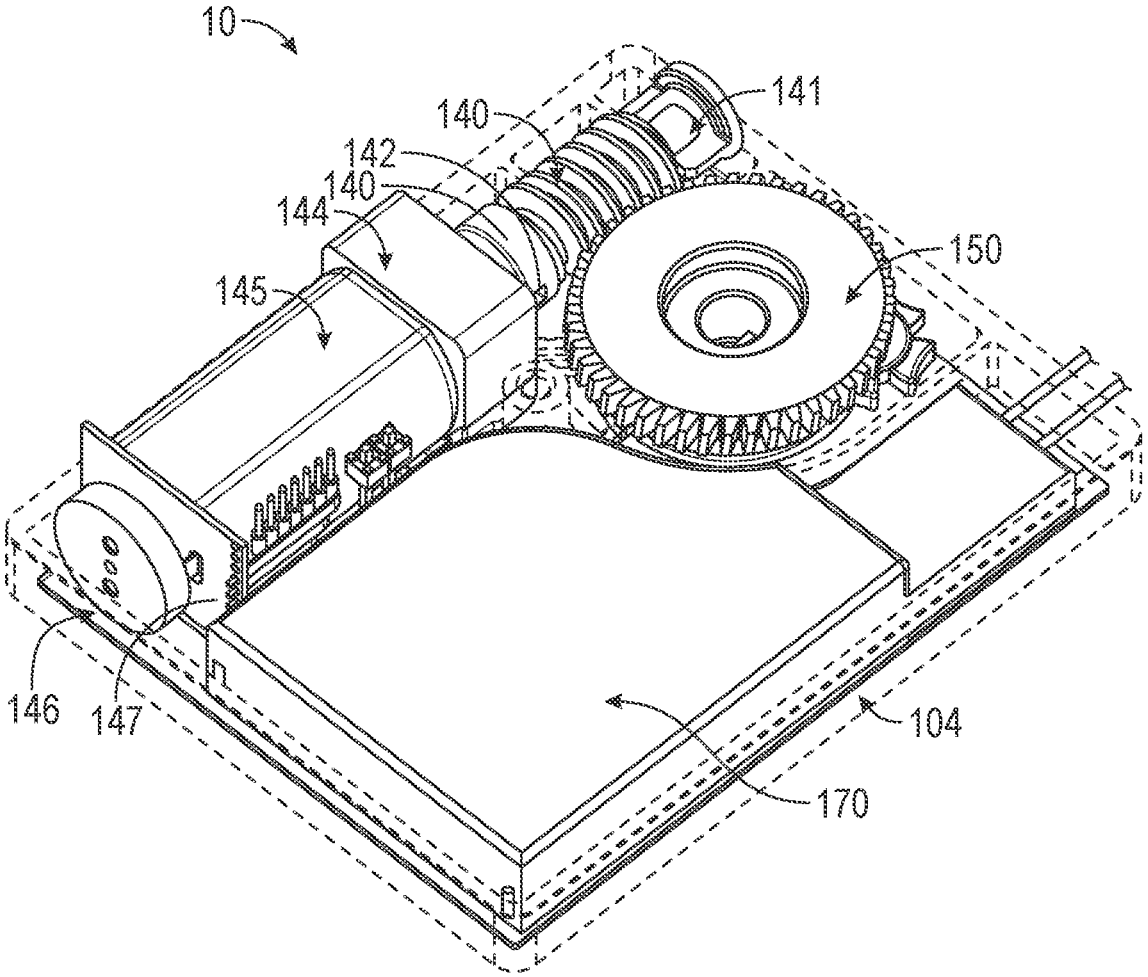
Figure 2E:
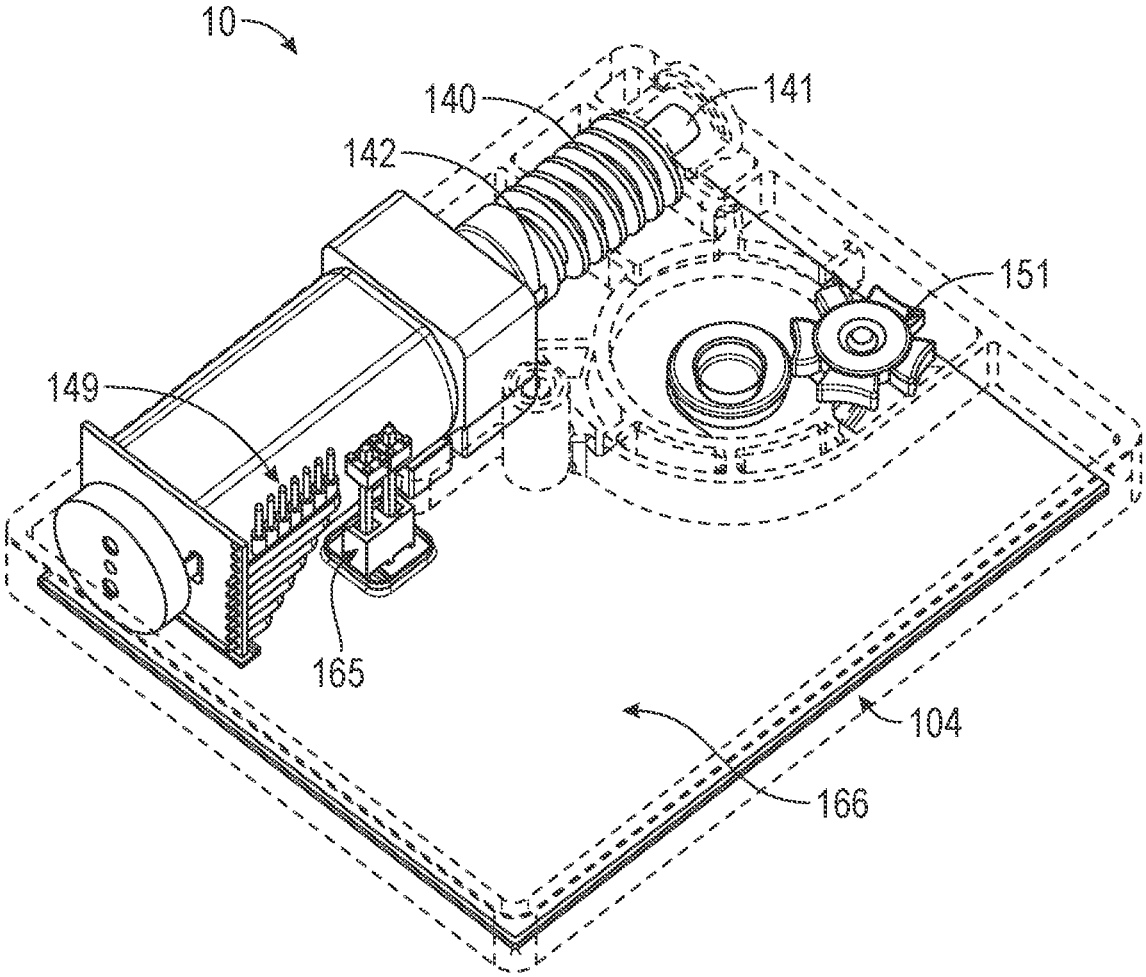
Figure 2F:
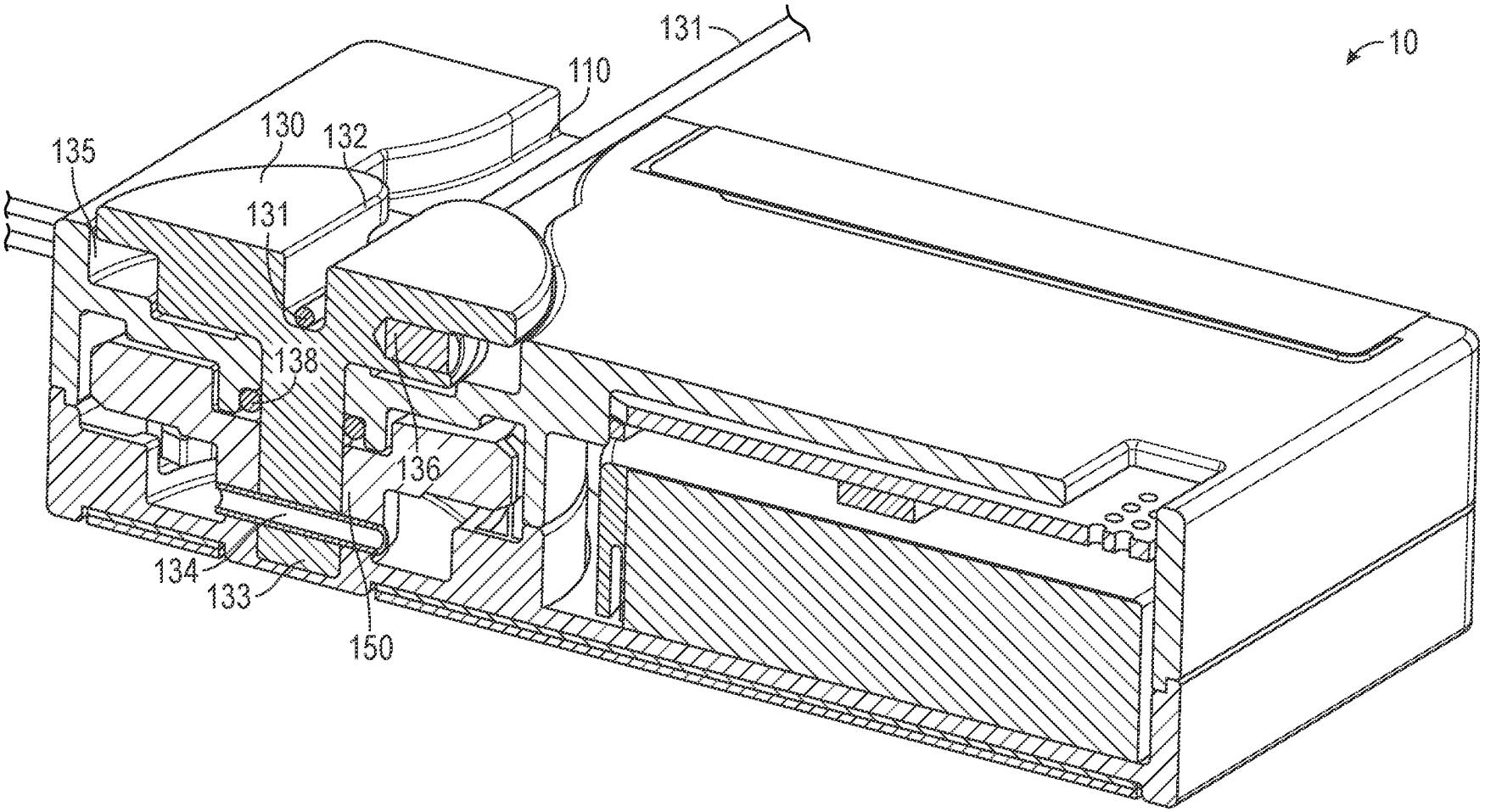
Figure 2G:
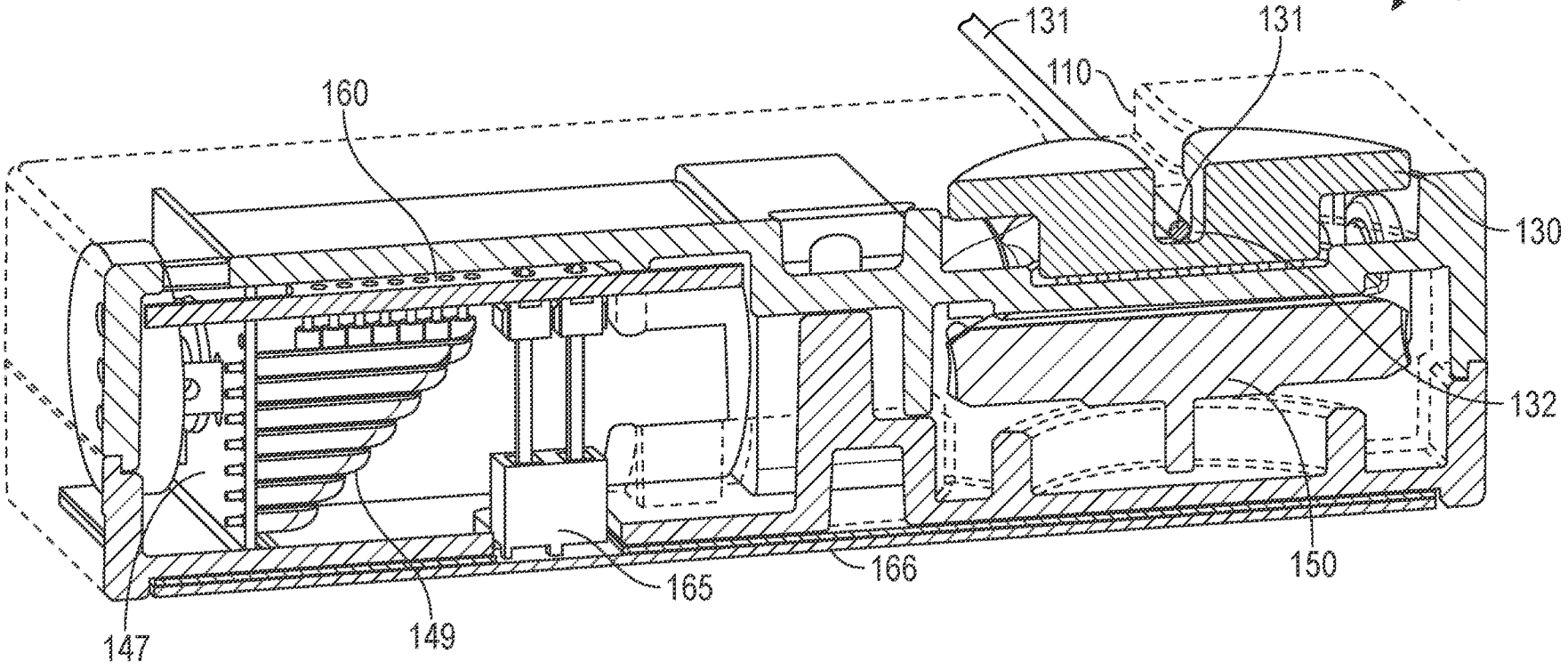
Figure 2H:
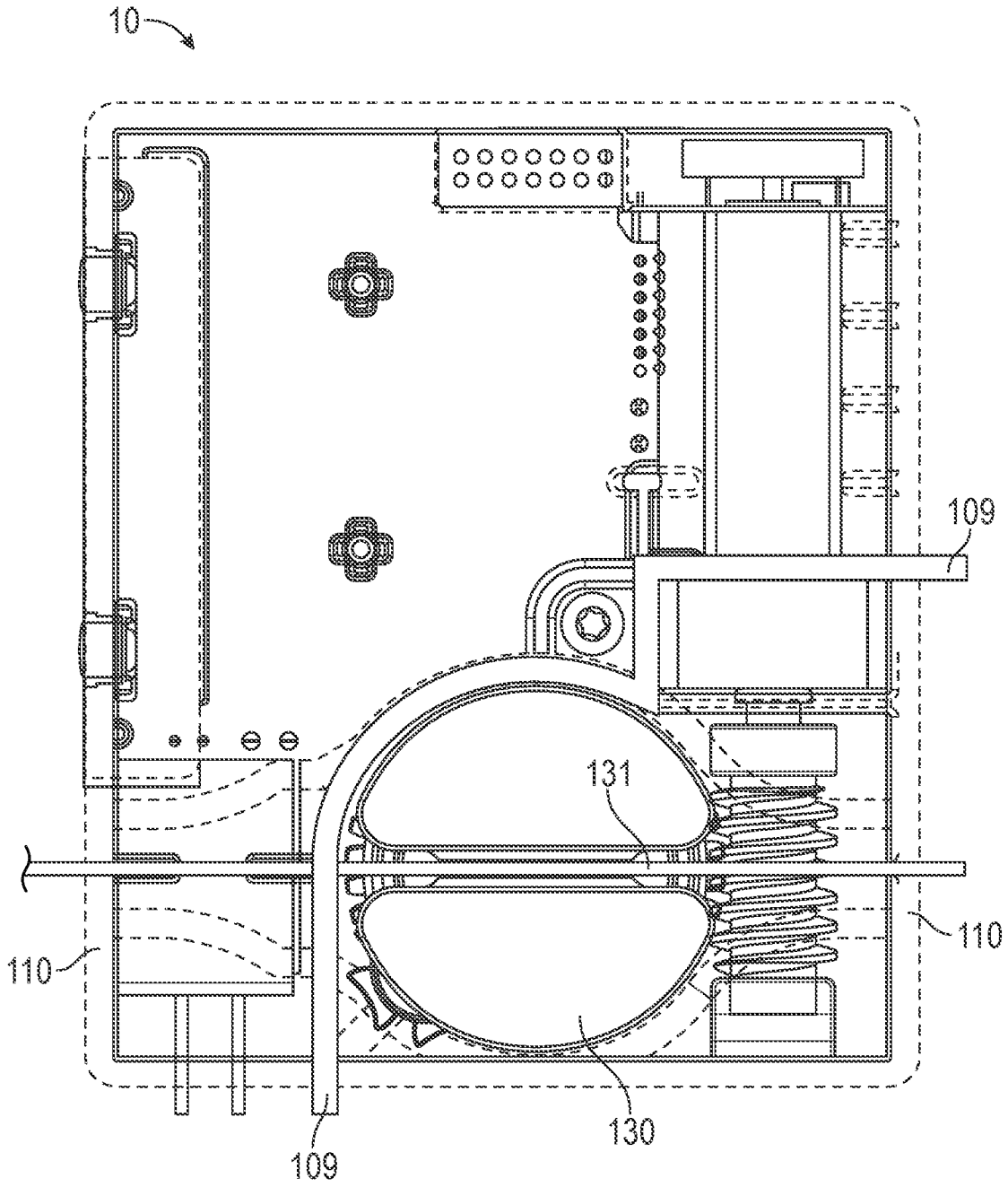
Figure 2I:
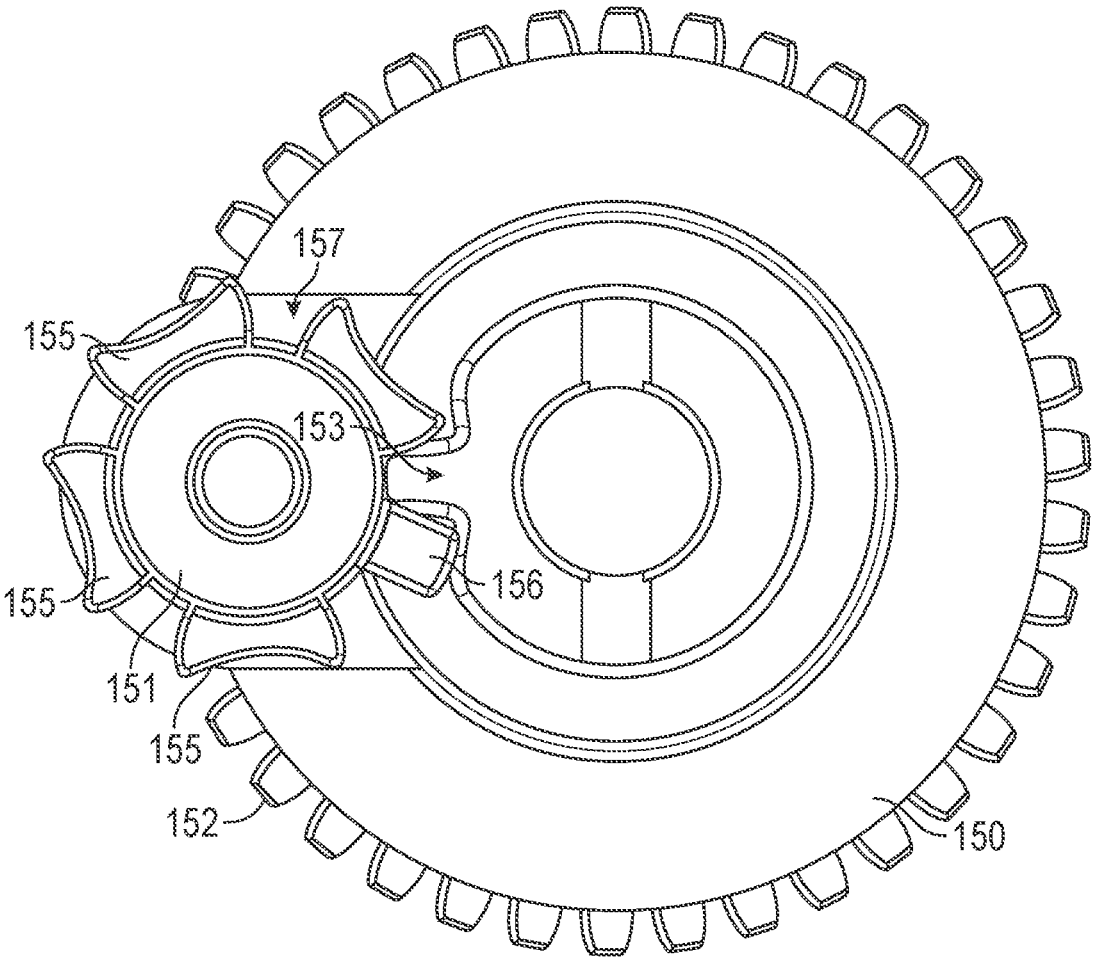
Figure 2J:
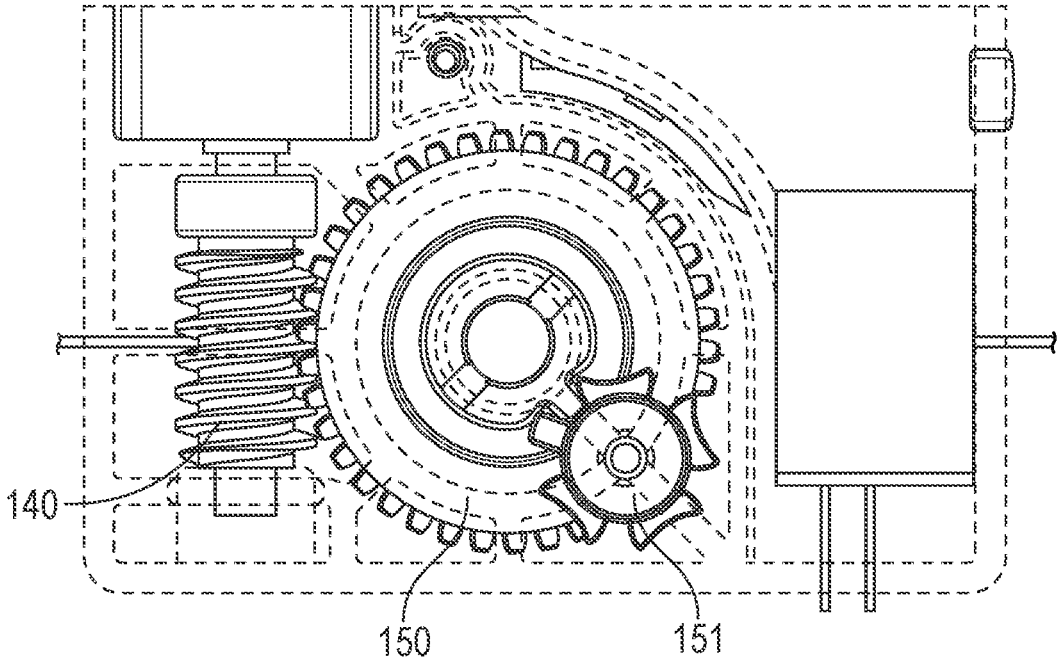
Figure 2K:
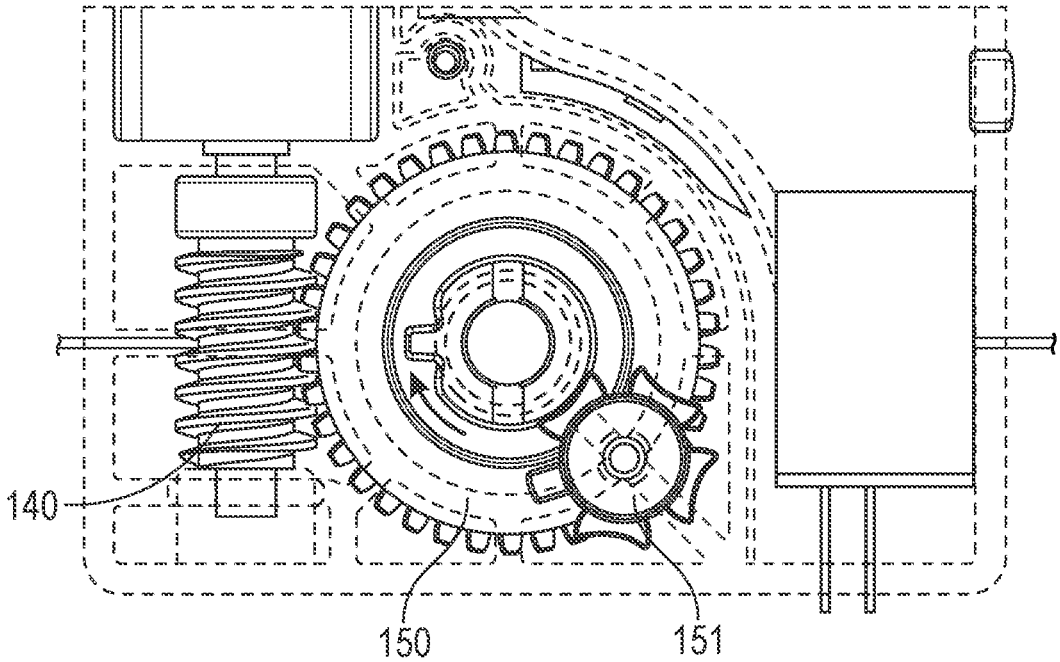
Figure 2L:
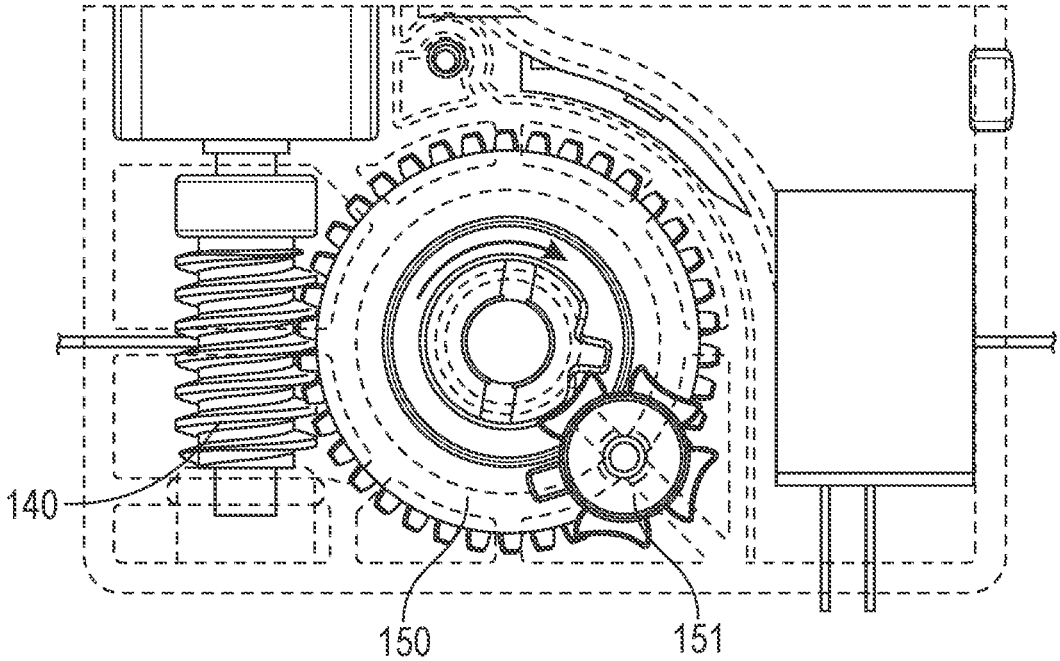
Figure 2M:
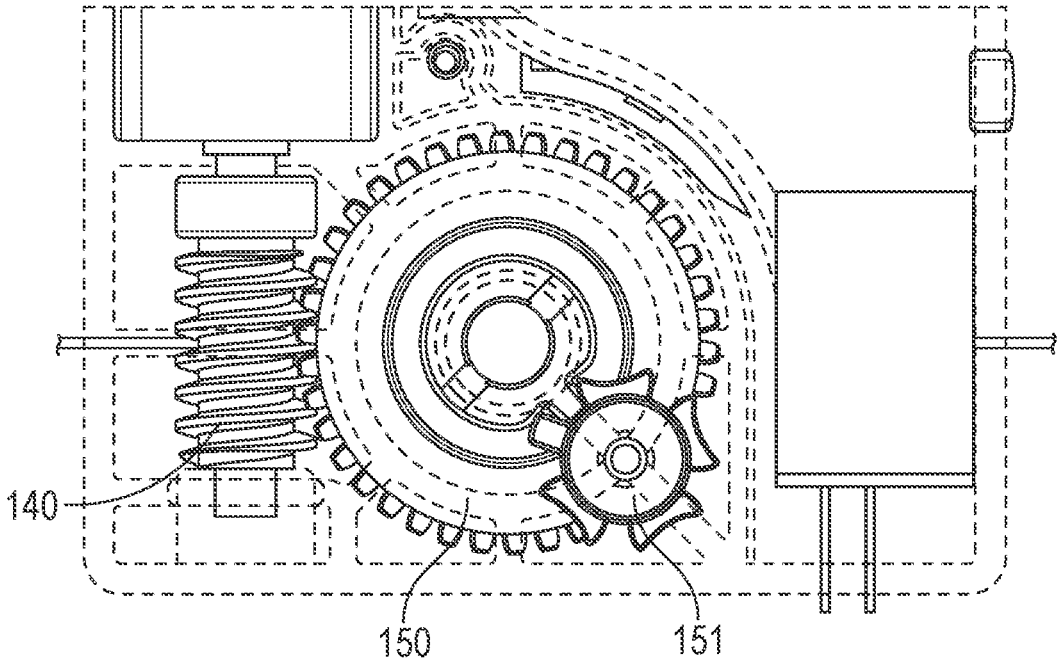
Figure 2N:
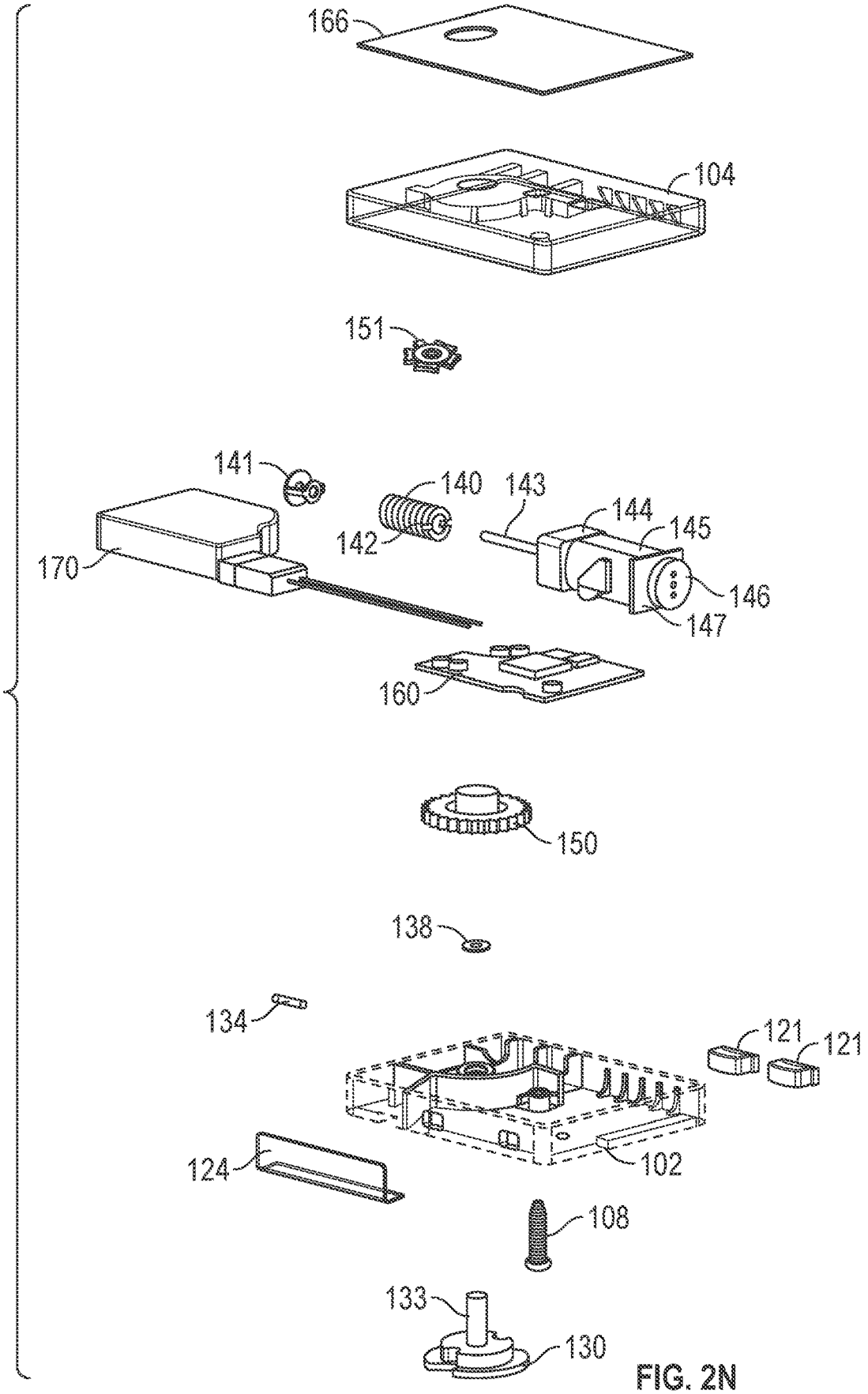

Examples of the lacing engine 10 are described in detail in reference to FIGS. 2A-2N. Examples of the actuator 30 are described in detail in reference to FIGS. 3A-3D. Examples of the mid-sole plate 40 are described in detail in reference to FIGS. 4A-4D. Various additional details of the motorized lacing system 1 are discussed throughout the remainder of the description.

FIGS. 2A-2N are diagrams and drawings illustrating a motorized lacing engine, according to some example embodiments. FIG. 2A introduces various external features of an example lacing engine 10, including a housing structure 100, case screw 108, lace channel 110 (also referred to as lace guide relief 110), lace channel wall 112, lace channel transition 114, spool recess 115, button openings 120, buttons 121, button membrane seal 124, programming header 128, spool 130, and lace groove 132. Additional details of the housing structure 100 are discussed below in reference to FIG. 2B.

In an example, the lacing engine 10 is held together by one or more screws, such as the case screw 108. The case screw 108 is positioned near the primary drive mechanisms to enhance structural integrity of the lacing engine 10. The case screw 108 also functions to assist the assembly process, such as holding the case together for ultra-sonic welding of exterior seams.

In this example, the lacing engine 10 includes a lace channel 110 to receive a lace or lace cable once assembled into the automated footwear platform. The lace channel 110 can include a lace channel wall 112. The lace channel wall 112 can include chamfered edges to provide a smooth guiding surface for a lace cable to run in during operation. Part of the smooth guiding surface of the lace channel 110 can include a channel transition 114, which is a widened portion of the lace channel 110 leading into the spool recess 115. The spool recess 115 transitions from the channel transition 114 into generally circular sections that conform closely to the profile of the spool 130. The spool recess 115 assists in retaining the spooled lace cable, as well as in retaining position of the spool 130. However, other aspects of the design provide primary retention of the spool 130. In this example, the spool 130 is shaped similarly to half of a yo-yo with a lace groove 132 running through a flat top surface and a spool shaft 133 (not shown in FIG. 2A) extending inferiorly from the opposite side. The spool 130 is described in further detail below in reference of additional figures.

The lateral side of the lacing engine 10 includes button openings 120 that enable buttons 121 for activation of the mechanism to extend through the housing structure 100. The buttons 121 provide an external interface for activation of switches 122, illustrated in additional figures discussed below. In some examples, the housing structure 100 includes button membrane seal 124 to provide protection from dirt and water. In this example, the button membrane seal 124 is up to a few mils (thousandth of an inch) thick clear plastic (or similar material) adhered from a superior surface of the housing structure 100 over a corner and down a lateral side. In another example, the button membrane seal 124 is a 2 mil thick vinyl adhesive backed membrane covering the buttons 121 and button openings 120.

FIG. 2B is an illustration of housing structure 100 including top section 102 and bottom section 104. In this example, the top section 102 includes features such as the case screw 108, lace channel 110, lace channel transition 114, spool recess 115, button openings 120, and button seal recess 126. The button seal recess 126 is a portion of the top section 102 relieved to provide an inset for the button membrane seal 124. In this example, the button seal recess 126 is a couple mil recessed portion on the lateral side of the superior surface of the top section 104 transitioning over a portion of the lateral edge of the superior surface and down the length of a portion of the lateral side of the top section 104.

In this example, the bottom section 104 includes features such as wireless charger access 105, joint 106, and grease isolation wall 109. Also illustrated, but not specifically identified, is the case screw base for receiving case screw 108 as well as various features within the grease isolation wall 109 for holding portions of a drive mechanism. The grease isolation wall 109 is designed to retain grease or similar compounds surrounding the drive mechanism away from the electrical components of the lacing engine 10 including the gear motor and enclosed gear box.

FIG. 2C is an illustration of various internal components of lacing engine 10, according to example embodiments. In this example, the lacing engine 10 further includes spool magnet 136, O-ring seal 138, worm drive 140, bushing 141, worm drive key 142, gear box 144, gear motor 145, motor encoder 146, motor circuit board 147, wire harness 149, worm gear 150, circuit board 160, motor header 161, battery connection 162, and wired charging header 163. The spool magnet 136 assists in tracking movement of the spool 130 though detection by a magnetometer (not shown in FIG. 2C). The o-ring seal 138 functions to seal out dirt and moisture that could migrate into the lacing engine 10 around the spool shaft 133.

In this example, major drive components of the lacing engine 10 include worm drive 140, worm gear 150, gear motor 145 and gear box 144. The worm gear 150 is designed to inhibit back driving of worm drive 140 and gear motor 145, which means the major input forces coming in from the lacing cable via the spool 130 are resolved on the comparatively large worm gear and worm drive teeth. This arrangement protects the gear box 144 from needing to include gears of sufficient strength to withstand both the dynamic loading from active use of the footwear platform or tightening loading from tightening the lacing system. The worm drive 140 includes additional features to assist in protecting the more fragile portions of the drive system, such as the worm drive key 142. In this example, the worm drive key 142 is a radial slot in the motor end of the worm drive 140 that interfaces with a pin through the drive shaft coming out of the gear box 144. This arrangement prevents the worm drive 140 from imparting any axial forces on the gear box 144 or gear motor 145 by allowing the worm drive 140 to move freely in an axial direction (away from the gear box 144) transferring those axial loads onto bushing 141 and the housing structure 100.

FIG. 2D is an illustration depicting additional internal components of the lacing engine 10. In this example, the lacing engine 10 includes drive components such as worm drive 140, bushing 141, gear box 144, gear motor 145, motor encoder 146, motor circuit board 147 and worm gear 150. FIG. 2D adds illustration of battery 170 as well as a better view of some of the drive components discussed above.

FIG. 2E is another illustration depicting internal components of the lacing engine 10. In FIG. 2E the worm gear 150 is removed to better illustrate the indexing wheel 151 (also referred to as the Geneva wheel 151). The indexing wheel 151, as described in further detail below, provides a mechanism to home the drive mechanism in case of electrical or mechanical failure and loss of position. In this example, the lacing engine 10 also includes a wireless charging interconnect 165 and a wireless charging coil 166, which are located inferior to the battery 170 (which is not shown in this figure). In this example, the wireless charging coil 166 is mounted on an external inferior surface of the bottom section 104 of the lacing engine 10.

FIG. 2F is a cross-section illustration of the lacing engine 10, according to example embodiments. FIG. 2F assists in illustrating the structure of the spool 130 as well as how the lace groove trove 132 and lace channel 110 interface with lace cable 131. As shown in this example, lace 131 runs continuously through the lace channel 110 and into the lace groove 132 of the spool 130. The cross-section illustration also depicts lace recess 135, which is where the lace 131 will build up as it is taken up by rotation of the spool 130. The lace 131 is captured by the lace groove 132 as it runs across the lacing engine 10, so that when the spool 130 is turned, the lace 131 is rotated onto a body of the spool 130 within the lace recess 135.

As illustrated by the cross-section of lacing engine 10, the spool 130 includes a spool shaft 133 that couples with worm gear 150 after running through an O-ring 138. In this example, the spool shaft 133 is coupled to the worm gear via keyed connection pin 134. In some examples, the keyed connection pin 134 only extends from the spool shaft 133 in one axial direction, and is contacted by a key on the worm gear in such a way as to allow for an almost complete revolution of the worm gear 150 before the keyed connection pin 134 is contacted when the direction of worm gear 150 is reversed. A clutch system could also be implemented to couple the spool 130 to the worm gear 150. In such an example, the clutch mechanism could be deactivated to allow the spool 130 to run free upon de-lacing (loosening). In the example of the keyed connection pin 134 only extending is one axial direction from the spool shaft 133, the spool is allowed to move freely upon initial activation of a de-lacing process, while the worm gear 150 is driven backward. Allowing the spool 130 to move freely during the initial portion of a de-lacing process assists in preventing tangles in the lace 131 as it provides time for the user to begin loosening the footwear, which in turn will tension the lace 131 in the loosening direction prior to being driven by the worm gear 150.

FIG. 2G is another cross-section illustration of the lacing engine 10, according to example embodiments. FIG. 2G illustrates a more medial cross-section of the lacing engine 10, as compared to FIG. 2F, which illustrates additional components such as circuit board 160, wireless charging interconnect 165, and wireless charging coil 166. FIG. 2G is also used to depict additional detail surround the spool 130 and lace 131 interface.

FIG. 2H is a top view of the lacing engine 10, according to example embodiments. FIG. 2H emphasizes the grease isolation wall 109 and illustrates how the grease isolation wall 109 surrounds certain portions of the drive mechanism, including spool 130, worm gear 150, worm drive 140, and gear box 145. In certain examples, the grease isolation wall 109 separates worm drive 140 from gear box 145. FIG. 2H also provides a top view of the interface between spool 130 and lace cable 131, with the lace cable 131 running in a medial-lateral direction through lace groove 132 in spool 130.

FIG. 2I is a top view illustration of the worm gear 150 and index wheel 151 portions of lacing engine 10, according to example embodiments. The index wheel 151 is a variation on the well-known Geneva wheel used in watchmaking and film projectors. A typical Geneva wheel or drive mechanism provides a method of translating continuous rotational movement into intermittent motion, such as is needed in a film projector or to make the second hand of a watch move intermittently. Watchmakers used a different type of Geneva wheel to prevent over-winding of a mechanical watch spring, but using a Geneva wheel with a missing slot (e.g., one of the Geneva slots 157 would be missing). The missing slot would prevent further indexing of the Geneva wheel, which was responsible for winding the spring and prevents over-winding. In the illustrated example, the lacing engine 10 includes a variation on the Geneva wheel, indexing wheel 151, which includes a small stop tooth 156 that acts as a stopping mechanism in a homing operation. As illustrated in FIGS. 2J-2M, the standard Geneva teeth 155 simply index for each rotation of the worm gear 150 when the index tooth 152 engages the Geneva slot 157 next to one of the Geneva teeth 155. However, when the index tooth 152 engages the Geneva slot 157 next to the stop tooth 156 a larger force is generated, which can be used to stall the drive mechanism in a horning operation. The stop tooth 156 can be used to create a known location of the mechanism for homing in case of loss of other positioning information, such as the motor encoder 146.

FIG. 2J-2M are illustrations of the worm gear 150 and index wheel 151 moving through an index operation, according to example embodiments. As discussed above, these figures illustrate what happens during a single full revolution of the worm gear 150 starting with FIG. 2J though FIG. 2M. In FIG. 2J, the index tooth 153 of the worm gear 150 is engaged in the Geneva slot 157 between a first Geneva tooth 155 of the Geneva teeth 155 and the stop tooth 156. FIG. 2K illustrates the index wheel 151 in a first index position, which is maintained as the index tooth 153 starts its revolution with the worm gear 150. In FIG. 2L, the index tooth 153 begins to engage the Geneva slot 157 on the opposite side of the first Geneva tooth 155. Finally, in FIG. 2M the index tooth 153 is fully engaged within a Geneva lot 157 between the first Geneva tooth 155 and a second Geneva tooth 155. The process shown in FIGS. 2J-2M continues with each revolution of the worm gear 150 until the index tooth 153 engages the stop tooth 156. As discussed above, when the index tooth 153 engages the stop tooth 156, the increased forces can stall the drive mechanism.

FIG. 2N is an exploded view of lacing engine 10, according to example embodiments. The exploded view of the lacing engine 10 provides an illustration of how all the various components fit together. FIG. 2N shows the lacing engine 10 upside down, with the bottom section 104 at the top of the page and the top section 102 near the bottom. In this example, the wireless charging coil 166 is shown as being adhered to the outside (bottom) of the bottom section 104. The exploded view also provide a good illustration of how the worm drive 140 is assembled with the bushing 141, drive shaft 143, gear box 144 and gear motor 145. The illustration does not include a drive shaft pin that is received within the worm drive key 142 on a first end of the worm drive 140. As discussed above, the worm drive 140 slides over the drive shaft 143 to engage a drive shaft pin in the worm drive key 142, which is essentially a slot running transverse to the drive shaft 143 in a first end of the worm drive 140.

Figure 3A:
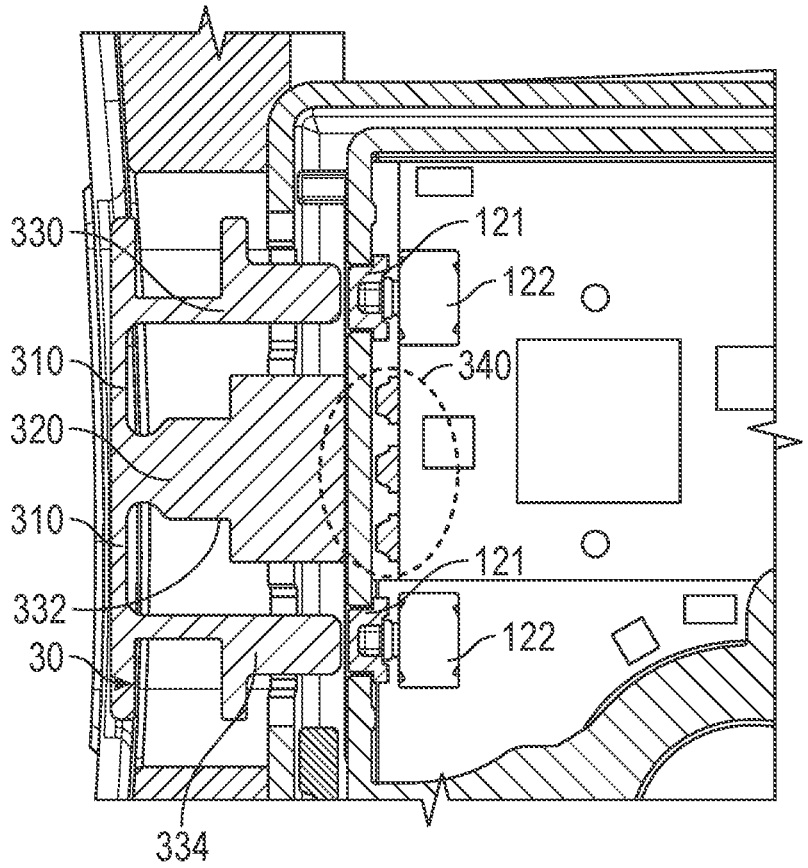
FIGS. 3A-3D are diagrams and drawings illustrating an actuator for interfacing with a motorized lacing engine, according to some example embodiments.

FIGS. 3A-3D are diagrams and drawings illustrating an actuator 30 for interfacing with a motorized lacing engine, according to an example embodiment. In this example, the actuator 30 includes features such as bridge 310, light pipe 320, posterior arm 330, central arm 332, and anterior arm 334. FIG. 3A also illustrates related features of lacing engine 10, such as LEDs 340 (also referenced as LED 340), buttons 121 and switches 122. In this example, the posterior arm 330 and anterior arm 334 each can separately activate one of the switches 122 through buttons 121. The actuator 30 is also designed to enable activation of both switches 122 simultaneously, for things like reset or other functions. The primary function of the actuator 30 is to provide tightening and loosening commands to the lacing engine 10. The actuator 30 also includes a light pipe 320 that directs light from LEDs 340 out to the external portion of the footwear platform (e.g., outsole 60). The light pipe 320 is structured to disperse light from multiple individual LED sources evening across the face of actuator 30.

In this example, the arms of the actuator 30, posterior arm 330 and anterior arm 334, include flanges to prevent over activation of switches 122 providing a measure of safety against impacts against the side of the footwear platform. The large central arm 332 is also designed to carry impact loads against the side of the lacing engine 10, instead of allowing transmission of these loads against the buttons 121.

Figure 3B:
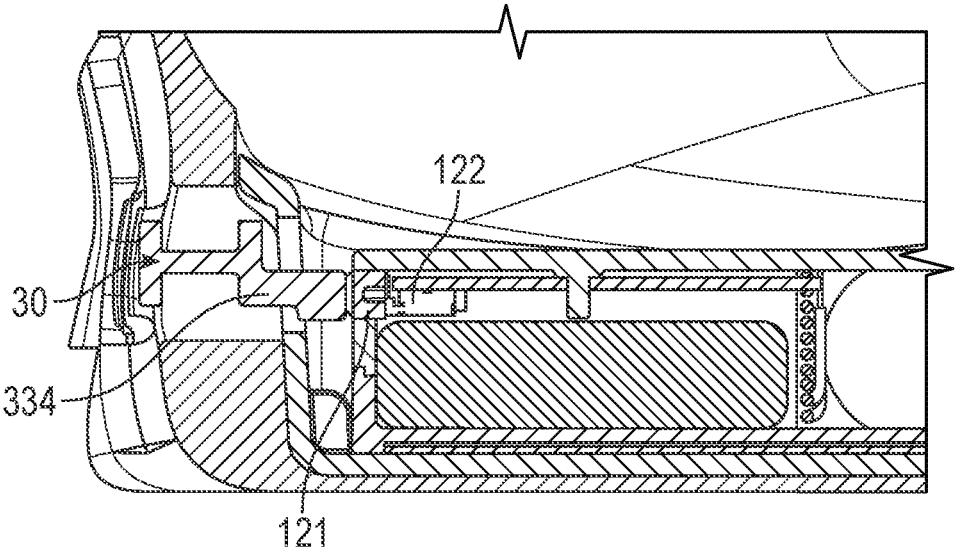
Figure 3C:
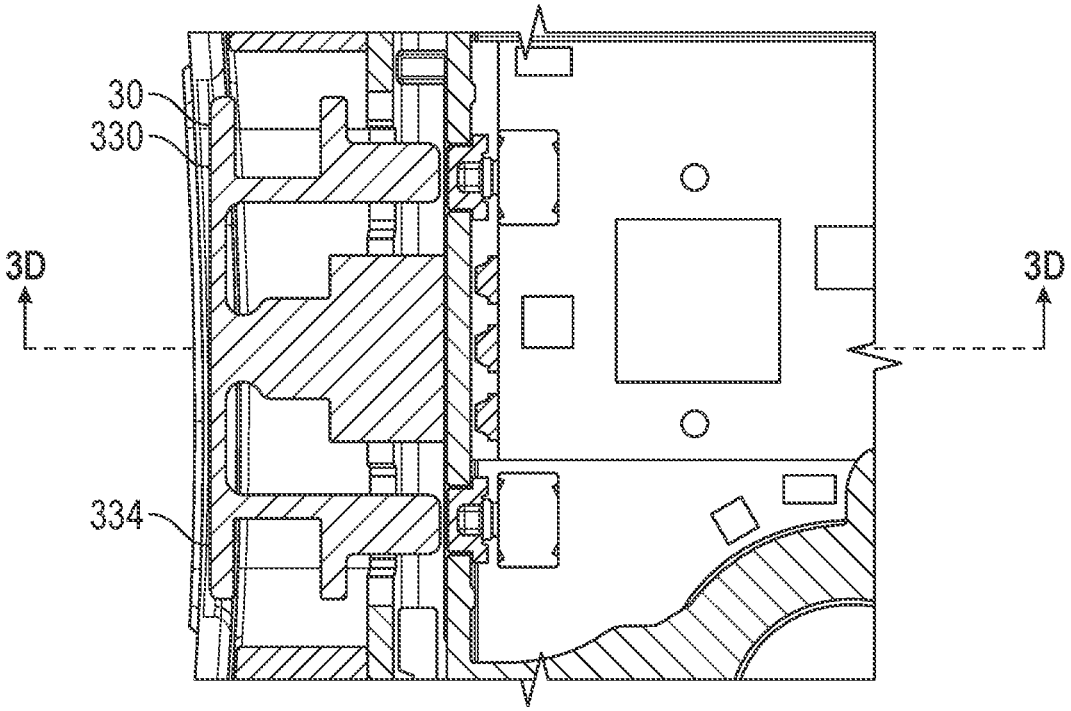
Figure 3D:
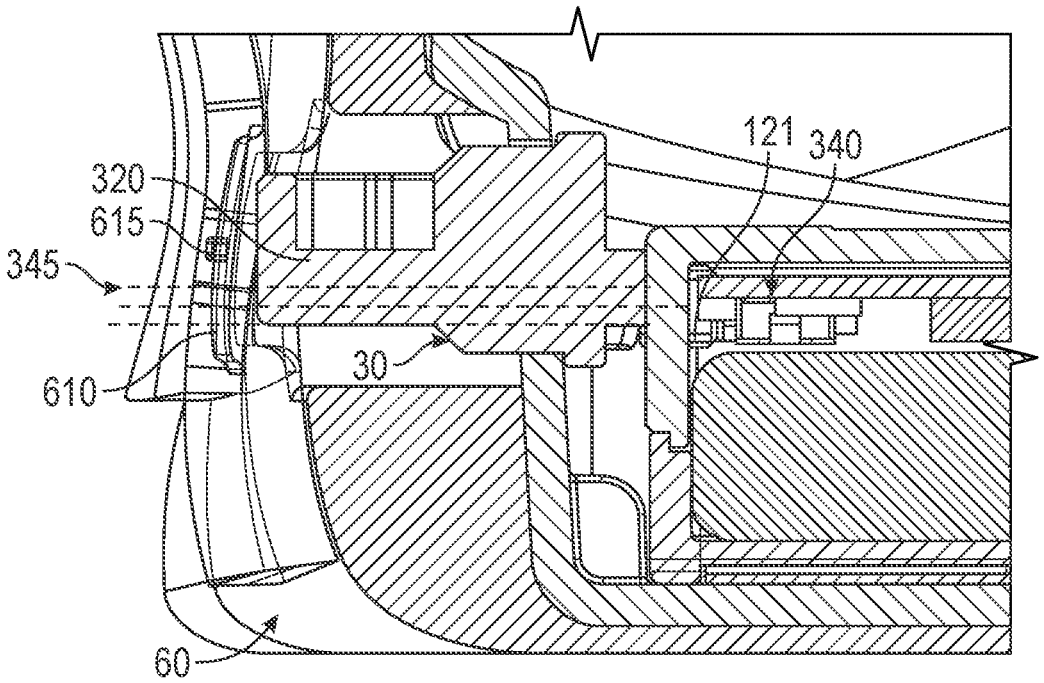

FIG. 3B provides a side view of the actuator 30, which further illustrates an example structure of anterior arm 334 and engagement with button 121. FIG. 3C is an additional top view of actuator 30 illustrating activation paths through posterior arm 330 and anterior arm 334. FIG. 3C also depicts section line A-A, which corresponds to the cross-section illustrated in FIG. 3D. In FIG. 3D, the actuator 30 is illustrated in cross-section with transmitted light 345 shown in dotted lines. The light pipe 320 provides a transmission medium for transmitted light 345 from LEDs 340. FIG. 3D also illustrates aspects of outsole 60, such as actuator cover 610 and raised actuator interface 615.

FIGS. 4A-4D are diagrams and drawings illustrating a mid-sole plate 40 for holding lacing engine 10, according to some example embodiments. In this example, the mid-sole plate 40 includes features such as lacing engine cavity 410, medial lace guide 420, lateral lace guide 421, lid slot 430, anterior flange 440, posterior flange 450, a superior surface 460, an inferior surface 470, and an actuator cutout 480. The lacing engine cavity 410 is designed to receive lacing engine 10. In this example, the lacing engine cavity 410 retains the lacing engine 10 is lateral and anterior posterior directions, but does not include any built in feature to lock the lacing engine 10 in to the pocket. Optionally, the lacing engine cavity 410 can include detents, tabs, or similar mechanical features along one or more sidewalk that could positively retain the lacing engine 10 within the lacing engine cavity 410.

The medial lace guide 420 and lateral lace guide 421 assist in guiding lace cable into the lace engine pocket 410 and over lacing engine 10 (when present). The medial/lateral lace guides 420, 421 can include chamfered edges and inferiorly slated ramps to assist in guiding the lace cable into the desired position over the lacing engine 10. In this example, the medial/lateral lace guides 420, 421 include openings in the sides of the mid-sole plate 40 that are many times wider than the typical lacing cable diameter, in other examples the openings for the medial/lateral lace guides 420, 421 may only be a couple times wider than the lacing cable diameter.

In this example, the mid-sole plate 40 includes a sculpted or contoured anterior flange 440 that extends much further on the medial side of the mid-sole plate 40. The example anterior flange 440 is designed to provide additional support under the arch of the footwear platform. However, in other examples the anterior flange 440 may be less pronounced in on the medial side. In this example, the posterior flange 450 also includes a particular contour with extended portions on both the medial and lateral sides. The illustrated posterior flange 450 shape provides enhanced lateral stability for the lacing engine 10.

Figure 4A:
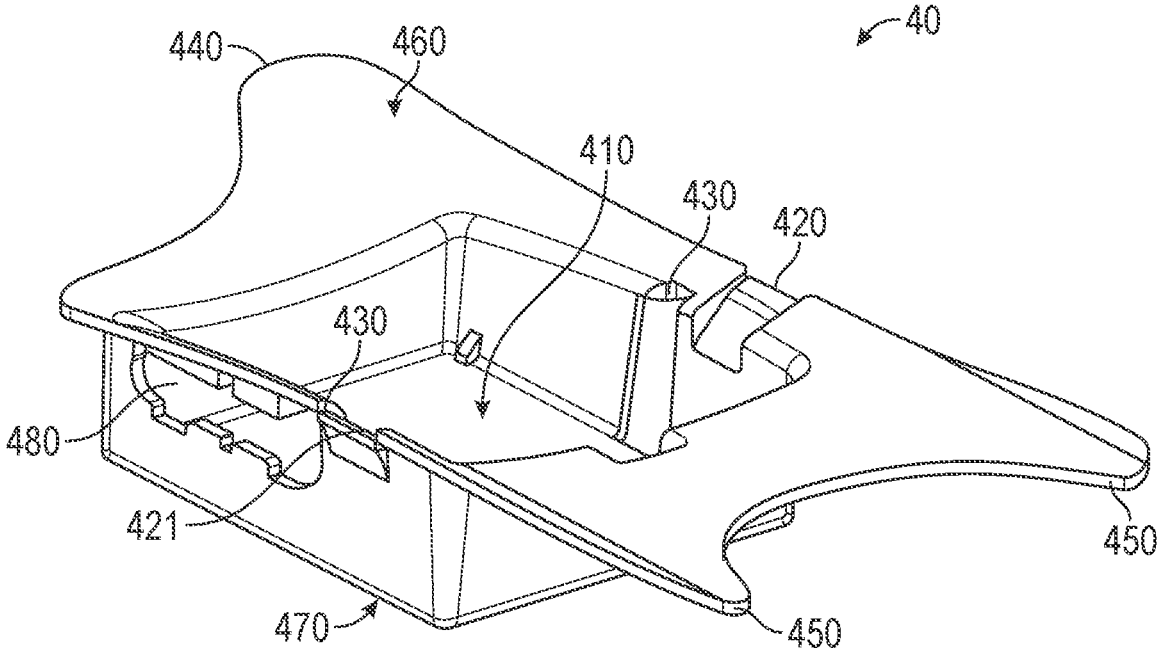
FIGS. 4A-4D are diagrams and drawings illustrating a mid-sole plate for holding a lacing engine, according to some example embodiments.
Figure 4B:
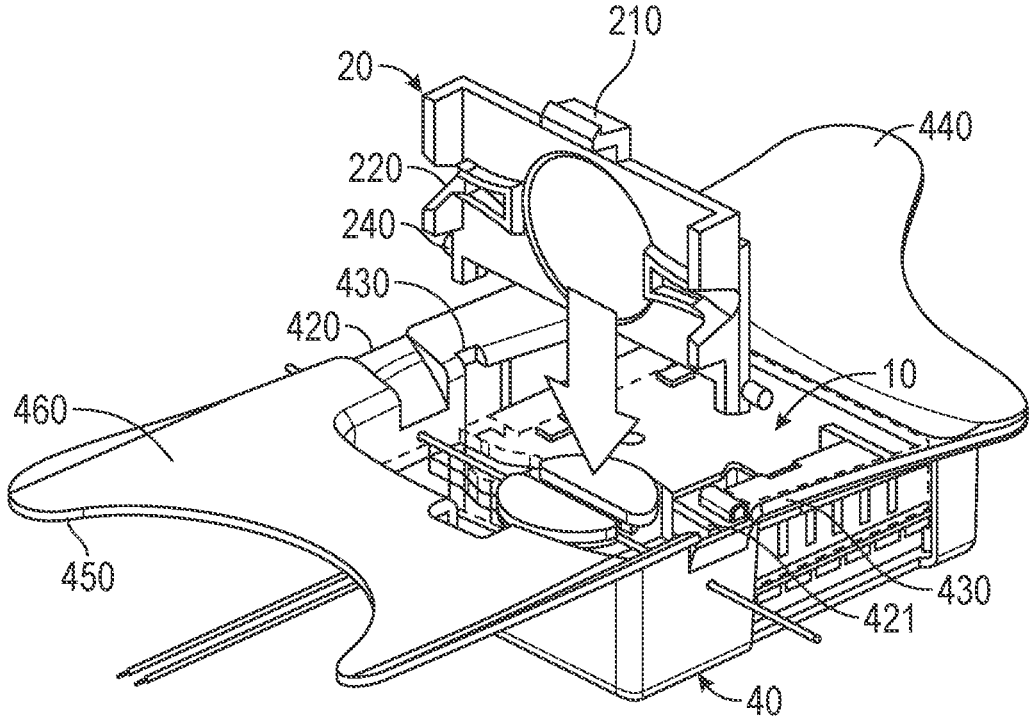
Figure 4C:
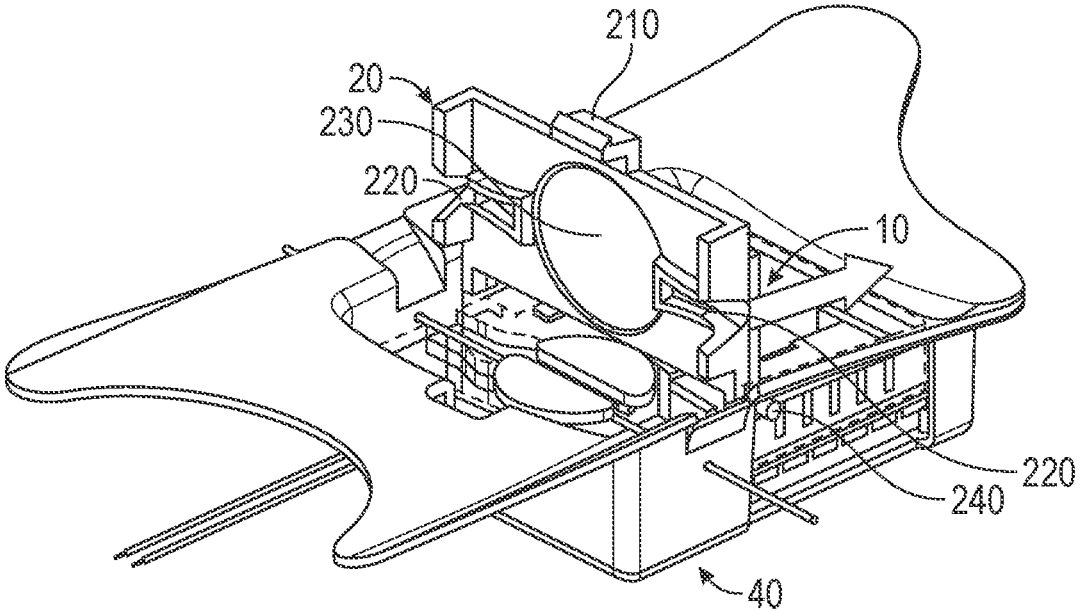
Figure 4D:
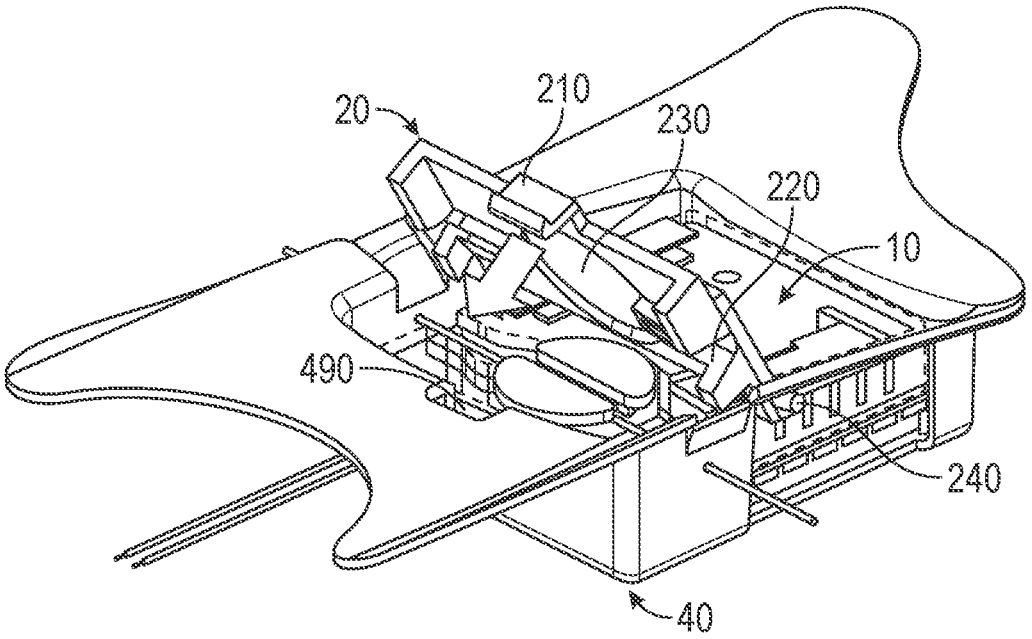

FIGS. 4B-4D illustrate insertion of the lid 20 into the mid-sole plate 40 to retain the lacing engine 10 and capture lace cable 131. In this example, the lid 20 includes features such as latch 210, lid lace guides 220, lid spool recess 230, and lid clips 240. The lid lace guides 220 can include both medial and lateral lid lace guides 220. The lid lace guides 220 assist in maintaining alignment of the lace cable 131 through the proper portion of the lacing engine 10. The lid clips 240 can also include both medial and lateral lid clips 240. The lid clips 240 provide a pivot point for attachment of the lid 20 to the mid-sole plate 40. As illustrated in FIG. 4B, the lid 20 is inserted straight down into the mid-sole plate 40 with the lid clips 240 entering the mid-sole plate 40 via the lid slots 430.

As illustrated in FIG. 4C, once the lid clips 240 are inserted through the lid slots 430, the lid 20 is shifted anteriorly to keep the lid clips 240 from disengaging from the mid-sole plate 40. FIG. 4D illustrates rotation or pivoting of the lid 20 about the lid clips 240 to secure the lacing engine 10 and lace cable 131 by engagement of the latch 210 with a lid latch recess 490 in the mid-sole plate 40. Once snapped into position, the lid 20 secures the lacing engine 10 within the mid-sole plate 40.

Figure 5A:
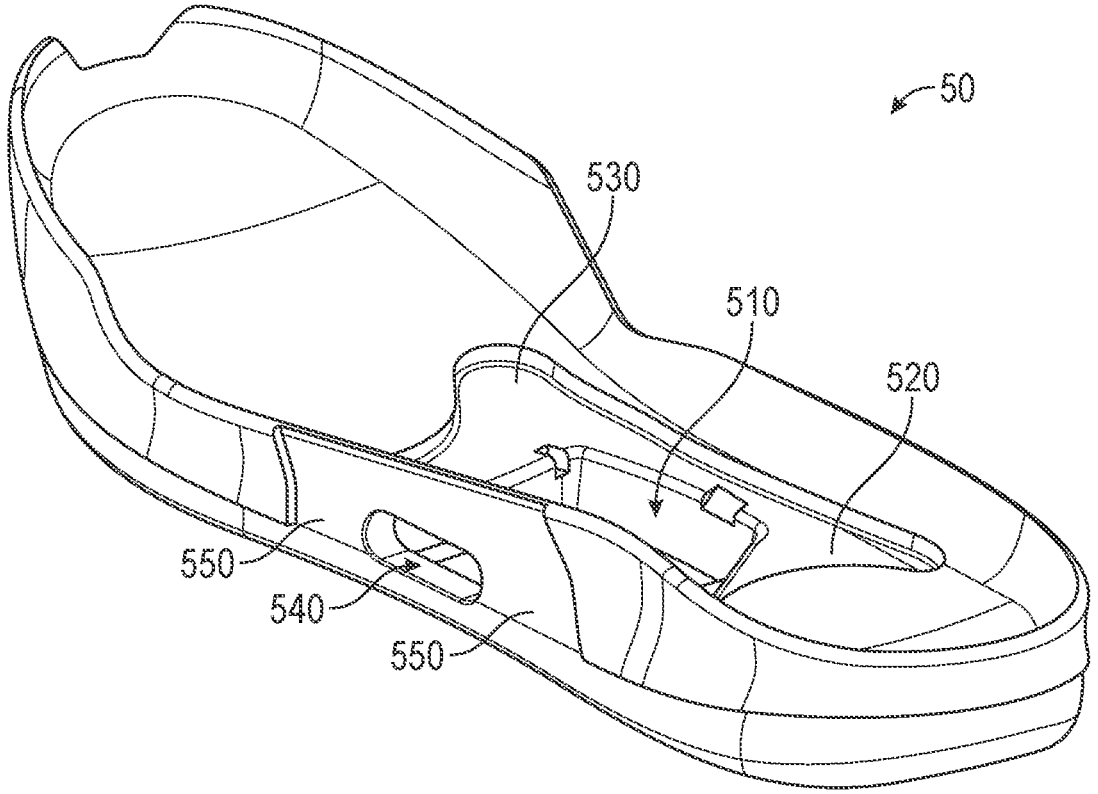
FIGS. 5A-5D are diagrams and drawings illustrating a mid-sole and out-sole to accommodate a lacing engine and related components, according to some example embodiments.
Figure 5B:
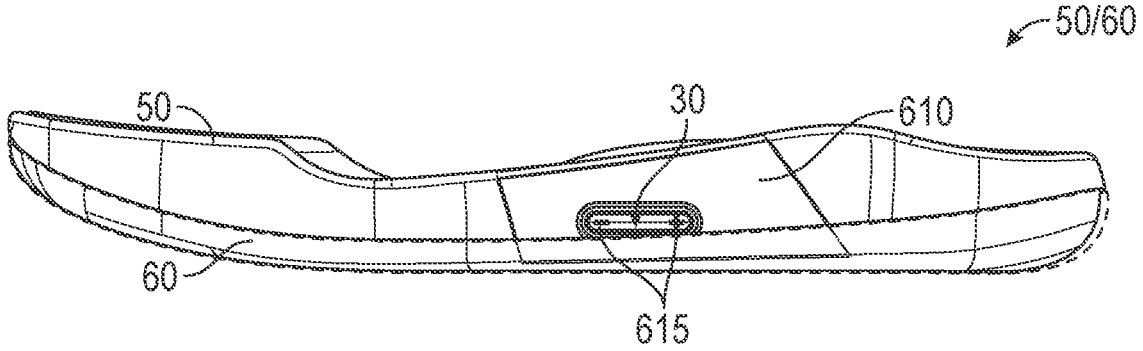
Figure 5C:
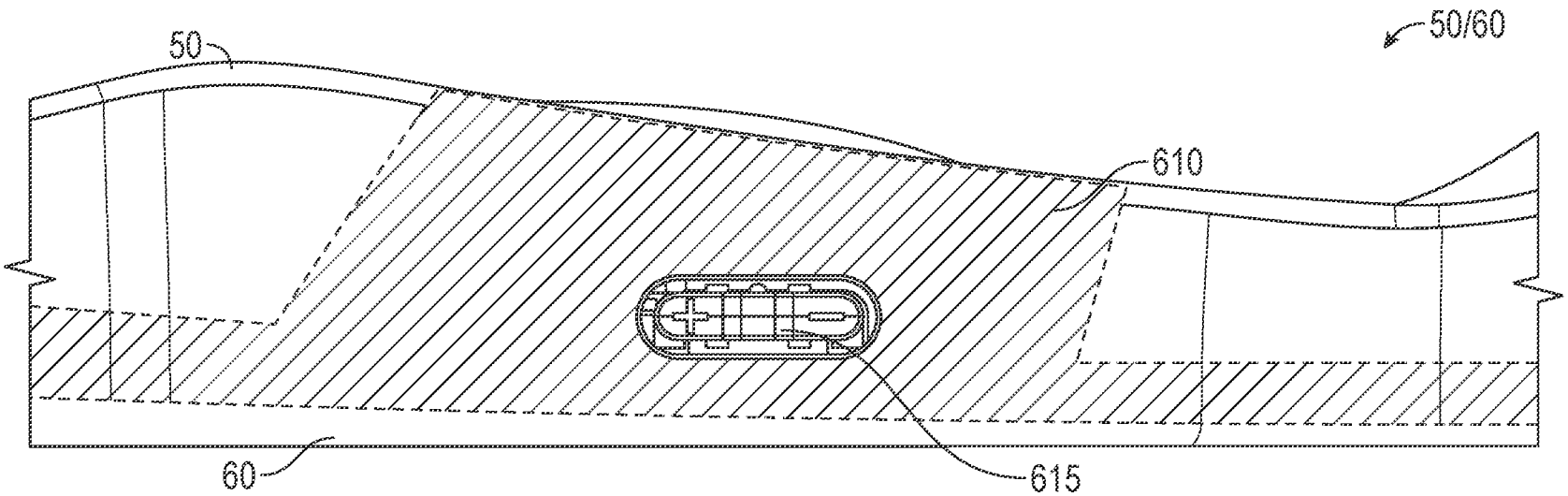

FIGS. 5A-5D are diagrams and drawings illustrating a mid-sole 50 and out-sole 60 configured to accommodate lacing engine 10 and related components, according to some example embodiments. The mid-sole 50 can be formed from any suitable footwear material and includes various features to accommodate the mid-sole plate 40 and related components. In this example, the mid-sole 50 includes features such as plate recess 510, anterior flange recess 520, posterior flange recess 530, actuator opening 540 and actuator cover recess 550. The plate recess 510 includes various cutouts and similar features to match corresponding features of the mid-sole plate 40. The actuator opening 540 is sized and positioned to provide access to the actuator 30 from the lateral side of the footwear platform 1. The actuator cover recess 550 is a recessed portion of the mid-sole 50 adapted to accommodate a molded covering to protect the actuator 30 and provide a particular tactile and visual look for the primary user interface to the lacing engine 10, as illustrated in FIGS. 5B and 5C.

FIGS. 5B and 5C illustrate portions of the mid-sole 50 and out-sole 60, according to example embodiments. FIG. 5B includes illustration of exemplary actuator cover 610 and raised actuator interface 615, which is molded or otherwise formed into the actuator cover 610. FIG. 5C illustrates an additional example of actuator 610 and raised actuator interface 615 including horizontal striping to disperse portions of the light transmitted to the out-sole 60 through the light pipe 320 portion of actuator 30.

Figure 5D:
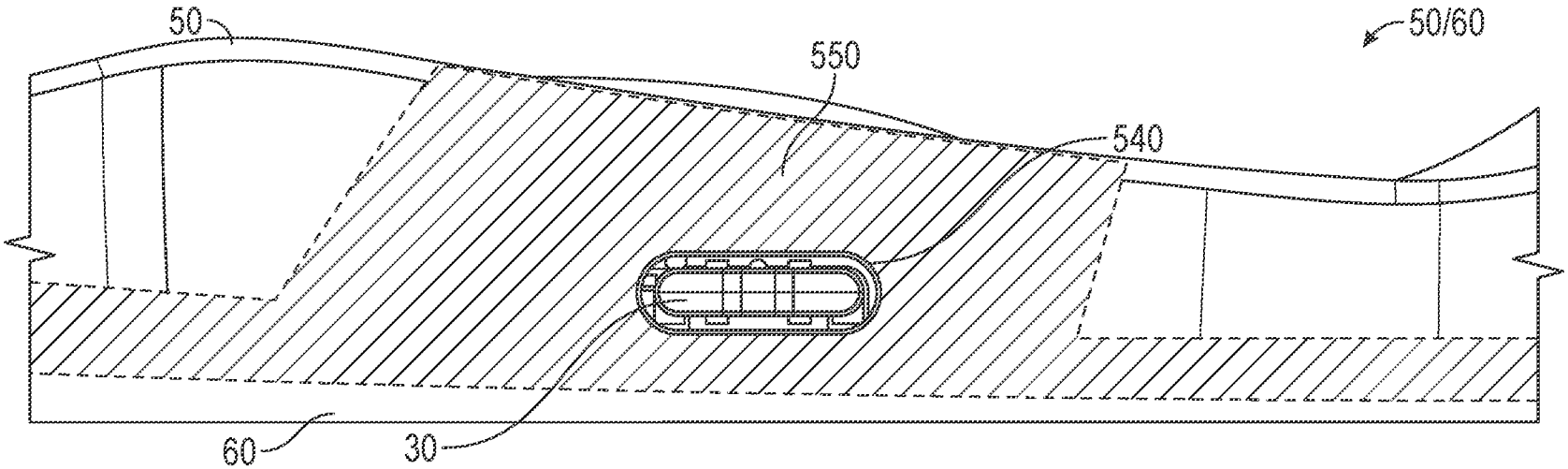

FIG. 5D further illustrates actuator cover recess 550 on mid-sole 50 as well as positioning of actuator 30 within actuator opening 540 prior to application of actuator cover 610. In this example, the actuator cover recess 550 is designed to receive adhesive to adhere actuator cover 610 to the mid-sole 50 and out-sole 60.

Figure 6A:
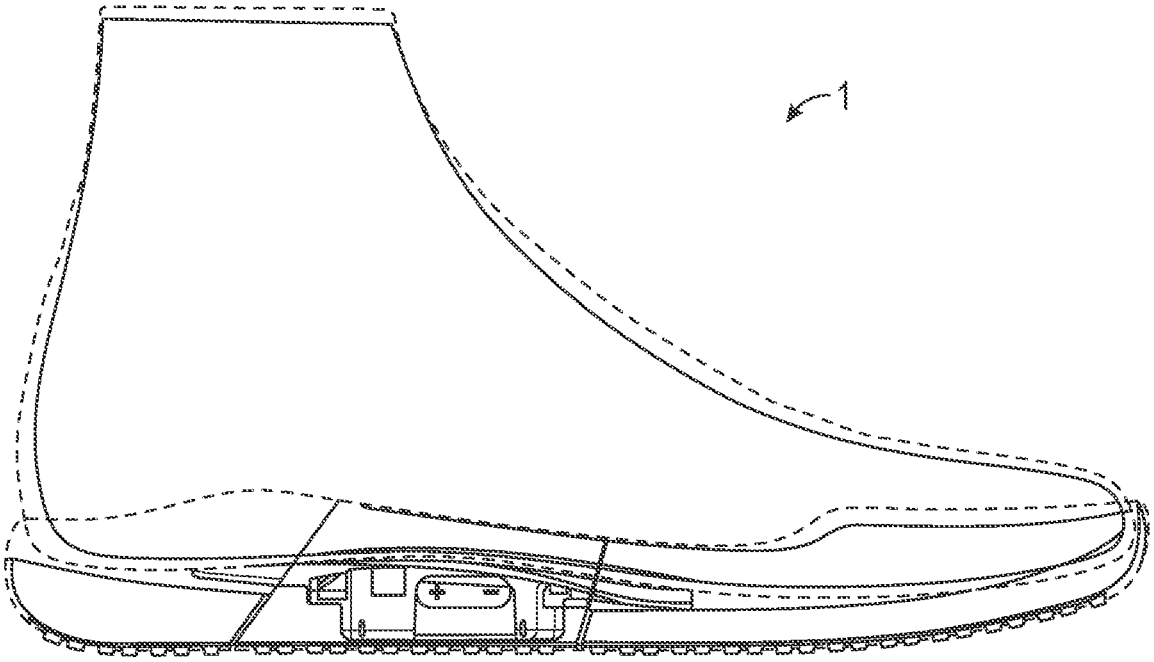
FIGS. 6A-6D are illustrations of a footwear assembly including a motorized lacing engine, according to some example embodiments.
Figure 6B:
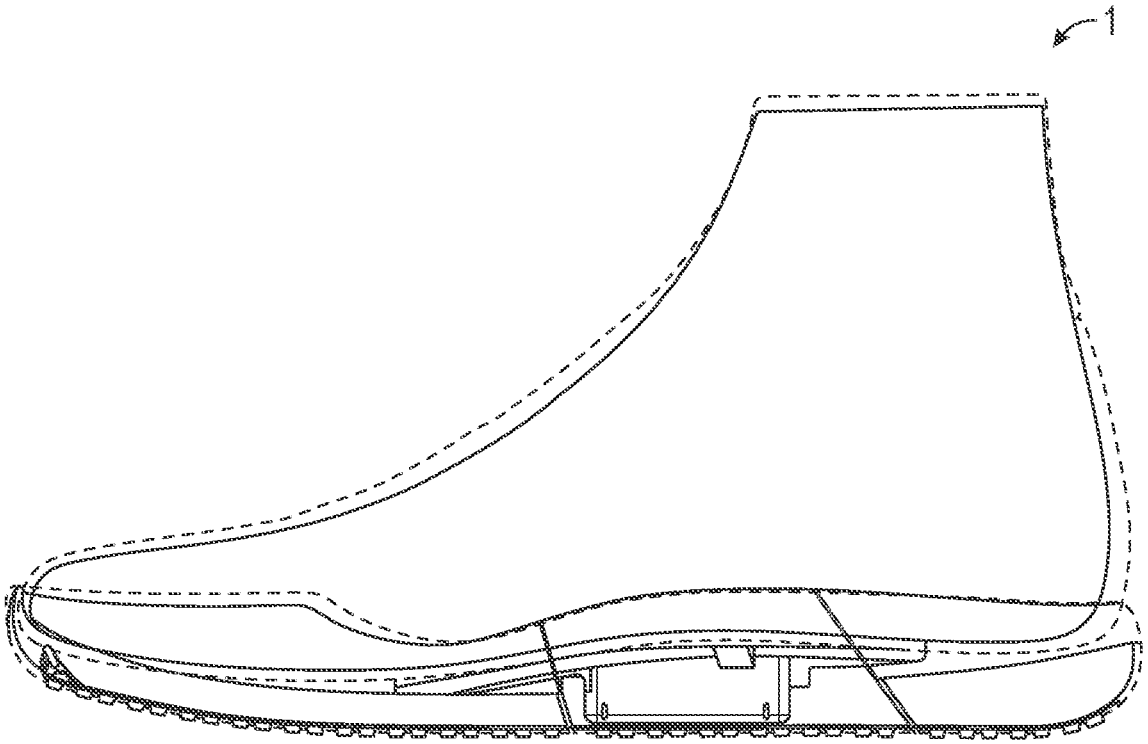
Figure 6C:
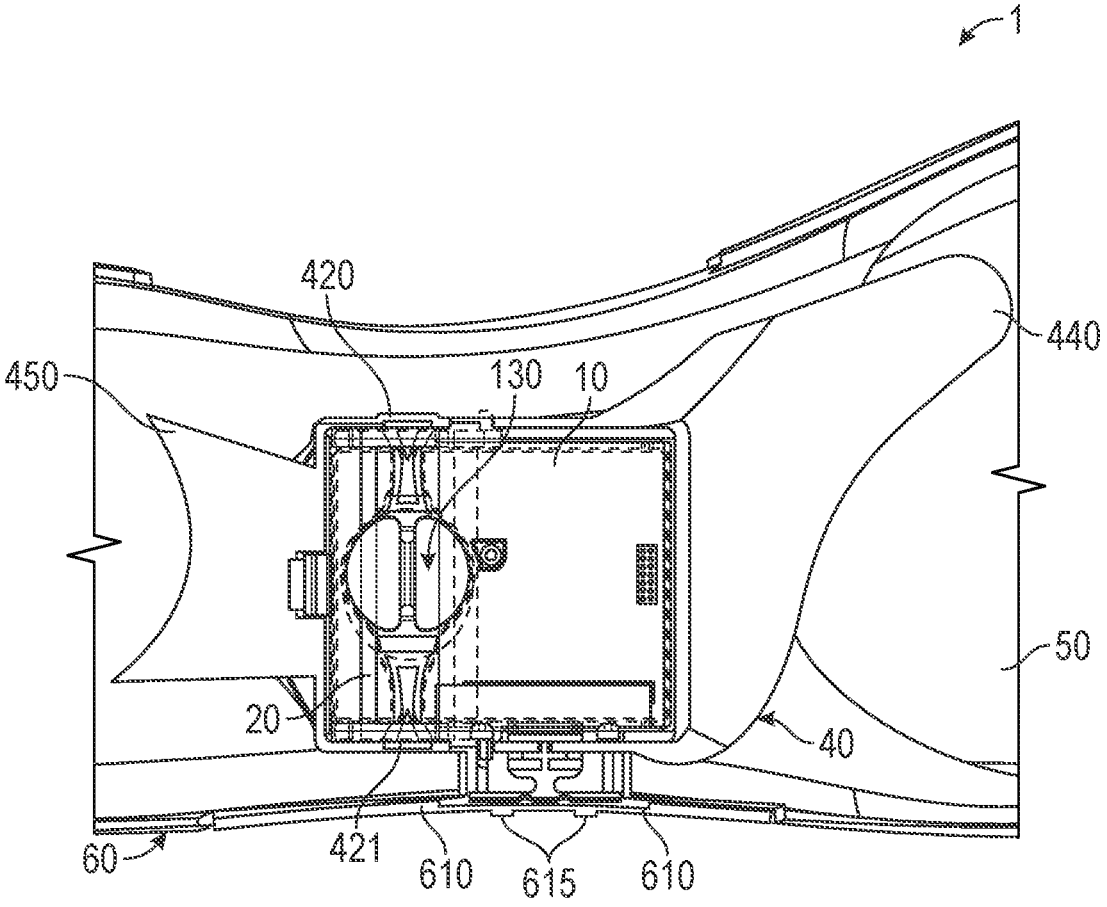

FIGS. 6A-6D are illustrations of a footwear assembly 1 including a motorized lacing engine 10, according to some example embodiments. In this example, FIGS. 6A-6C depict transparent examples of an assembled automated footwear platform 1 including a lacing engine 10, a mid-sole plate 40, a mid-sole 50, and an out-sole 60. FIG. 6A is a lateral side view of the automated footwear platform 1. FIG. 6B is a medial side view of the automated footwear platform 1. FIG. 6C is a top view, with the upper portion removed, of the automated footwear platform 1. The top view demonstrates relative positioning of the lacing engine 10, the lid 20, the actuator 30, the mid-sole plate 40, the mid-sole 50, and the out-sole 60. In this example, the top view also illustrates the spool 130, the medial lace guide 420 the lateral lace guide 421, the anterior flange 440, the posterior flange 450, the actuator cover 610, and the raised actuator interface 615.

Figure 6D:
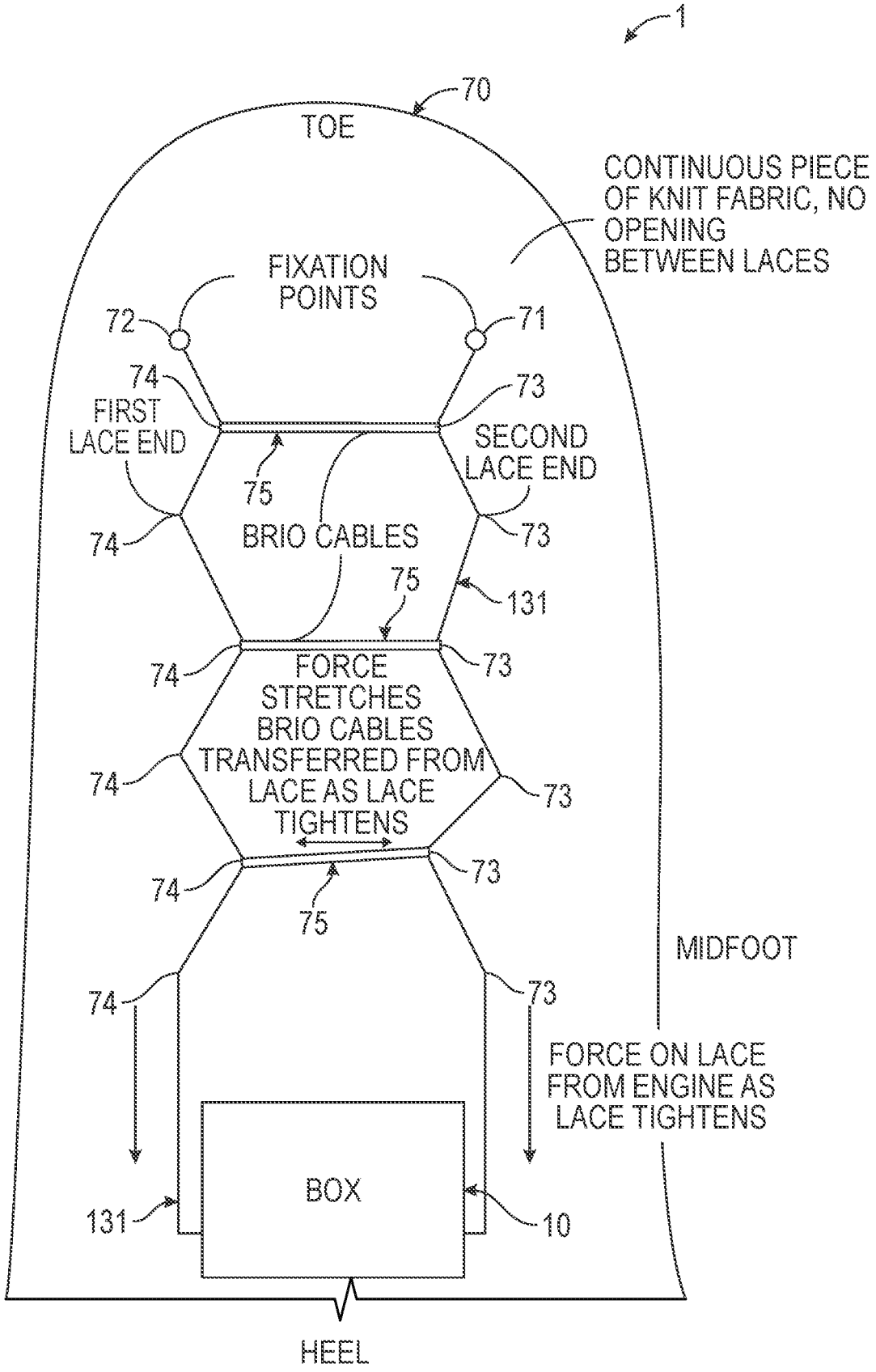

FIG. 6D is a top view diagram of upper 70 illustrating an example lacing configuration, according to some example embodiments. In this example, the upper 70 includes lateral lace fixation 71, medial lace fixation 72, lateral lace guides 73, medial lace guides 74, and brio cables 75, in additional to lace 131 and lacing engine 10. The example illustrated in FIG. 6D includes a continuous knit fabric upper 70 with diagonal lacing pattern involving non-overlapping medial and lateral lacing paths. The lacing paths are created starting at the lateral lace fixation running through the lateral lace guides 73 through the lacing engine 10 up through the medial lace guides 74 back to the medial lace fixation 72. In this example, lace 131 forms a continuous loop from lateral lace fixation 71 to medial lace fixation 72. Medial to lateral tightening is transmitted through brio cables 75 in this example. In other examples, the lacing path may crisscross or incorporate additional features to transmit tightening forces in a medial-lateral direction across the upper 70. Additionally, the continuous lace loop concept can be incorporated into a more traditional upper with a central (medial) gap and lace 131 crisscrossing back and forth across the central gap.

Figure 7:
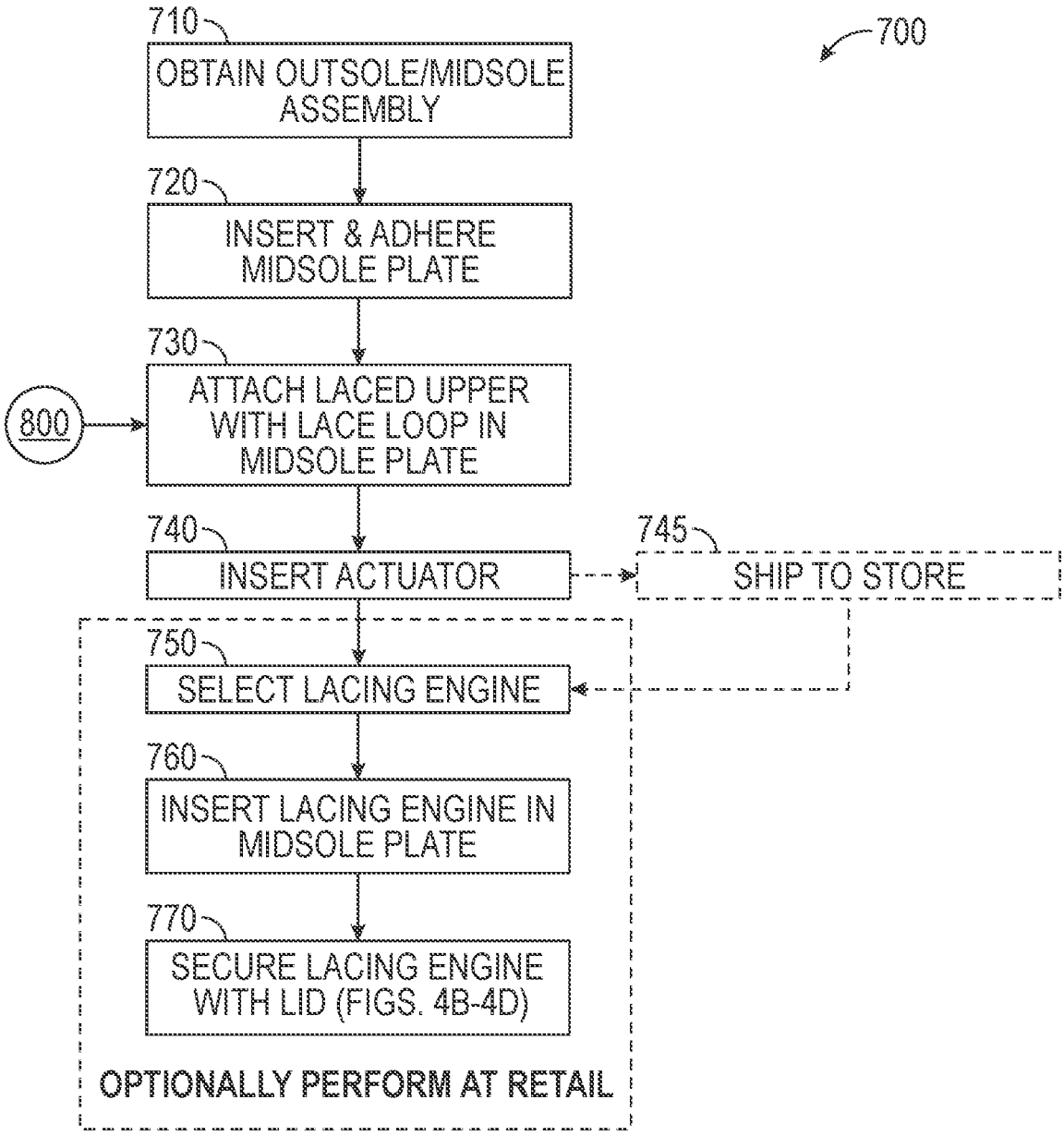
FIG. 7 is a flowchart illustrating a footwear assembly process for assembly of footwear including a lacing engine, according to some example embodiments.

FIG. 7 is a flowchart illustrating a footwear assembly process for assembly of an automated footwear platform 1 including lacing engine 10, according to some example embodiments. In this example, the assembly process includes operations such as: obtaining an outsole/midsole assembly at 710, inserting and adhering a mid-sole plate at 720, attaching laced upper at 730, inserting actuator at 740, optionally shipping the subassembly to a retail store at 745, selecting a lacing engine at 750, inserting a lacing engine into the mid-sole plate at 760, and securing the lacing engine at 770. The process 700 described in further detail below can include some or all of the process operations described and at least some of the process operations can occur at various locations (e.g., manufacturing plant versus retail store). In certain examples, all of the process operations discussed in reference to process 700 can be completed within a manufacturing location with a completed automated footwear platform delivered directly to a consumer or to a retain location for purchase.

In this example, the process 700 begins at 710 with obtaining an out-sole and mid-sole assembly, such as mid-sole 50 adhered to out-sole 60. At 720, the process 700 continues with insertion of a mid-sole plate, such as mid-sole plate 40, into a plate recess 510. In some examples, the mid-sole plate 40 includes a layer of adhesive on the inferior surface to adhere the mid-sole plate into the mid-sole. In other examples, adhesive is applied to the mid-sole prior to insertion of a mid-sole plate. In still other examples, the mid-sole is designed with an interference fit with the mid-sole plate, which does not require adhesive to secure the two components of the automated footwear platform.

At 730, the process 700 continues with a laced upper portion of the automated footwear platform being attached to the mid-sole. Attachment of the laced upper portion is done through any known footwear manufacturing process, with the addition of positioning a lower lace loop into the mid-sole plate for subsequent engagement with a lacing engine, such as lacing engine 10. For example, attaching a laced upper to mid-sole 50 with mid-sole plate 40 inserted, the lower lace loop is positioned to align with medial lace guide 420 and lateral lace guide 421, which position the lace loop properly to engage with lacing engine 10 when inserted later in the assembly process. Assembly of the upper portion is discussed in greater detail in reference to FIGS. 8A-8B below.

At 740, the process 700 continues with insertion of an actuator, such as actuator 30, into the mid-sole plate. Optionally, insertion of the actuator can be done prior to attachment of the upper portion at operation 730. In an example, insertion of actuator 30 into the actuator cutout 480 of mid-sole plate 40 involves a snap fit between actuator 30 and actuator cutout 480. Optionally, process 700 continues at 745 with shipment of the subassembly of the automated footwear platform to a retail location or similar point of sale. The remaining operations within process 700 can be performed without special tools or materials, which allows for flexible customization of the product sold at the retail level without the need to manufacture and inventory every combination of automated footwear subassembly and lacing engine options.

At 750, the process 700 continues with selection of a lacing engine, which may be an optional operation in cases where only one lacing engine is available. In an example, lacing engine 10, a motorized lacing engine, is chosen for assembly into the subassembly from operations 710-740. However, as noted above, the automated footwear platform is designed to accommodate various types of lacing engines from fully automatic motorized lacing engines to human-power manually activated lacing engines. The subassembly built up in operations 710-740, with components such as out-sole 60, mid-sole 50, and mid-sole plate 40, provides a modular platform to accommodate a wide range of optional automation components.

At 760, the process 700 continues with insertion of the selected lacing engine into the mid-sole plate. For example, lacing engine 10 can be inserted into mid-sole plate 40, with the lacing engine 10 slipped underneath the lace loop running through the lacing engine cavity 410. With the lacing engine 10 in place and the lace cable engaged within the spool of the lacing engine, such as spool 130, a lid (or similar component) can be installed into the mid-sole plate to secure the lacing engine 10 and lace. An example of install of lid 20 into mid-sole plate 40 to secure lacing engine 10 is illustrated in FIGS. 4B-4D and discussed above. With the lid secured over the lacing engine, the automated footwear platform is complete and ready for active use.

Figure 8A:
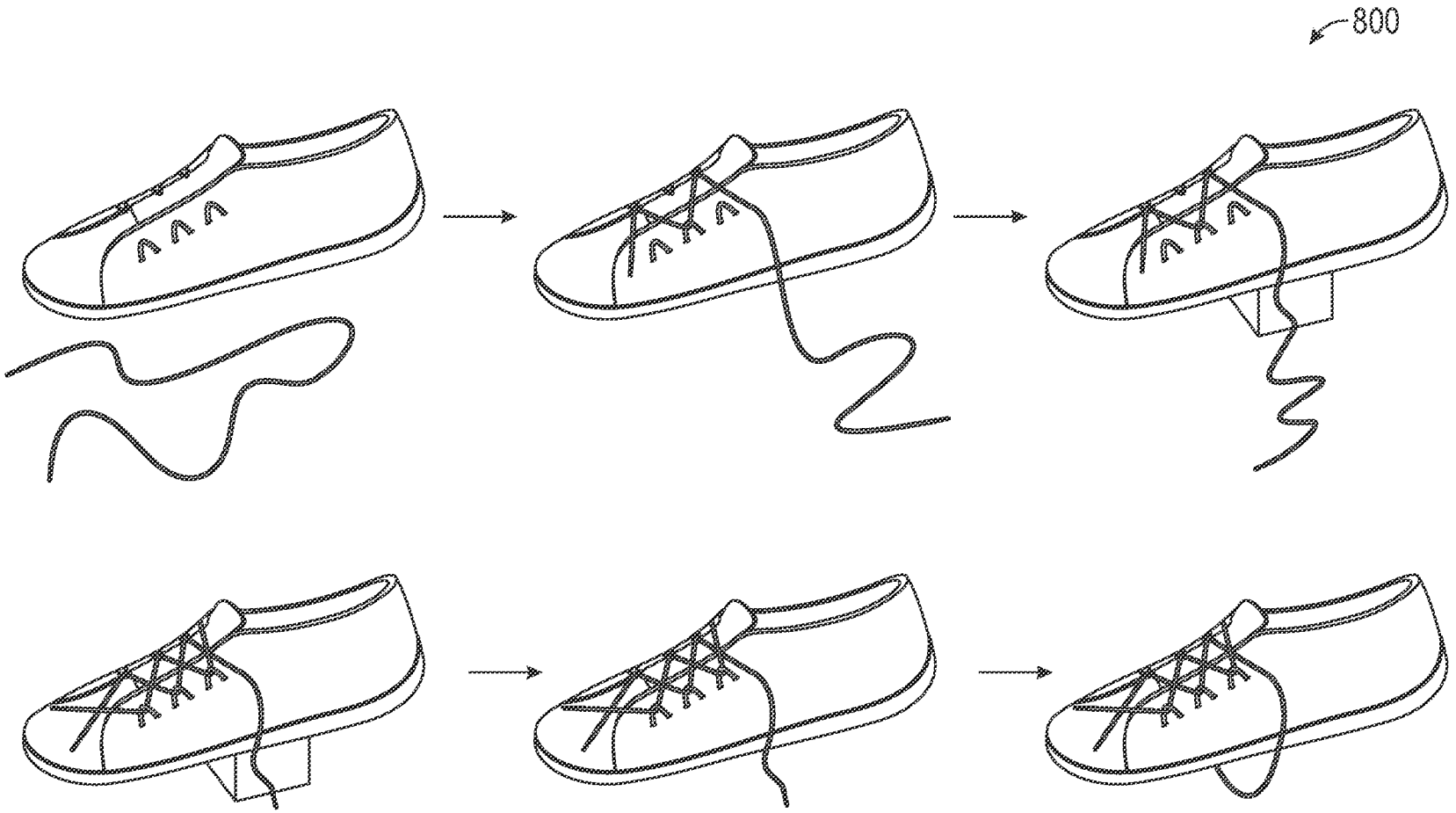
FIGS. 8A-8B is a drawing and a flowchart illustrating an assembly process for assembly of a footwear upper in preparation for assembly to mid-sole, according to some example embodiments.
Figure 8B:
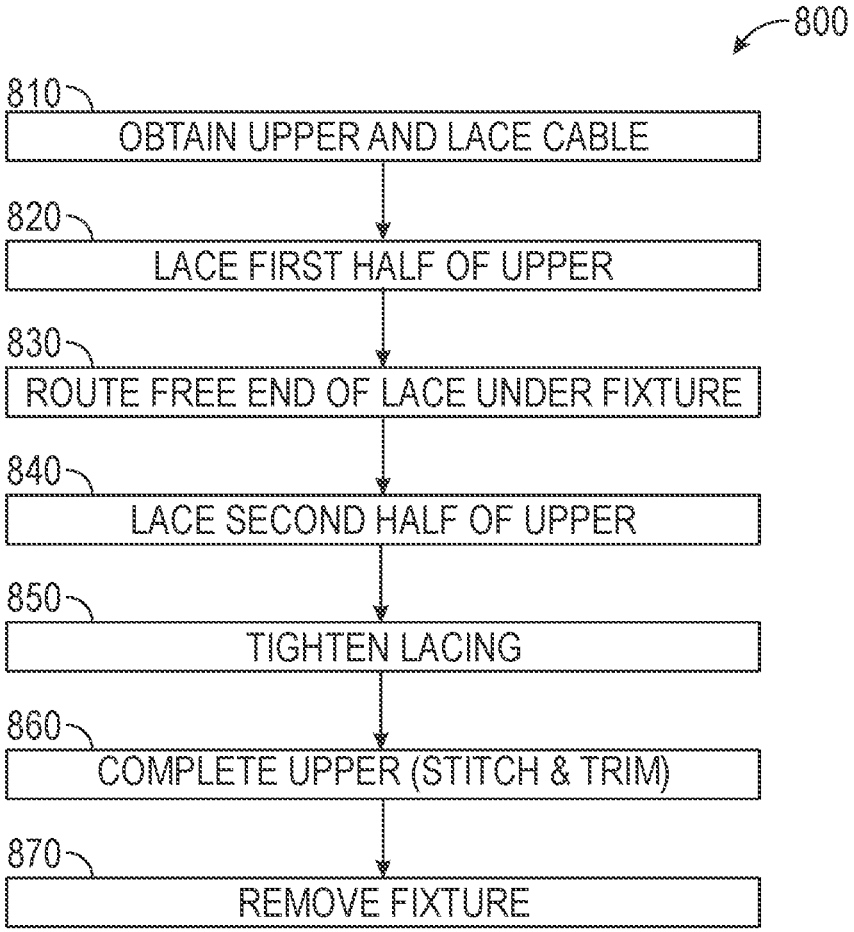

FIGS. 8A-8B include flowcharts illustrating generally an assembly process 800 for assembly of a footwear upper in preparation for assembly to a mid-sole, according to some example embodiments.

FIG. 8A visually depicts a series of assembly operations to assembly a laced upper portion of a footwear assembly for eventual assembly into an automated footwear platform, such as though process 700 discussed above. Process 800 illustrated in FIG. 8A starts with operation 1, which involves obtaining a knit upper and a lace (lace cable). Next, a first half of the knit upper is laced with the lace. In this example, lacing the upper involves threading the lace cable through a number of eyelets and securing one end to an anterior section of the upper. Next, the lace cable is routed under a fixture supporting the upper and around to the opposite side. Then, at operation 2.6, the other half of the upper is laced, while maintaining a lower loop of lace around the fixture. At 2.7, the lace is secured and trimmed and at 3.0 the fixture is removed to leave a laced knit upper with a lower lace loop under the upper portion.

FIG. 8B is a flowchart illustrating another example of process 800 for assembly of a footwear upper. In this example, the process 800 includes operations such as obtaining an upper and lace cable at 810, lacing the first half of the upper at 820, routing the lace under a lacing fixture at 830, lacing the second half of the upper at 840, tightening the lacing at 850, completing upper at 860, and removing the lacing fixture at 870.

The process 800 begins at 810 by obtaining an upper and a lace cable to being assembly. Obtaining the upper can include placing the upper on a lacing fixture used through other operations of process 800. At 820, the process 800 continues by lacing a first half of the upper with the lace cable. Lacing operation can include routing the lace cable through a series of eyelets or similar features built into the upper. The lacing operation at 820 can also include securing one end of the lace cable to a portion of the upper. Securing the lace cable can include sewing, tying off, or otherwise terminating a first end of the lace cable to a fixed portion of the upper.

At 830, the process 800 continues with routing the free end of the lace cable under the upper and around the lacing fixture. In this example, the lacing fixture is used to create a proper lace loop under the upper for eventual engagement with a lacing engine after the upper is joined with a mid-sole/out-sole assembly (see discussion of FIG. 7 above). The lacing fixture can include a groove or similar feature to at least partially retain the lace cable during the sequent operations of process 800.

At 840, the process 800 continues with lacing the second half of the upper with the free end of the lace cable. Lacing the second half can include routing the lace cable through a second series of eyelets or similar features on the second half of the upper. At 850, the process 800 continues by tightening the lace cable through the various eyelets and around the lacing fixture to ensure that the lower lace loop is properly formed for proper engagement with a lacing engine. The lacing fixture assists in obtaining a proper lace loop length, and different lacing fixtures can be used for different size or styles of footwear. The lacing process is completed at 860 with the free end of the lace cable being secured to the second half of the upper. Completion of the upper can also include additional trimming or stitching operations. Finally, at 870, the process 800 completes with removal of the upper from the lacing fixture.

Figure 9:
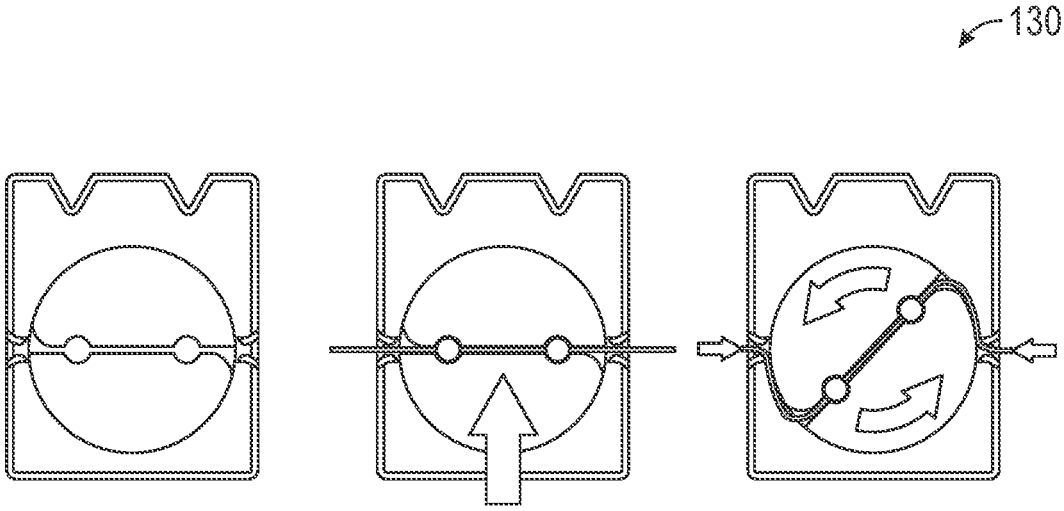
FIG. 9 is a drawing illustrating a mechanism for securing a lace within a spool of a lacing engine, according to some example embodiments.

FIG. 9 is a drawing illustrating a mechanism for securing a lace within a spool of a lacing engine, according to some example embodiments. In this example, spool 130 of lacing engine 10 receives lace cable 131 within lace groove 132. FIG. 9 includes a lace cable with ferrules and a spool with a lace groove that include recesses to receive the ferrules. In this example, the ferrules snap (e.g., interference fit) into recesses to assist in retaining the lace cable within the spool. Other example spools, such as spool 130, do not include recesses and other components of the automated footwear platform are used to retain the lace cable in the lace groove of the spool.

Figure 10A:
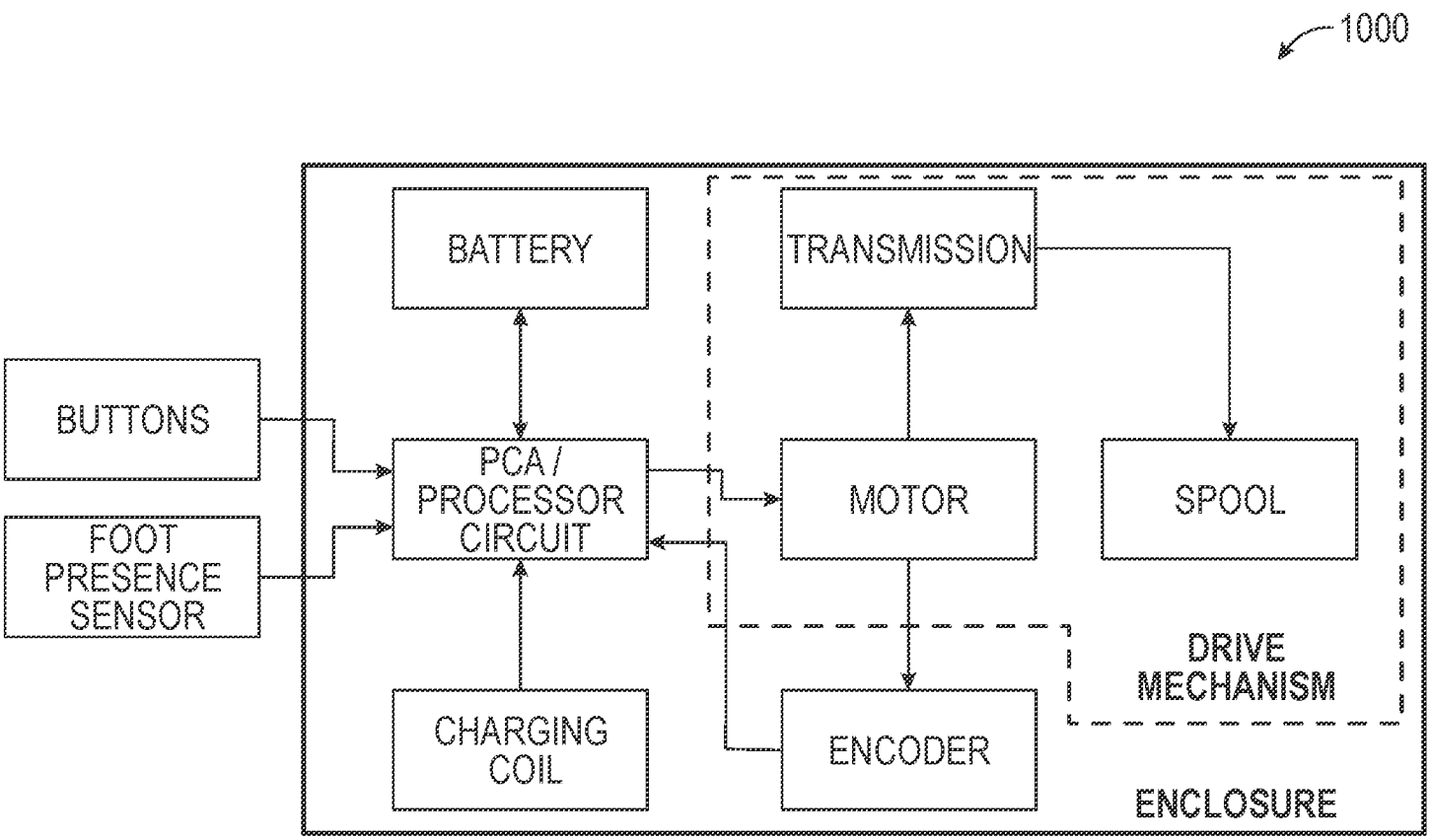
FIG. 10A is a block diagram illustrating components of a motorized lacing system, according to some example embodiments.

FIG. 10A is a block diagram illustrating components of a motorized lacing system for footwear, according to some example embodiments. The system 1000 illustrates basic components of a motorized lacing system such as including interface buttons, foot presence sensor(s), a printed circuit board assembly (PCA) with a processor circuit, a battery, a charging coil, an encoder, a motor, a transmission, and a spool. In this example, the interface buttons and foot presence sensor(s) communicate with the circuit board (PCA), which also communicates with the battery and charging coil. The encoder and motor are also connected to the circuit board and each other. The transmission couples the motor to the spool to form the drive mechanism.

In an example, the processor circuit controls one or more aspects of the drive mechanism. For example, the processor circuit can be configured to receive information from the buttons and/or from the foot presence sensor and/or from the battery and/or from the drive mechanism and/or from the encoder, and can be further configured to issue commands to the drive mechanism, such as to tighten or loosen the footwear, or to obtain or record sensor information, among other functions.

Figure 10B:
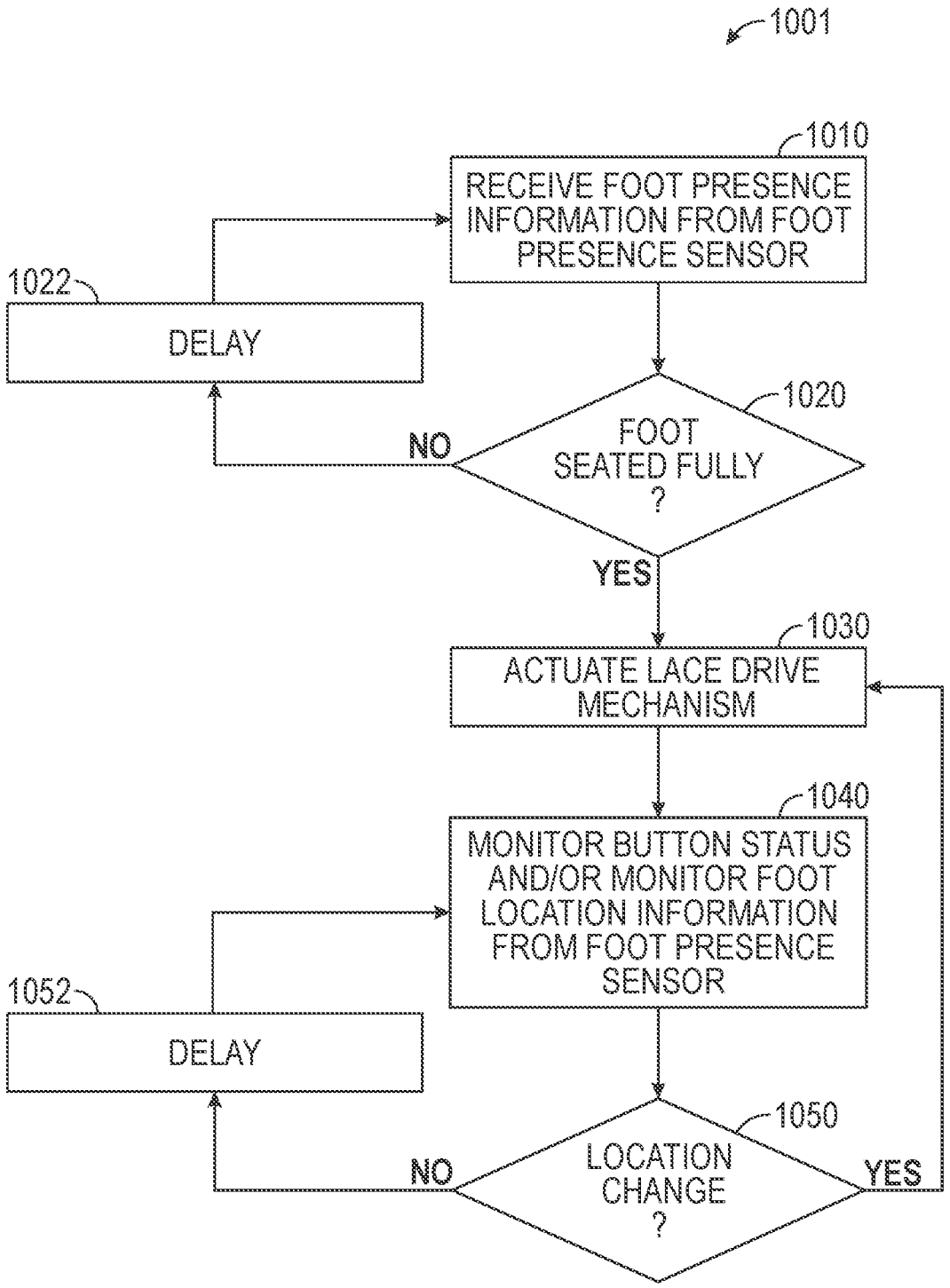
FIG. 10B is a flowchart illustrating an example of using foot presence information from a sensor.

FIG. 10B illustrates generally an example of a method 1001 that can include using information from a foot presence sensor to actuate a drive mechanism. At 1010, the example includes receiving foot presence information from a foot presence sensor. The foot presence information can include binary information about whether or not a foot is present, or can include an indication of a likelihood that a foot is present in a footwear article. The information can include an electrical signal provided from the sensor to the processor circuit. In an example, the foot presence information includes qualitative information about a location of a foot relative to one or more sensors in the footwear.

At 1020, the example includes determining whether a foot is fully seated in the footwear. If the sensor signal indicates that the foot is fully seated, then the example can continue at 1030 with actuating a lace drive mechanism. For example, when a foot is fully seated, the lace drive mechanism can be engaged to tighten footwear laces via a spool mechanism, as described above. If the sensor signal indicates that the foot is not fully seated, then the example can continue at 1022 by delaying or idling for some specified interval (e.g., 1-2 seconds, or more). After the delay elapses, the example can return to operation 1010, and the processor circuit can re-sample information from the foot presence sensor to determine again whether the foot is fully seated.

After the lace drive mechanism is actuated at 1030, the processor circuit can be configured to monitor foot location information at operation 1040. For example, the processor circuit can be configured to periodically or intermittently monitor information from the foot presence sensor about an absolute or relative position of a foot in the footwear. In an example, monitoring foot location information at 1040 and the receiving foot presence information at 1010 can include receiving information from the same or different foot position sensor. At 1040, the example includes monitoring information from one or more buttons associated with the footwear, such as can indicate a user instruction to disengage (loosen) the laces, such as when a user wishes to remove the footwear. In an example, lace tension information can be additionally or alternatively monitored or used as feedback information for actuating a drive motor or tensioning laces. For example, lace tension information can be monitored by measuring a drive motor current. The tension can be characterized at the factory or preset by the user, and can be correlated to a monitored or measured drive motor current level.

At 1050, the example includes determining whether a foot location has changed in the footwear. If no change in foot location is detected by the processor circuit, for example by analyzing foot presence signals from one or more foot presence sensors, then the example can continue with a delay 1052. After a specified delay interval, the example can return to 1040 to re-sample information from the foot presence sensor(s) to again determine whether a foot position has changed. The delay 1052 can be in the range of several milliseconds to several seconds, and can optionally be specified by a user.

In an example, the delay 1052 can be determined automatically by the processor circuit, such as in response to determining a footwear use characteristic. For example, if the processor circuit determines that a wearer is engaged in strenuous activity e.g., running, jumping, etc.), then the processor circuit can decrease the delay 1052. If the processor circuit determines that the wearer is engaged in non-strenuous activity (e.g., walking or sitting), then the processor circuit can increase the delay 1052, such as to increase battery longevity by deferring sensor sampling events. In an example, if a location change is detected at 1050, then the example can continue by returning to operation 1030, for example, to actuate the lace drive mechanism, such as to tighten or loosen the footwear's laces. In an example, the processor circuit includes or incorporates a hysteretic controller for the drive mechanism to help avoid unwanted lace spooling.

Motor Control Scheme

Figure 11C:
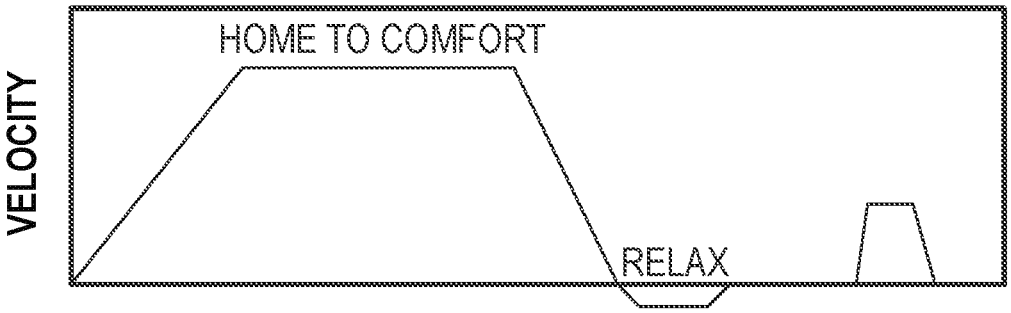

FIG. 11A-11D are diagrams illustrating a motor control scheme 1100 for a motorized lacing engine, according to some example embodiments. In this example, the motor control scheme 1100 involves dividing up the total travel, in terms of lace take-up, into segments, with the segments varying in size based on position on a continuum of lace travel (e.g., between home/loose position on one end and max tightness on the other). As the motor is controlling a radial spool and will be controlled, primarily, via a radial encoder on the motor shaft, the segments can be sized in terms of degrees of spool travel (which can also be viewed in terms of encoder counts). On the loose side of the continuum, the segments can be larger, such as 10 degrees of spool travel, as the amount of lace movement is less critical. However, as the laces are tightened each increment of lace travel becomes more and more critical to obtain the desired amount of lace tightness. Other parameters, such as motor current, can be used as secondary measures of lace tightness or continuum position. FIG. 11A includes an illustration of different segment sizes based on position along a tightness continuum.

FIG. 11B illustrates using a tightness continuum position to build a table of motion profiles based on current tightness continuum position and desired end position. The motion profiles can then be translated into specific inputs from user input buttons. The motion profile include parameters of spool motion, such as acceleration (Accel (deg/s/s)), velocity (Vel (deg/s)), deceleration (Dec (deg/s/s)), and angle of movement (Angle (deg)), FIG. 11C depicts an example motion profile plotted on a velocity over time graph.

Figure 11D:
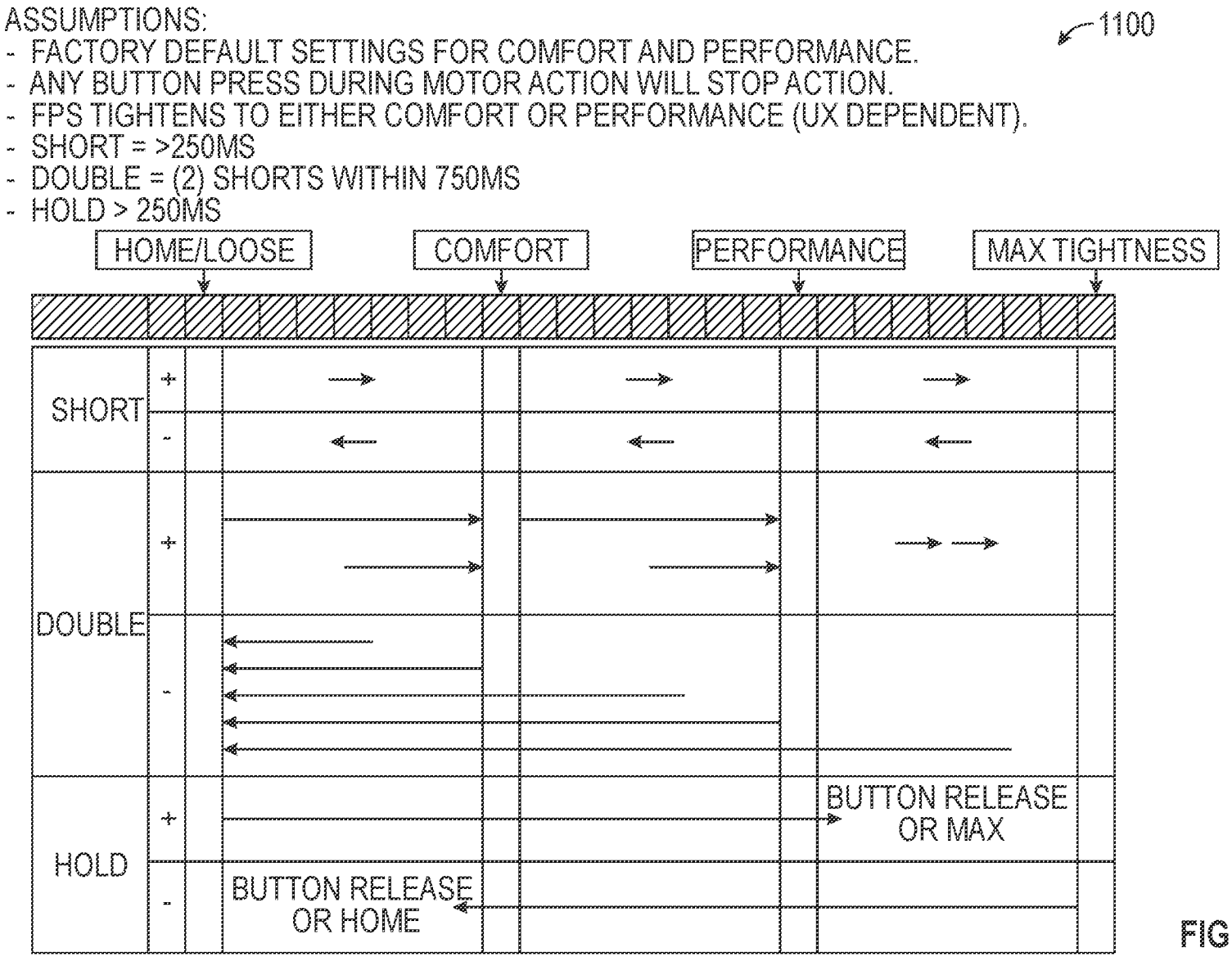

FIG. 11D is a graphic illustrating example user inputs to activate various motion profiles along the tightness continuum.

Modular Spool for Lacing Engine

Figure 12A:
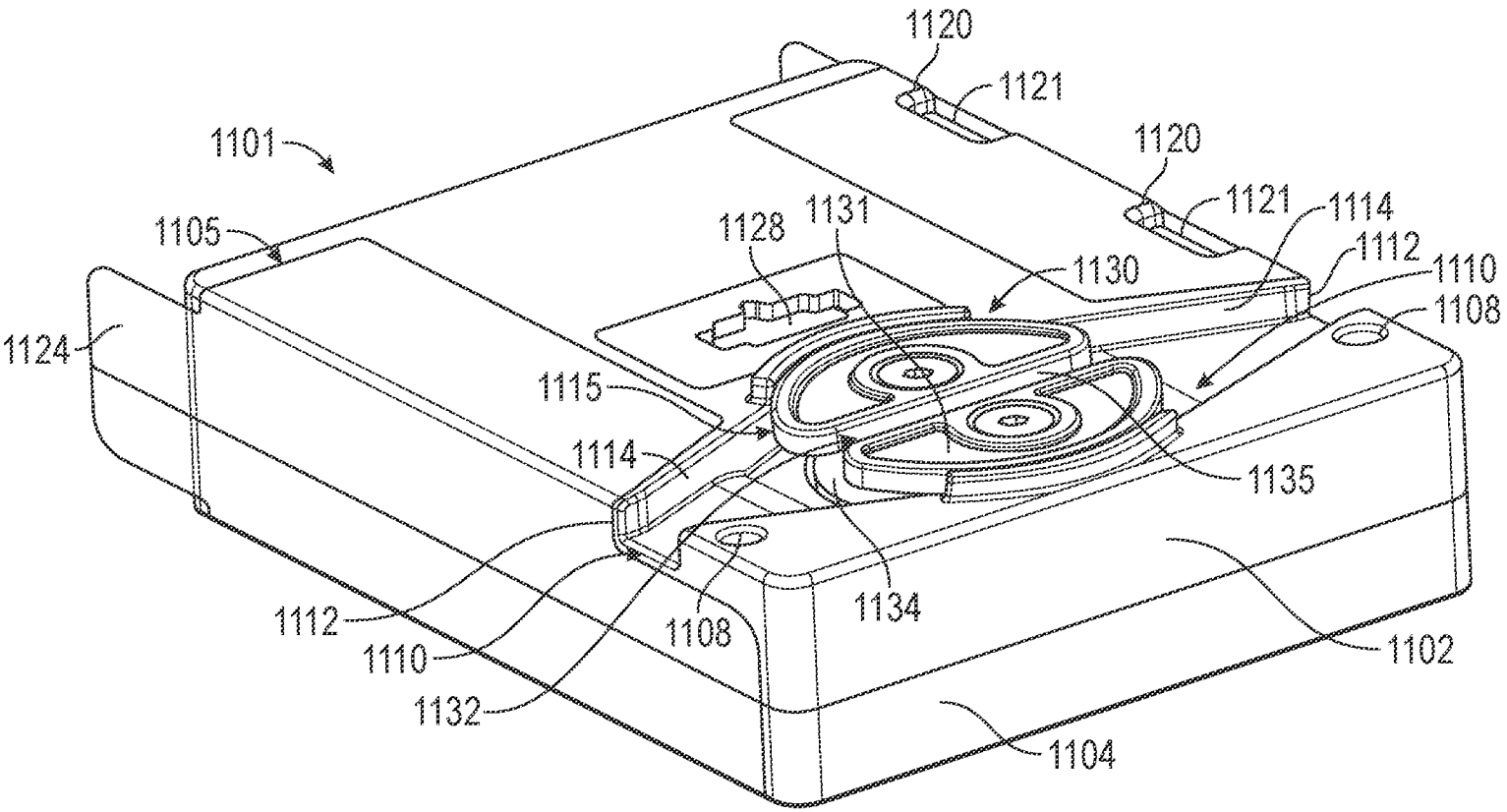
FIG. 12A is a perspective view illustration of a motorized lacing system having a modular spool, according to some example embodiments.
Figure 12B:
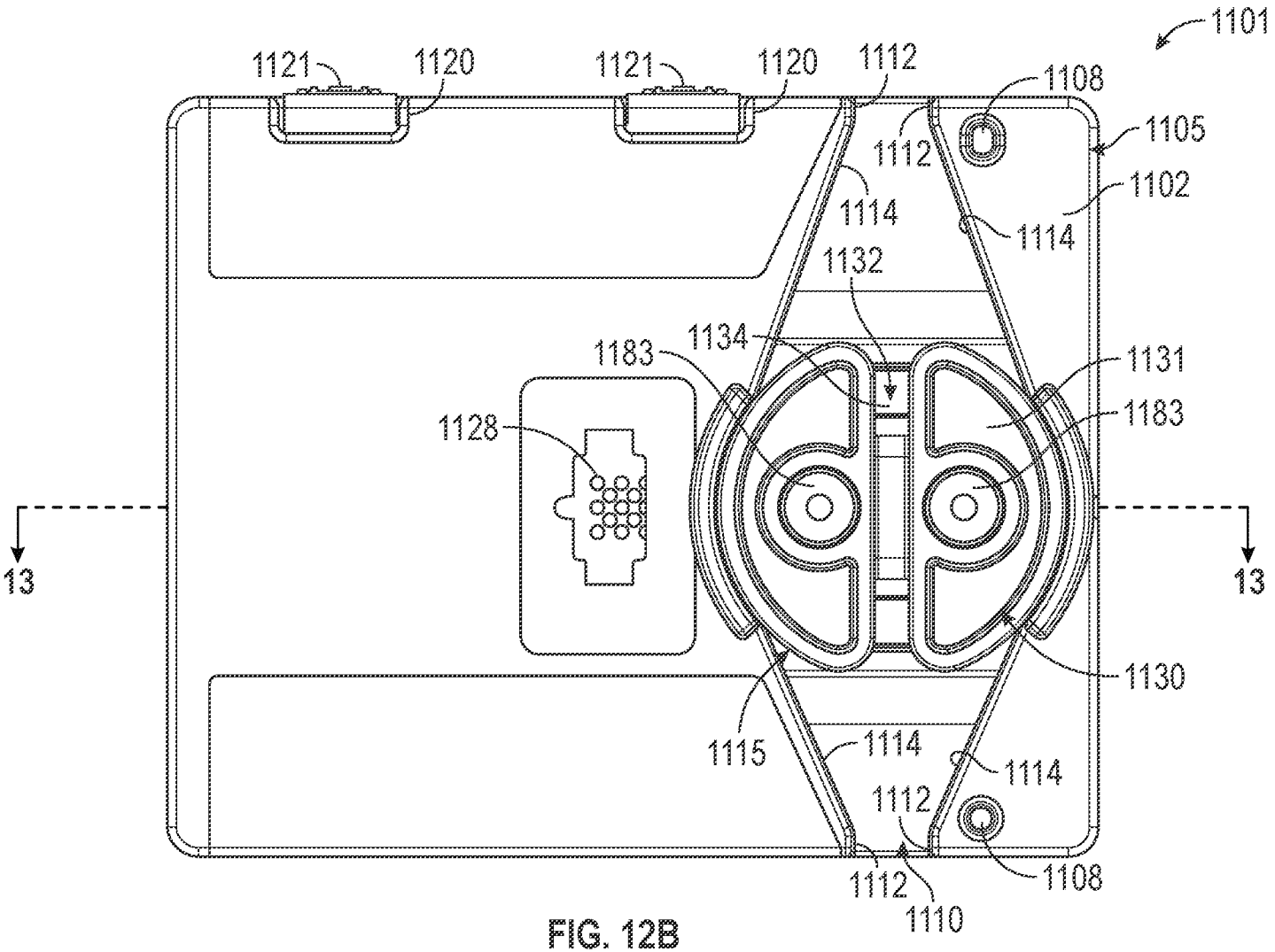
FIG. 12B is a top view of the motorized lacing system of FIG. 12A showing a winding channel through the modular spool aligned with a lacing channel through a housing.

FIG. 12A is a perspective view illustration of a motorized lacing system 1101 having a modular spool 1130, according to some example embodiments. FIG. 12B is a top view of the motorized lacing system 1101 of FIG. 12A showing winding channel 1132 extending through modular spool 1130 and aligned with lacing channel 1110 through housing structure 1105. Similar to spool 130 discussed above, modular spool 1130 provides a storage location for a lace, such as lace or cable 131 (FIG. 2F), when modular spool 1130 is wound to cinch lace 131 down on an article of footwear upper. Modular spool 1130 can be assembled from an assortment of components, such as upper plate 1131 and lower plate 1134. As such, modular spool 1130 can be made with components of different sizes without having to produce a completely different spool for each size. For example, sometimes it is desirable to produce a spool having a different diameter in order to change the generated torque and the associated pulling force on lace 131, or to accommodate a different sized lace or cable.

An example lacing engine 1101 can include upper component 1102 and lower component 1104 of housing structure 1105, case screws 1108, lace channel 1110 (also referred to as lace guide relief 1110), lace channel walls 1112, lace channel transitions 1114, spool recess 1115, button openings 1120, buttons 1121, button membrane seal 1124, programming header 1128, modular spool 1130, and winding channel (lace groove) 1132.

Figure 12C:
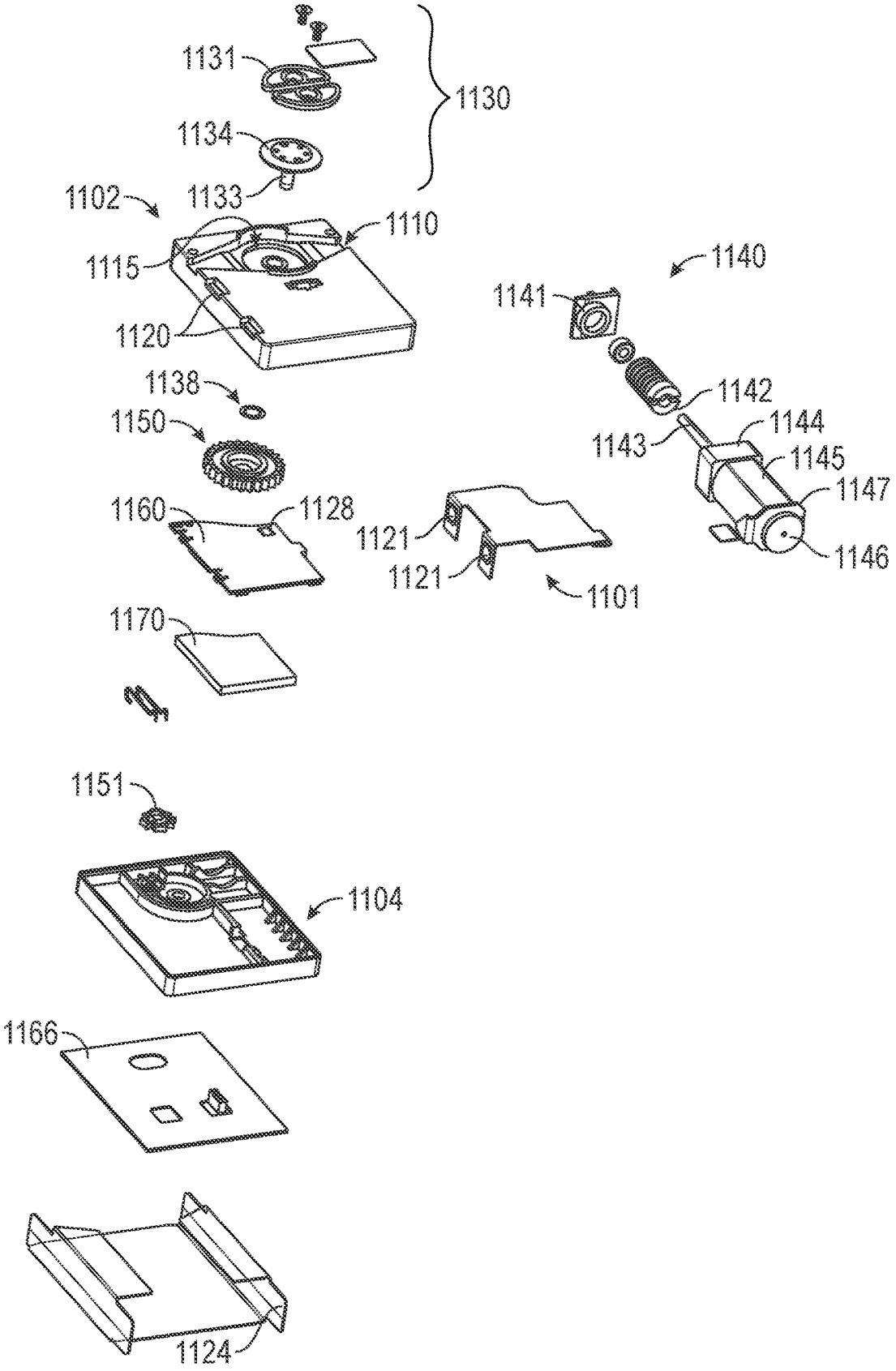
FIG. 12C is an exploded view illustration of the motorized lacing system of FIG. 12A showing components of a modular spool.

Housing structure 1105 is configured to provide a compact lacing engine for insertion into a sole of an article of footwear, as described herein, for example. Case screws 1108 can be used to hold upper component 1102 and lower component 1104 in engagement. Together, upper component 1102 and lower component 1104 provide an interior space for placement of components of motorized lacing system 1101, such as components of modular spool 1130 and worm drive 1140 (FIG. 12C). Lace channel walls 1112 can be shaped to guide lace 131 into and out of housing structure 1105 and lace channel transitions 1114 can be shaped to guide lace into and out of modular spool 1130. In an example, lace channel walls 1112 extend generally parallel to the major axis of lace channel 1110, while lace channel transitions 1114 extend oblique to the major axis of lace channel 1110 in extending between lace channel walls 1112 and spool recess 1115. Spool recess 1115 can comprise a partial cylindrical socket for receiving modular spool 1130.

Lace 131 can be positioned to extend into across lace channel 1110 and winding channel 1132. As modular spool 1130 is rotated by worm drive 1140, lace 131 is wound around drum 1135 (shown more clearly in FIG. 13) between upper plate 1131 and lower plate 1134. Buttons 1121 can extend through button openings 1120 and can be used to actuate worm drive 1140 to rotate modular spool 1130 in clockwise and counterclockwise directions. Programming header 1128 can permit circuit board 1160 (FIG. 12C) of lacing engine 1101 to be connected to external computing systems in order to characterize the lacing action provided by buttons 1121 and the operation of worm drive 1140, for example.

FIG. 12C is an exploded view illustration of motorized lacing system 1101 of FIG. 12A showing components of modular spool 1130. Motorized lacing system 1101 can comprise housing structure 1105, modular spool 1130, worm gear 1150, indexing wheel 1151, circuit board 1160, battery 1170, wireless charging coil 1166, button membrane seal 1124, buttons 1121 and worm drive 140.

Housing structure 1105 can comprise upper component 1102 and lower component 1104. Upper component 1102 can include lace channel 1110 and spool recess 1115. Modular spool 1130 can comprise upper plate 1131, winding channel 1132, spool shaft 1133 and lower plate 1134. Operation of modular spool 1130 relative to housing structure 1105 is explained with reference to FIGS. 12D and 13, below.

Worm drive 1140 can comprise bushing 1141, key 1142, drive shaft 1143, gear box 1144, gear motor 1145, motor encoder 1146 and motor circuit board 1147. Worm drive 1140, circuit board 1160, wireless charging coil 1166 and battery 1170 can operate in a similar manner as worm drive 140, circuit board 160, wireless charging coil 166 and battery 170 described herein and further description is not provided here for brevity.

Figure 12D:
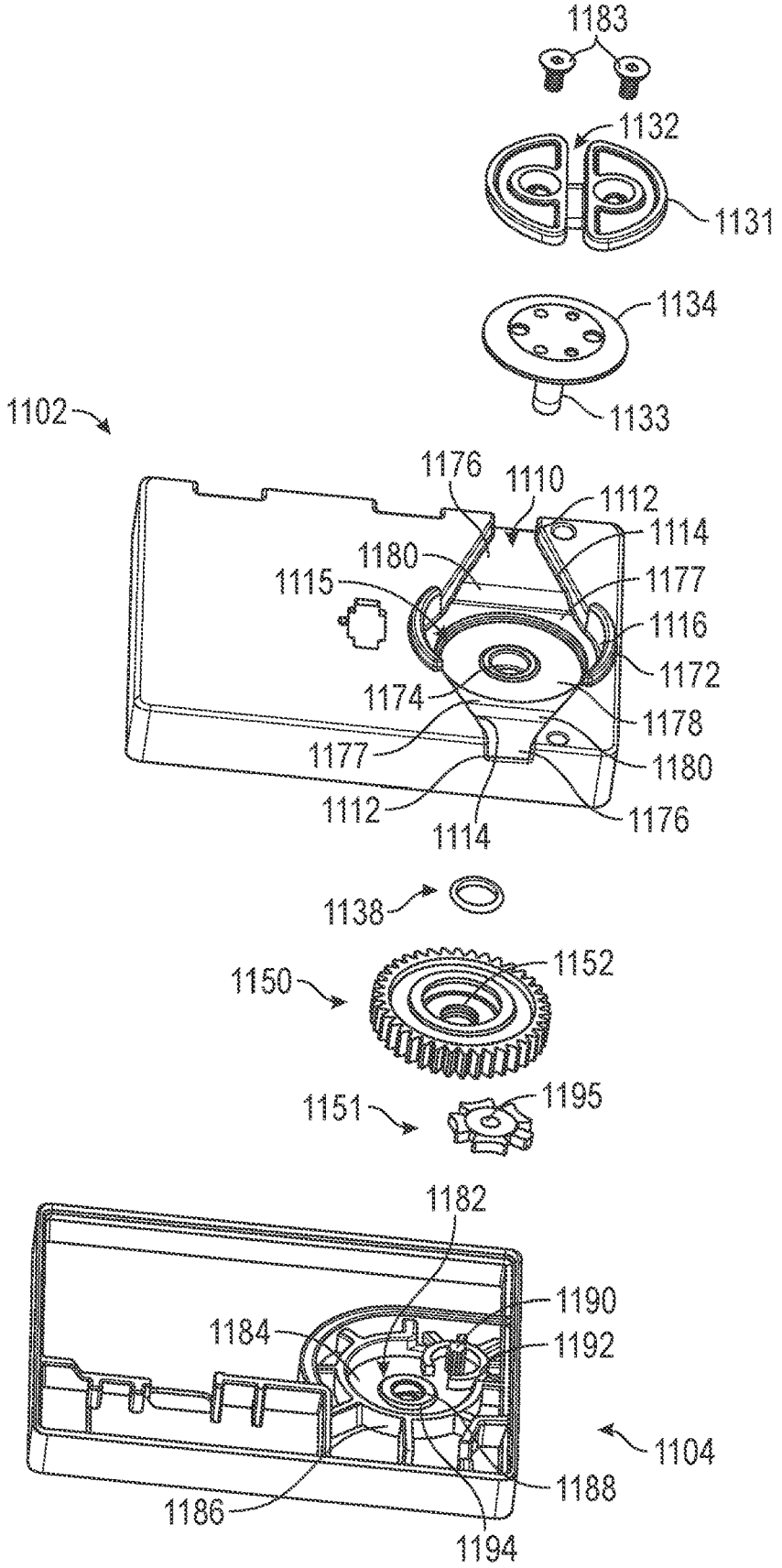
FIG. 12D is an exploded view of the modular spool of FIG. 12C showing the components positioned relative to upper and lower housing components.
Figure 13:
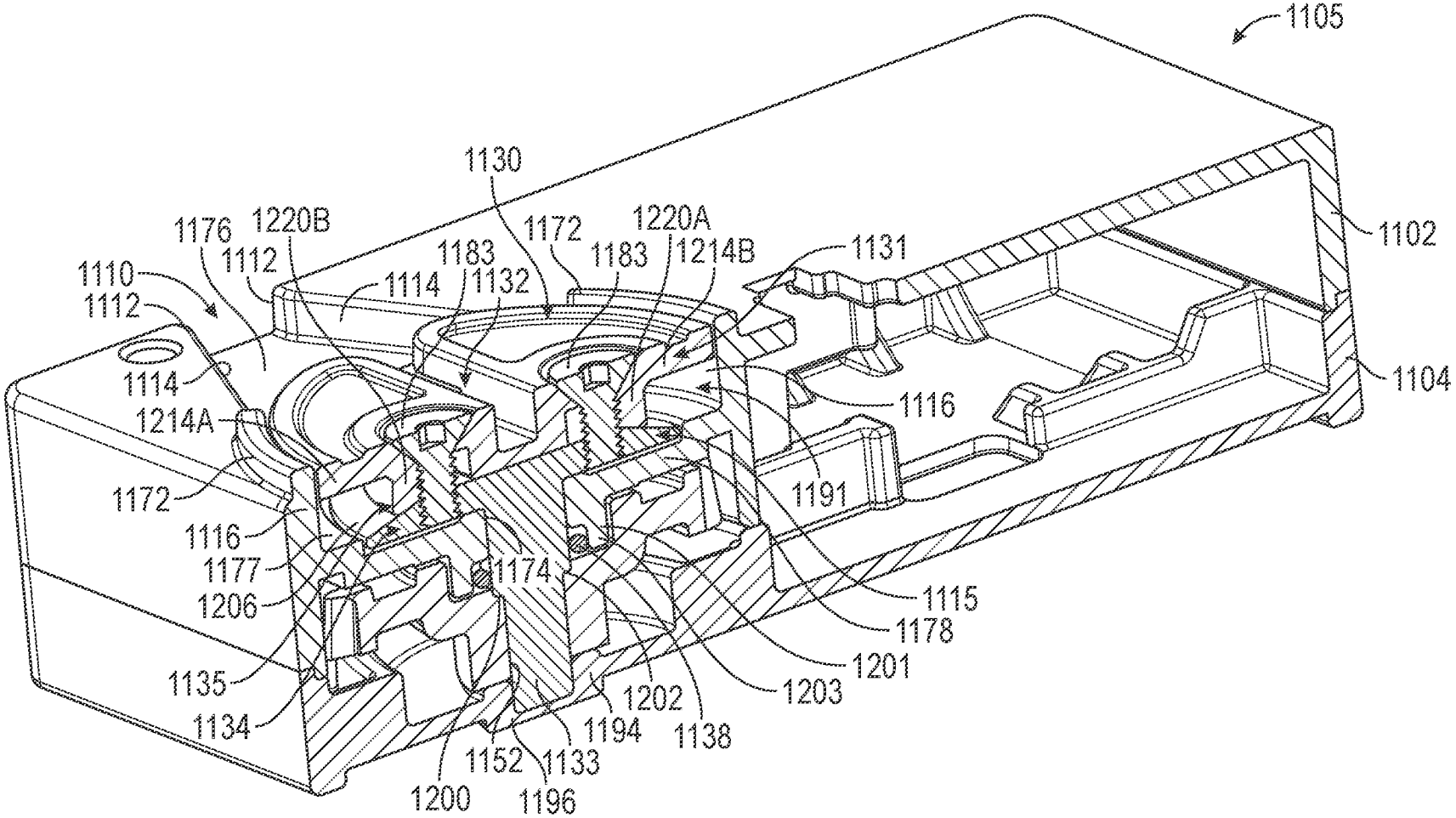
FIG. 13 is a cross-sectional view of the motorized lacing system of FIG. 12B showing a section through the modular spool.

FIG. 12D is an exploded view of modular spool 1130 of FIG. 12C showing components of modular spool 1130 positioned relative to upper and lower housing components 1102, 1104. Upper component 1102 can include lace channel 1110, channel walls (inlets) 1112, channel transitions (relief areas) 1114, spool walls 1116 for spool recess 1115, spool flanges 1172, shaft bearing 1174, channel floors 1176, floor 1177, counterbore 1178 and channel lips 1180. Lower component 1104 can include gear receptacle 1182, floor 1184, wall 1186, shaft socket 1188, wheel post 1190 and wheel base 1192. As shown in FIG. 13, fasteners 1183 can be used to assemble upper plate 1131 and lower plate 1134 so that modular spool 1130 can be inserted into spool recess 1115 of upper component 1102 and spool shaft 133 can be inserted through shaft bearing 1174 and into shaft socket 1188 in lower component 1104 when upper component 1102 and lower component 1104 are connected using fasteners such as case screws 1108 (FIG. 12A).

Fasteners 1183 can be used to secure upper plate 1131 to lower plate 1134 to form an assembled modular spool 1130. Seal 1138 can be positioned between upper plate 1131 and lower plate 1134 when assembled. Modular spool 1130 can be positioned into spool recess 1115 so that spool shaft 1133 is inserted into shaft bearing 1174. Lower plate 1134 can be configured to thereby seat in counterbore 1178 while upper plate 1131 is positioned adjacent spool flanges 1172 extending from spool walls 1116. Spool shaft 1133 can extend through shaft bearing 1174 to engage worm gear 1150 as socket 1152.

Worm gear 1150 can be positioned within gear receptacle 1182 spaced from floor 1184 by wall 1186. Socket 1188 can include flange 1194 to receive the end of spool shaft 1133. Bore 1195 in indexing wheel 1151 can be positioned around wheel post 1190 such that indexing wheel 1151 abuts wheel base 1192. With worm gear 1150 resting on flange 1194 and indexing wheel 1151 resting on wheel base 1192, teeth of indexing wheel 1151 can mate with a tooth, such as tooth 153 (FIG. 2I) on the bottom side of worm gear 1150, as discussed herein, to provide appropriate indexing action. Thus, worm drive 1140 can drive worm gear 150 to cause direct rotation of spool shaft 1133, such as by spool shaft 1133 being force fit into socket 1152. Additionally spool shaft 1133 and socket 1152 can be configured to have a splined connection, e.g., a plurality of mating ribs on one component and grooves on the other component, that can allow worm gear 1150 and lower plate 1134 to rotate together. The splined connection can eliminate the need for having a pinned connection therebetween, which requires an additional component and precise alignment of components for assembly. As discussed above, indexing wheel 1151 can be configured to arrest rotation of worm gear 1150 after a certain number of revolutions of worm gear 1150 by the indexing action.

FIG. 13 is a cross-sectional view of motorized lacing system 1101 of FIG. 12B showing a section through modular spool 1130. FIG. 13 illustrates modular spool 1130 in an assembled state inserted into spool recess 1115. Fasteners 1183 can hold lower plate 1134 in engagement with upper plate 1131. Lower plate 1134 is drawn into engagement with drum 1135 by fasteners 1183. Drum 1135 is positioned opposite spool walls 1116 to form a lace volume 1191 for storing lace 131. Lace volume 1191 can circumscribe winding channel 1132. Lace volume 1191 and winding channel 1132 are placed in the path of lacing channel 1110 between lace channel walls 1112 and lace channel transitions 1114. As discussed in greater detail below, modular spool 1130 is positioned and configured to be rotated within spool recess 1115 to permit pushing and pulling of lace 131 through lacing channel 1110 while preventing nesting and damage of lace 131.

Figure 14A:
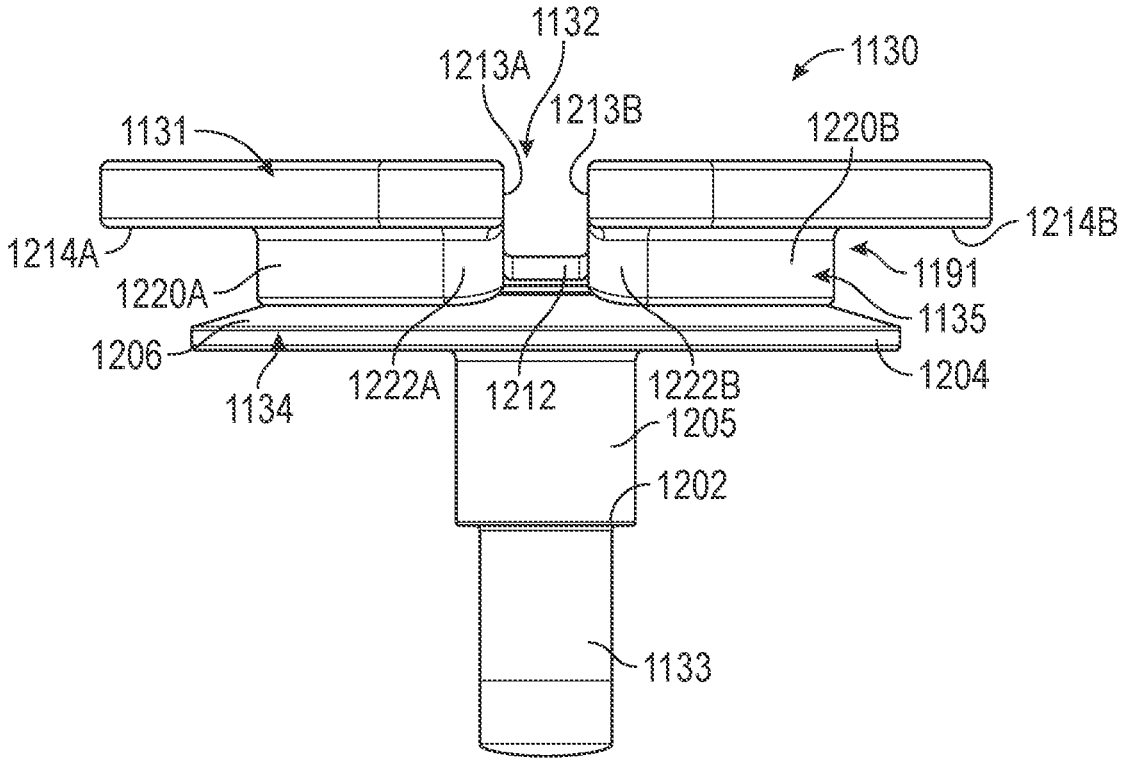
FIGS. 14A and 14B are side and top plan view illustrations, respectively, of the modular spool of FIGS. 12A-13 in an assembled state.
Figure 14B:
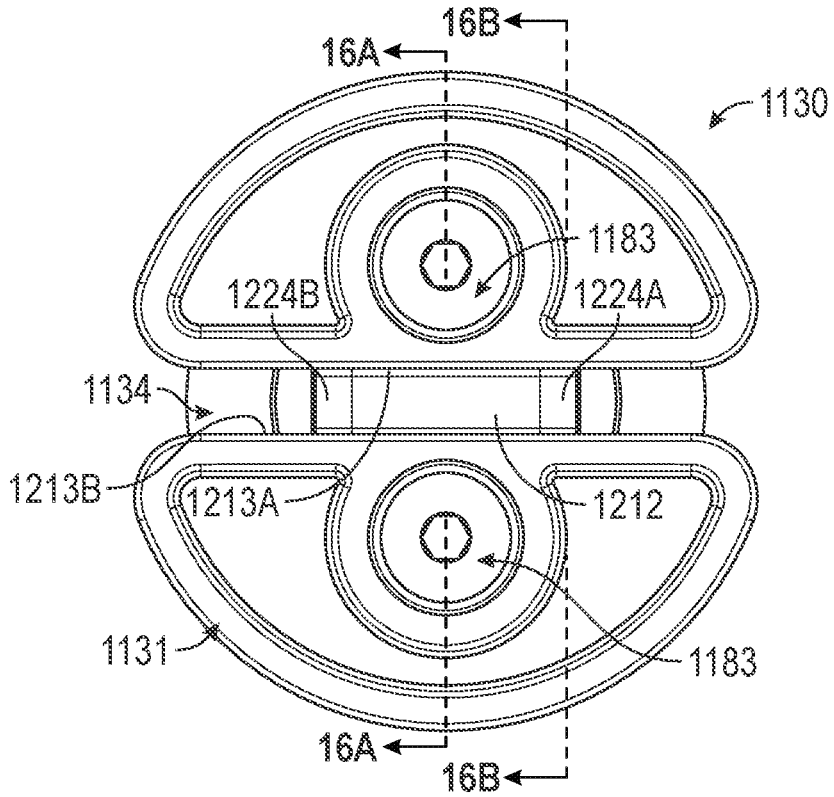
Figure 15B:
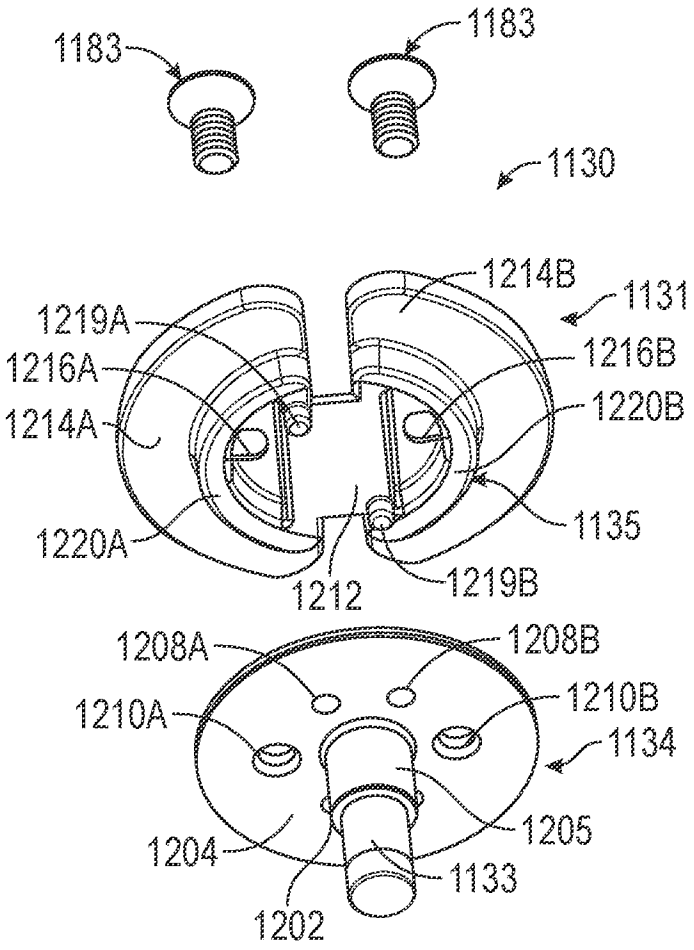
FIGS. 15A and 15B are top and bottom perspective view illustrations, respectively, of the modular spool of FIGS. 14A and 14B in an exploded state.
Figure 15A:
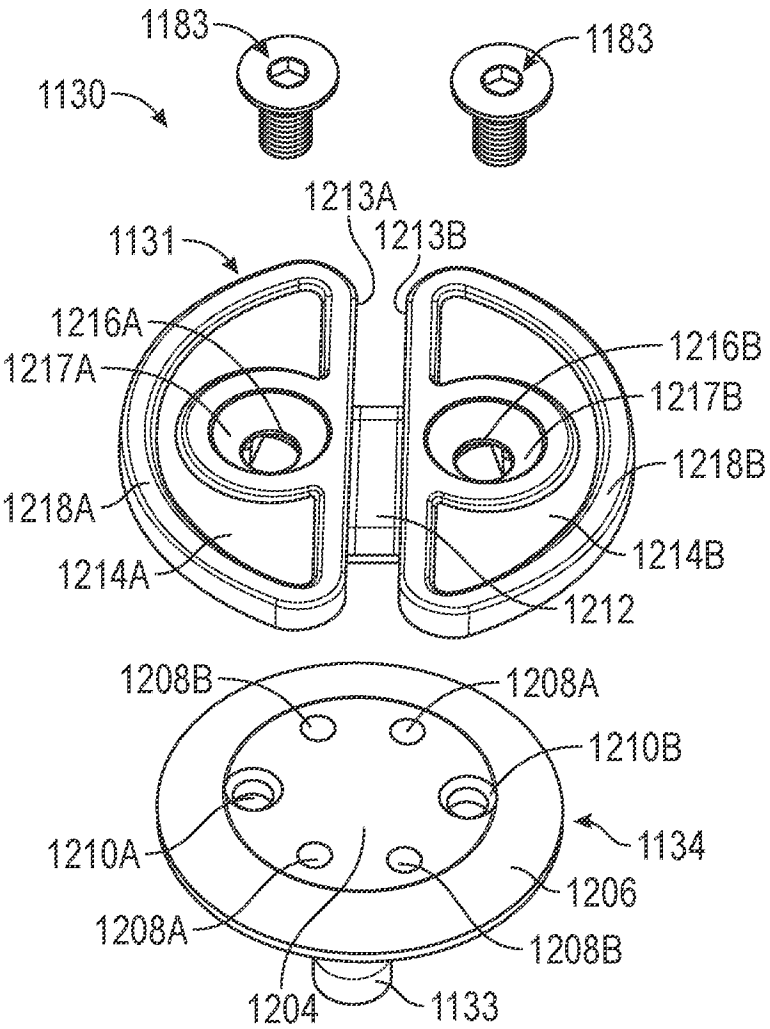

FIGS. 14A and 14B are side and top plan view illustrations, respectively, of modular spool 1130 of FIGS. 12A-13 in an assembled state. FIGS. 15A and 15B are top and bottom perspective view illustrations, respectively, of modular spool 1130 of FIGS. 14A and 14B in an exploded state. Modular spool 1130 can include upper plate 1131 and lower plate 1134, which can be held together by fasteners 1183.

Lower plate 1134 can include shaft 1131, shoulder 1202, disk portion 1204, upper shaft portion 1205, bevel 1206, timing ports 1208A, timing ports 1208B, and fastener bores 1210A and 1210B. Upper plate 1131 can include winding channel 1132, drum 1135, bridge 1212, first channel wall 1213A, second channel wall 1213B, first disk segment 1214A, second disk segment 1214B, first fastener bore 1216A, second fastener bore 1216B, first counterbore 1217A, second counterbore 1217B, first edge flange 1218A and second edge flange 1218B, first peg 1219A and second peg 1219B. Drum 1135 can comprise first drum wall 1220A and second drum wall 1220B.

As shown in FIG. 14A, winding channel 1132 is configured to extend through drum 1135 to open to lace volume 1191. Lace volume 1191 is partially bounded by first disk segment 1214A and second disk segment 1214B at an upper portion and disk portion 1204 at a lower portion. Winding channel 1132 smoothly transitions from walls 1213A and 1213B to drum walls 1220A and 1220B, respectively, at contours 1222A and 1222B to help prevent damaging of lace 131.

As shown in FIG. 14B, bridge 1212 connects drum walls 1213A and 1213B. Bridge 1212 can include contours 1224A and 1224B to smoothly transition winding channel 1132 between bridge 1212 and lower plate 1134.

Figure 16A:
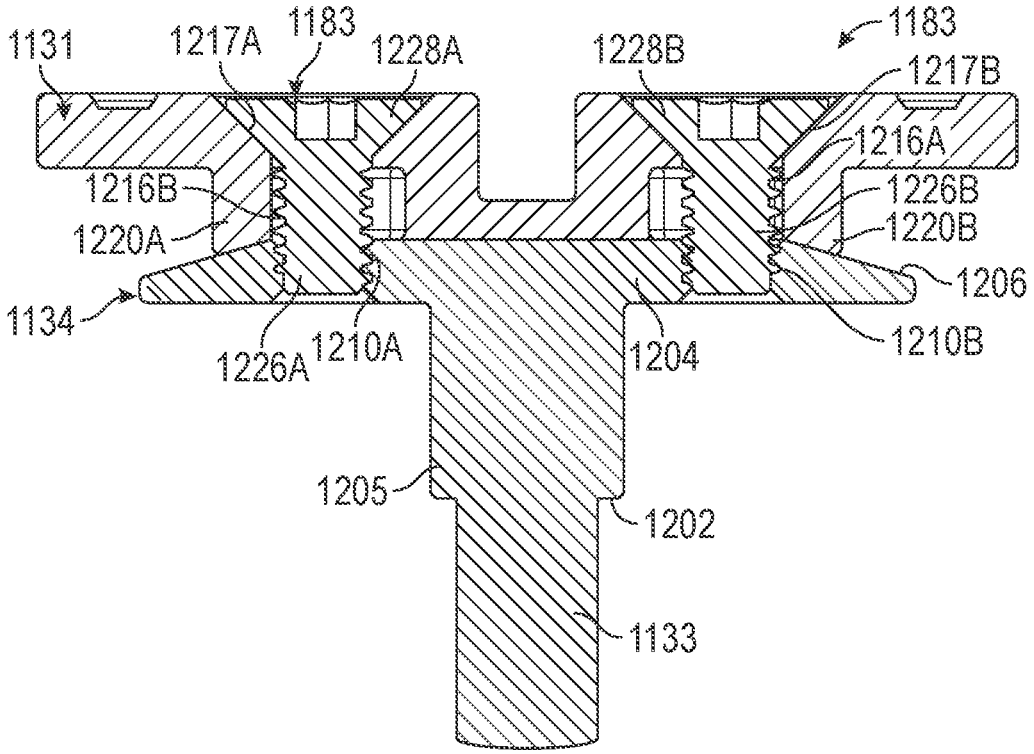
FIG. 16A is a side cross-sectional view of the modular spool of FIG. 14B illustrating a connection interface between upper and lower components of the modular spool.

FIG. 16A is a side cross-sectional view of modular spool 1130 of FIG. 14B illustrating a connection interface between upper plate 1131 and lower plate 1134 of modular spool 1130. FIG. 16A shows fasteners 1183 extending between disk portion 1204 of lower plate 1134 and disk segments 1214A and 1214B upper plate 1131. More specifically, shanks 1226A and 1226B of fasteners 1183 extend through first and second fastener bores 1216A and 1216B and engage fastener bores 1210A and 1210B of disk portion 1204. In the illustrated embodiment, fastener bores 1216A and 1216B comprise non-threaded through bores that permit shanks 1226A and 1226B to freely pass therethrough, while bores 1210A and 1210B comprise threaded bores to engage with mating threading on shanks 1226A and 1226B. With shanks 1226A and 1226B engaged with bores 1210A and 1210B, respectively, heads 1228A and 1228B of fasteners 1183 engage counterbores 1217A and 1217B. As such, drum walls 1220A and 1220B of upper plate 1131 are brought into contact with disk portion 1204 of lower plate 1134 to form lace volume 1191.

Figure 16B:
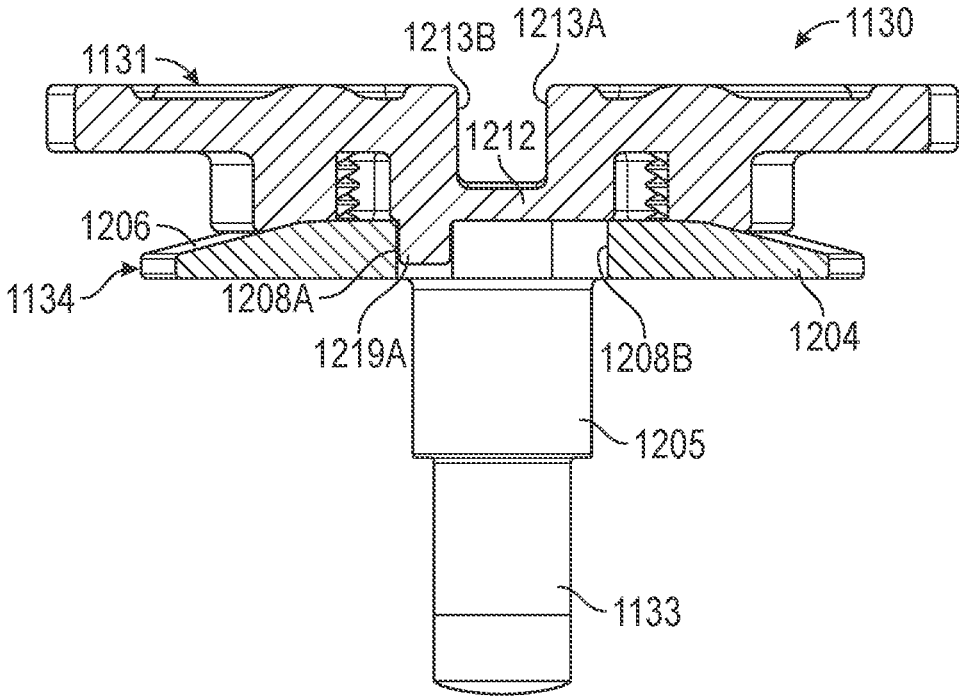
FIG. 16B is a side cross-sectional view of the modular spool of FIG. 14B illustrating an indexing interface between upper and lower components of the modular spool.

FIG. 16B is a side cross-sectional view of modular spool 1130 of FIG. 14B illustrating an indexing interface between upper plate 1131 and lower plate 1134 of modular spool 1130. FIG. 16B shows the engagement of first peg 1219A with timing port 1208A, while timing port 1208B is unoccupied. As shown in FIG. 15B, upper plate 1131 includes two pegs 1219A and 1219B that are configured to mate with either timing ports 1208A or timing ports 1208B. Thus, upper plate 1131 can be connected to lower plate 1134 in two orientation. This can facilitate easier assembly of upper plate 1131 to lower plate 1134. For example, once upper plate 1131 is brought into engagement with lower plate 1134 so that pegs 1219A and 1219B are contacting disk portion 1204, upper plate 1131 need only be rotated less than one-hundred-eighty degrees to bring pegs 1219A and 1219B into engagement with one of the sets of ports 1208A or 1208B. Ports 1208A can be aligned along an axis that is oblique to an axis extending through both of fastener bores 1210A and 1210B. The axis of fastener bores 1210A and 1210B can be perpendicular to the central axis of winding channel 1132. Ports 1208B can be aligned along an axis that is oblique to both the axes of ports 1208A and bores 1210A and 1210B.

Pegs 1219A and 1219B can be sized to form an interference fit with ports 1208A and 1208B. Thus, upper plate 1131 can be held in engagement with lower plate 1134 to facilitate assembly of fasteners 1183 into fastener bores 1210A and 1210B. Pegs 1219A and 1219B are sized so as to not extend all the way through ports 1208A or 1208B in order to prevent pegs 1219A and 12129B from interfering with rotation of disk portion 1204 on counterbore 1178.

Returning to FIG. 13, the assembly and operation of modular spool 1130 and housing structure 1105 are described. As shown, the distal end of shaft 1133 rests within flange 1194. Lower housing 1104 includes wall 1196 that prevents shaft 1133 from passing through lower housing 1104. Worm gear 1150 includes bore 1152 and counterbore 1200 through which shaft 1133 extends. Bore 1152 is sized to tightly receive shaft 1133, such as via a force fit, so that shaft 1133 and lower plate 1134 rotate with worm gear 1150.

Rotation of lower plate 1134 produces rotation of upper plate 1131 via fasteners 1183. Shaft 1133 includes shoulder 1202 that is configured to engage counterbore 1200. Worm gear 1150 can also include socket 1201 that can engage with wall 1203 on upper component 1102. Engagement of wall 1203 with socket 1201 can help ensure that worm gear 1150 rotates in a plane parallel to floor 1177 of upper component 1102. Upper shaft portion 1205 of shaft 1133 can engage shaft bearing 1174 in upper component 1102 to help ensure that lower plate 1134 rotates in a plane parallel to floor 1177. Disk portion 1204 of lower plate 1134 can engage counterbore 1178 and can have bevel 1206. Bevel 1206 can have a tapered end that can align with floor 1177 to provide a smooth transition between upper component 1102 and disk portion 1204 of lower plate 1134 in order to help prevent damage to lace 131. Disk portion 1204 and bevel 1206 can also help prevent ingress of lace 131 into spaces within housing structure 1105.

Drum walls 1220A and 1220B of drum 1135 extend away from disk portion 1204 to provide height for lace volume 1191. Drum walls 1220A and 1220B can be configured to position disk segments 1214A and 1214B adjacent spool flanges 1172 that extend from spool walls 1116. Spool flanges 1172 can provide clearance for modular spool 1130 to facilitate rotation. That is, flanges 1172 can shield modular spool 1130 from a cover or lid structure, e.g., lid 20 of FIG. 1, positioned over modular spool 1130 and lacing channel 1110 so that cover or lid structure does not interfere with rotation of modular spool 1130. Spool flanges 1172 can also comprise ribs or other barriers to prevent ingress of lace 131 into spaces within housing structure 1105.

Lace volume 1191 is positioned at approximately the height of lace channel walls 1112 and lace channel transitions 1114. Counter bore 1178 can be positioned lower (e.g., further into the interior of housing structure 1105) than floors 1176 via the shape of channel lips 1180 in order to align floors 1176 with the center of lace volume 1191 or drum walls 1220A and 1220B in order to facilitate winding and unwinding of lace 131. For example, floors 1176 can align with the center of lace volume 1191 so that lace 131 will be pulled to the center of drum 1135 and will subsequently fall above and below the center of drum 1135 as more layers of lace 131 are wound around drum 1135.

In view of the foregoing, modular spool 1130 can include interchangeable components that permit the spool element of motorized lacing system 1101 to be modified without redesigning motorized lacing system 1101 or a non-modular spool. For example, lower plate 1134 can provide a component configured for operation with motorized lacing system 1101 that can mate in a desirable manner with lower component 1104. However, different configurations of upper plate 1131 can be coupled with lower plate 1134 to alter the properties of modular spool 1130. For example, different configurations of upper plate 1131 can have different heights of spool walls 1220A and 1220B to provide an increase in lace volume 1191. Also, spool walls 1220A and 1220B can be configured to provide drum 1135 with different diameters to alter the torque that is applied to modular spool 1130 by lace 131 during a winding operation, which can influence the operation of gear motor 1145. Thus, if a redesign of various components of motorized lacing system 1101 is desired, the entirety of the spool component need not be redesigned or changed out.

Additional Notes

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The disclosure, therefore, is not to be taken in a limiting sense, and the scope of various embodiments includes the full range of equivalents to which the disclosed subject matter is entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein, such as the motor control examples, can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. An Abstract, if provided, is included to comply with 37 C.F.R. § 1.72(b), to allow the reader to quickly ascertain the nature of the technical disclosure. It is submitted with the understanding that it will not be used to interpret or limit the scope or meaning of the claims. Also, in the above Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A method of assembling a modular winding spool for a footwear lacing apparatus, the method comprising:

positioning an upper plate and a lower plate of the modular winding spool adjacent each other;

inserting a first fastener into the upper and lower plates to couple the upper and lower plates; and inserting the upper and lower plates into a lacing channel of the footwear lacing apparatus;

wherein the footwear lacing apparatus comprises a housing for receiving the modular winding spool and the lacing channel comprises an elongate channel extending through the housing, the lacing channel being accessible across a length of a superior side of the housing.

2. The method of assembling a modular winding spool of claim 1, further comprising:

inserting the first fastener through a first fastener bore in the upper plate and into a first fastener bore in the lower plate; and inserting a second fastener through a second fastener bore in the upper plate and into a second fastener bore in the lower plate.

3. The method of assembling a modular winding spool of claim 2, further comprising:

rotating the upper plate and the lower plate to align indexing pegs of the upper plate or the lower plate with respective peg ports of the lower plate or the upper plate; and inserting the indexing pegs into the peg ports.

4. The method of assembling a modular winding spool of claim 3, further comprising inserting a pair of the indexing pegs of the upper plate into a pair of the peg ports in the lower plate, wherein the lower plate includes multiple pairs of peg ports including the pair of peg ports that allow the upper plate to be assembled to the lower plate in a plurality of orientations.

5. The method of assembling a modular winding spool of claim 3, wherein inserting the indexing pegs into the peg ports aligns the first fastener bore in the upper plate with the first fastener bore in the lower plate and the second fastener bore in the upper plate with the second fastener bore in the lower plate, respectively.

6. The method of assembling a modular winding spool of claim 1, further comprising positioning the lower plate against a drum of the upper plate to form a winding area between the upper and lower plates, the drum comprising a cylindrical body extending from the upper plate to space the upper plate from the lower plate.

7. The method of assembling a modular winding spool of claim 6, wherein inserting the upper and lower plates into the lacing channel of the footwear lacing apparatus comprises inserting the lower plate into a counterbore within the lacing channel so that the lower plate is recessed out of the lacing channel, the drum of the modular winding spool is aligned with the lacing channel and the upper plate is out of the counterbore.

8. The method of assembling a modular winding spool of claim 7, wherein the upper plate extends radially beyond the counterbore.

9. The method of assembling a modular winding spool of claim 7, wherein the upper plate is positioned above the lacing channel.

10. The method of assembling a modular winding spool of claim 1, further comprising inserting a shaft of the lower plate through a bore of the footwear lacing apparatus transverse to the lacing channel.

11. The method of assembling a modular winding spool of claim 10, further comprising attaching a gear to the shaft.

12. The method of assembling a modular winding spool of claim 1, further comprising selecting the upper plate from a group comprising a first upper plate having a first drum of a first size and a second upper plate having a second drum of a second size, the second size different than the first size.

13. The method of assembling a modular winding spool of claim 1, further comprising inserting the footwear lacing apparatus into a lacing engine cavity within a sole structure for an article of footwear.

14. The method of assembling a modular winding spool of claim 1, further comprising extending a lace cable through a winding channel of a lace drum disposed between the upper plate and the lower plate.

15. The method of assembling a modular winding spool of claim 14, further comprising extending the lace cable out of ends of the lacing channel disposed within a within the housing surrounding the modular winding spool, the ends of the lacing channel being located on opposite sides of the modular winding spool.

16. A method of assembling a modular winding spool for a footwear lacing apparatus, the method comprising:

positioning an upper plate and a lower plate of the modular winding spool adjacent each other to be aligned along a rotation axis;

inserting a fastener into the upper and lower plates to couple the upper and lower plates;

inserting the upper and lower plates into a lacing channel of the footwear lacing apparatus; and inserting the footwear lacing apparatus into a lacing engine cavity within a sole structure for an article of footwear so that the rotation axis extends in a superior-inferior direction and the modular winding spool is configured to pull lace cable through medial and lateral sides of the sole structure.

17. The method of assembling a modular winding spool of claim 16, further comprising extending the modular winding spool through an opening in an upper surface of a housing structure of the footwear lacing apparatus to engage a gear positioned within the housing structure.

18. A method of assembling a modular winding spool for a footwear lacing apparatus, the method comprising:

selecting an upper plate from a group comprising:

a first upper plate having a first drum of a first size and a first pair of fastener bores of a first configuration; and a second upper plate having a second drum of a second size and a second pair of fastener bores of a second configuration, the second size different than the first size and the second configuration equivalent to the first configuration;

positioning the upper plate and a lower plate of the modular winding spool adjacent each other to align the first or second pair of fastener bores with a third pair of fastener bores of the lower plate;

inserting a fastener into the upper and lower plates to couple the upper and lower plates; and inserting the upper and lower plates into a lacing channel of the footwear lacing apparatus.

19. The method of assembling a modular winding spool of claim 18, wherein the first configuration comprises a first size and a first spacing of bores of the first pair of fastener bores and the second configuration comprises a second size and a second spacing of bores of the second pair of fastener bores.

20. The method of assembling a modular winding spool of claim 18, wherein the first upper plate and the second upper plate are each sized to fit into the lacing channel.

21. A method of assembling a modular winding spool for a footwear lacing apparatus, the method comprising:

positioning an upper plate and a lower plate of the modular winding spool adjacent each other;

inserting a first fastener into the upper and lower plates to couple the upper and lower plates;

inserting the upper and lower plates into a lacing channel of the footwear lacing apparatus;

inserting a shaft of the lower plate through a bore of the footwear lacing apparatus transverse to the lacing channel; and attaching a gear to the shaft.

* * * * *